US005338651A

United States Patent [19]

Naruse et al.

[11] Patent Number: 5,338,651

[45] Date of Patent: * Aug. 16, 1994

[54] SILVER HALIDE COLOR PHOTOGRAPHIC LIGHT-SENSITIVE MATERIAL

[75] Inventors: Hideaki Naruse; Makoto Suzuki; Takehiko Sato, all of Kanagawa, Japan

[73] Assignee: Fuji Photo Film Co., Ltd., Kanagawa, Japan

[ * ] Notice: The portion of the term of this patent subsequent to Oct. 26, 2010 has been disclaimed.

[21] Appl. No.: 981,860

[22] Filed: Nov. 27, 1992

[30] Foreign Application Priority Data

Nov. 27, 1991 [JP] Japan ..... 3-335917

[51] Int. Cl.[5] ..... G03C 1/46

[52] U.S. Cl. ..... 430/505; 430/557; 430/558; 430/384; 430/385

[58] Field of Search ..... 430/558, 384, 385, 585, 430/557

[56] References Cited

U.S. PATENT DOCUMENTS

| | | | |
|---|---|---|---|
| 4,873,183 | 10/1989 | Tachibana et al. | 430/558 |
| 4,910,127 | 3/1990 | Sakaki et al. | 430/558 |
| 5,023,169 | 6/1991 | Hirabayashi et al. | 430/557 |
| 5,091,297 | 2/1992 | Fukunagya et al. | 430/558 |
| 5,213,958 | 5/1993 | Motoki et al. | 430/557 |
| 5,238,803 | 8/1993 | Ichijima et al. | 430/557 |
| 5,256,526 | 10/1993 | Suzuki et al. | 430/384 |
| 5,270,153 | 12/1993 | Suzuki et al. | 430/384 |

FOREIGN PATENT DOCUMENTS

| | | |
|---|---|---|
| 0342637 | 11/1989 | European Pat. Off. . |
| 0447920 | 9/1991 | European Pat. Off. . |
| 0447969 | 9/1991 | European Pat. Off. . |
| 0488248 | 6/1992 | European Pat. Off. . |
| 0491197 | 6/1992 | European Pat. Off. . |
| 3141057 | 6/1988 | Japan . |
| 3149647 | 6/1988 | Japan . |
| 3264755 | 11/1988 | Japan . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic light-sensitive material which provides a good color developability and an excellent color reproducibility in every hue comprises at least a cyan dye-forming emulsion layer, a magenta dye-forming emulsion layer and a yellow dye-forming emulsion layer, wherein the cyan dye-forming emulsion layer contains at least one cyan dye-forming coupler represented by the following Formula (I) or (II) and the yellow dye-forming emulsion layer contains at least one yellow dye-forming coupler represented by the following Formula (III) or (IV):

(I)

(II)

to form a homopolymer or a copolymer;

(III)

wherein $X_3$ represents (IV)

with the substituents as defined herein the specification.

16 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, more specifically to a silver halide color photographic light-sensitive material which provides good color developability and excellent color reproducibility in every hue.

BACKGROUND OF THE INVENTION

A silver halide color photographic light-sensitive material is subjected to an imagewise exposure and then to development with an aromatic primary amine type color development agent to result in generating an oxidation product of the developing agent, which reacts with a dye-forming coupler (hereinafter referred to as a coupler) to thereby form a dye image. In the silver halide color photographic light-sensitive material, usually used as the coupler are a yellow dye-forming coupler, a cyan dye-forming coupler and a magenta dye-forming coupler in combination. The dyes formed by these couplers have undesired sub-absorptions in many cases, and in employing them for a multi-layer constitutional silver halide color photographic light-sensitive material, the color reproducibility thereof is inclined to be deteriorated. Accordingly, there have so far been proposed the use of couplers which form an image with less sub-absorption and techniques of combining such couplers.

With respect to a magenta coupler, it is well known that a dye formed by a pyrazoloazole type magenta coupler has less sub-absorption, particularly in 420 to 450 nm, than a dye formed by a 5-pyrazolone type magenta coupler and provides a sharp visible absorption spectrum.

However, improvement only in a magenta dye would be insufficient to reproduce well all colors of a subject by combining the cyan dye, magenta dye and yellow dye.

It is disclosed in JP-A-63-231451 (the term "JP-A" as used herewith means an unexamined Japanese patent application) that a specific yellow coupler is combined with a pyrazoloazole magenta coupler to try to improve color reproducibility in every hue.

The yellow coupler employed in JP-A-63-231451 is disclosed in JP-A-63-123047 as a yellow coupler which provides a dye showing a sharp absorption spectrum and has an excellent color developability and less fog as well as less fluctuation in color developability by pH of a color developing solution. However, the effects are insufficient with the combination described in JP-A-63-231451 and insufficient as well in the color developability of the yellow coupler.

Further, the conventional phenol type and naphthol type couplers have unfavorable sub-absorptions in the yellow region of 400 to 430 nm, and accordingly have the serious problem that the color reproducibility is markedly reduced.

There are proposed as a means for solving this problem, cyan couplers such as pyrazoloazoles described in U.S. Pat. No. 4,873,183 and 2,4-diphenyimidazoles described in EP 249,453A2. The dyes formed by these couplers have less unfavorable absorptions in a short wavelength region as compared with the dyes formed by the conventional cyan couplers and therefore are preferable in terms of color reproducibility. However, these couplers are not deemed to have enough color reproducibilities and in addition, there remain problems in actual use, such as a low coupling activity.

Further, pyrazoloimidazoles are proposed in U.S. Pat. No. 4,728,598. These couplers are improved in coupling activity, but are insufficient in terms of hue.

SUMMARY OF THE INVENTION

An object of the present invention is to provide a silver halide color photographic light-sensitive material capable of providing a dye having a good color developability and an excellent color reproducibility in every hue.

It has been found that the above and other objects of the present invention can be achieved by a silver halide color photographic light-sensitive material comprising a support and provided thereon at least a silver halide emulsion layer containing a cyan dye-forming coupler, a silver halide emulsion layer containing a magenta dye-forming coupler and a silver halide emulsion layer containing a yellow dye-forming coupler, wherein the silver halide emulsion layer containing the cyan dye-forming coupler contains at least one cyan dye-forming coupler represented by the following Formula (I) or (II) and the silver halide emulsion layer containing the yellow dye-forming coupler contains at least one yellow dye-forming coupler represented by the following Formula (III) or (IV):

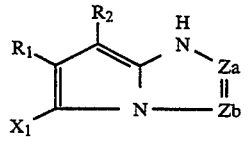

(I)

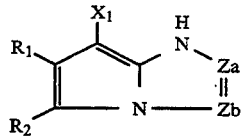

(II)

wherein Za and Zb each represents —C($R_3$)= and —N=, provided that one of Za and Zb is —N= and the other is —C($R_3$)=; $R_1$ and $R_2$ each is an electron attractive group having a Hammett's substituent constant $\sigma p$ of 0.2 or more and the sum of the $\sigma_p$ values of $R_1$ and $R_2$ is 0.65 or more; $R_3$ represents a hydrogen atom or a substituent; $X_1$ represents a hydrogen atom or a group capable of splitting off upon a reaction with an oxidation product of an aromatic primary amine color developing agent; the group represented by $R_1$, $R_2$, $R_3$ or $X_1$ may be a divalent group and combine with a polymer which is higher than a dimer and which has a high molecular weight chain to form a homopolymer or a copolymer;

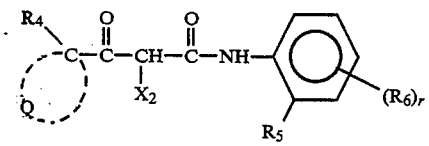

(III)

in Formulas (III), $R_4$ represents a monovalent group excluding a hydrogen atom; Q represents a group of non-metallic atoms necessary to form a 3 to 5-membered hydrocarbon ring or a 3 to 5-membered heterocyclic ring containing at least one hetero atom selected from N, S, O and P together with C, provided that $R_4$ is not combined with Q to form a ring; $R_5$ represents a hydrogen atom, a halogen atom, an alkoxy group, an aryloxy group, an alkyl group, or an amino group; $R_6$ represents a substituent group; $X_2$ represents a hydrogen atom or a group capable of splitting off upon a reaction with an oxidation product of an aromatic primary amine color developing agent; r represents an integer of 0 to 4, provided that when r is plural, $R_6$ may be the same or different;

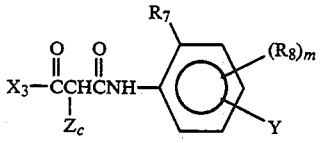

(IV)

wherein $X_3$ represents

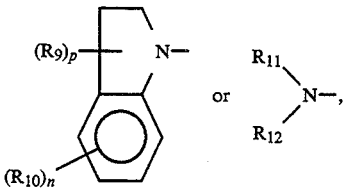

$R_7$ represents a halogen atom or an alkoxy group; $R_8$, $R_9$and $R_{10}$ each represents a substituent; $R_{11}$ represents an alkyl group; $R_{12}$ represents an alkyl group or an aryl group; $Z_c$ represents a group capable of splitting off upon a reaction with an oxidation product of an aromatic primary amine color developing agent; Y represents an alkoxycarbonyl group, a sulfamoyl group, a carbamoyl group, an N-sulfonylsulfamoyl group, an N-acylsulfamoyl group, an acylamino group, an N-sulfonylcarbamoyl group, or a sulfonamido group; and p, m and n represent the integers of 0 to 2, 0 to 3 and 0 to 4, respectively.

The present invention can provide an silver halide color photographic light-sensitive material having an excellent color reproducibility and good color developability in every hue.

DETAILED DESCRIPTION OF THE INVENTION

The present invention will be explained below in detail.

First, Formulas (I) and (II) will be explained.

Za and Zb each represents —C($R_3$)= or —N=, provided that one of Za and Zb is —N=and the other is —C($R_3$)=.

That is, to be specific, the cyan couplers of the present invention are cyan dye-forming couplers represented by the following Formulas (I-a), (I-b), (II-a) and (II-b):

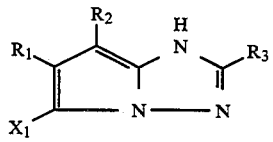

(I-a)

-continued

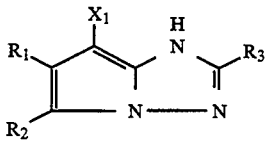

(II-a)

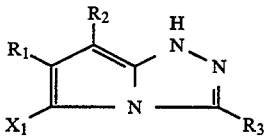

(I-b)

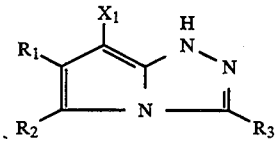

(II-b)

wherein $R_1$, $R_2$, $R_3$ and $X_1$ have the same meaning as $R_1$, $R_2$, $R_3$ and $X_1$ in Formulas (I) and (II), respectively.

$R_3$ represents a hydrogen atom or a substituent, and there can be given as examples of the substituent, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. Of these substituents, the substituents other than a halogen atom, a cyano group, a hydroxyl group, a nitro group and a carboxyl group may further be substituted with the substituents exemplified for $R_3$.

To be more specific, $R_3$ represents a hydrogen atom, a halogen atom (for example, a chlorine atom and a bromine atom), an aliphatic group (an aliphatic group having preferably 1 to 32 carbon atoms which may be linear, branched or cyclic, and saturated or unsaturated, for example, an alkyl group, an aralkyl group, an alkenyl group, an alkynyl group, a cycloalkyl group, and a cycloalkenyl group, and to be more detailed, methyl, ethyl, propyl, isopropyl, t-butyl, tridecyl, 2-methanesulfonylethyl, 3-(3-pentadecylphenoxy)propyl, 3-[4-{2-4-(4-hydroxyphenylsulfonyl)phenoxy]dodecanamide} phenyl]propyl, 2-ethoxytridecyl, trifluoromethyl, cyclopentyl, and 3-(2,4-di-t-amylphenoxy)propyl), an aryl group (having preferably 6 to 50 carbon atoms, for example, phenyl, 4-t-butylphenyl, 2,4-di-t-amylphenyl, and 4-tetradecanamidephenyl), a heterocyclic group (having preferably 1 to 50 carbon atoms, for example, 2-furyl, 2-thienyl, 2-pyrimidinyl, and 2-benzothiazolyl), a cyano group, a hydroxy group, a nitro group, a carboxy group, a sulfo group, an amino group, an alkoxy group (having preferably 1 to 50 carbon atoms, for example, methoxy, ethoxy, 2-methoxyethoxy, 2-dodecylethoxy, and 2-methanesulfonylethoxy), an aryloxy group (having preferably 6 to 50 carbon atoms, for example, phenoxy, 2-methylphenoxy, 4-t-butylphenoxy, 3-nitophenoxy, 3-t-butyloxycarbamoylphenoxy, and 3-methoxycarbamoyl), an acylamino group (having preferably 2 to 50 carbon atoms for example, acetamido, benzamido, tetradecanamido, 2-(2 , 4-di-t-amylphenoxy) butanamido , 4-(3-t-butyl-4-hydroxyphenoxy)butanamido, and 2-[4-(4-hydroxyphenylsulfonyl)phenoxy]decanamido), an alkylamino group (having preferably 1 to 50 carbon atoms, for example, methylamino, butylamino, dodecylamino, diethylamino, and methylbutylamino), an anilino group (having preferably 6 to 50 carbon atoms, for example, phenylamino, 2-chloroanilino, 2-chloro-5-tetradecanaminoanilino, 2-chloro-5-dodecyloxycarbonylanilino, N-acetylanilino, and 2-chloro-5-[2-(3-t-butyl-4-hydroxyphenoxy)-dodecanamide]anilino), a ureido group (having preferably 2 to 50 carbon atoms, for example, phenylureido, methylureido, and N,N-dibutylureido), a sulfamoylamino group (having preferably 1 to 50 carbon atoms, for example, N,N-dipropylsulfamoylamino, and N-methyl-N-decylsulfamoylamino), an alkylthio group (having preferably 1 to 50 carbon atoms, for example, methylthio, octylthio, tetradecylthio, 2-phenoxyethylthio, 3-phenoxypropylthio, and 3-(4-t-butyl-phenoxy)propylthio), an arylthio group (having preferably 6 to 50 carbon atoms, for example, phenylthio, 2-butoxy-5-t-octylphenylthio, 3-pentadecylphenylthio, 2-carboxyphenylthio and 4-tetradecanamidephenylthio), an alkoxycarbonylamino group (having preferably 2 to 50 carbon atoms, for example, methoxycarbonylamino and tetradecyloxycarbonylamino), a sulfonamido group (having preferably 1 to 50 carbon atoms, for example, methanesulfonamido, hexadecanesulfonamido, benzenesulfonamido, p-toluenesulfonamido, octadecanesulfonamido, and 2-methoxy-5-t-butylbenzenesulfonamido), a carbamoyl group (having preferably 1 to 50 carbon atoms, for example, N-ethylcarbamoyl, N,N-dibutylcarbamoyl, N-(2-dodecyloxy-ethyl)carbamoyl, N-methyl-N-dodecylcarbamoyl, and N-[3-(2,4-di-t-amylphenoxy)-propyl]carbamoyl), a sulfamoyl group (having preferably 0 to 50 carbon atoms, for example, N-ethylsulfamoyl, N,N-dipropylsulfamoyl, N-(2-dodecyloxyethyl)-sulfamoyl, N-ethyl-N-dodecylsulfamoyl, and N,N-diethylsulfamoyl), a sulfonyl group (having preferably 1 to 50 carbon atoms, for example, methanesulfonyl, octanesulfonyl, benzenesulfonyl, and toluenesulfonyl), an alkoxycarbonyl group (having preferably 2 to 50 carbon atoms, for example, methoxycarbonyl, butyloxycarbonyl, dodecyloxycarbonyl, and octadecyloxycarbonyl), a heterocyclic oxy group (having preferably 1 to 50 carbon atoms, for example, 1-phenyltetrazole-5-oxy, and 2-tetrahydropyranyloxy), an azo group (having preferably 6 to 50 carbon atoms, for example, phenylazo, 4-methoxyphenylazo, 4-pivaloylaminophenylazo, and 2-hydroxy-4-propanoylphenylazo), an acyloxy group (having preferably 2 to 50 carbon atoms, for example, acetoxy), a carbamoyloxy group (having preferably 2 to 50 carbon atoms, for example, N-methyl-carbamoyloxy and N-phenylcarbamoyloxy), a silyloxy group (having preferably 3 to 50 carbon atoms, for example, trimethylsilyloxy and dibutylmethylsilyloxy), an aryloxycarbonylamino group (having preferably 7 to 50 carbon atoms, for example, phenoxycarbonylamino), an imido group (having preferably 1 to 40 carbon atoms, for example, N-succinimido, N-phthalimido, and 3-octadecenylsuccinimido), a heterocyclic thio group (having preferably 1 to 50 carbon atoms, for example, 2-benzothiazolylthio, 2,4-di-phenoxy-1,3,5-triazole-6-thio, and 2-pyridylthio), a sulfinyl group (having preferably 1 to 50 carbon atoms, for example, dodecanesulfinyl, 3-pentadecylphenylsulfinyl, and 3-phenoxypropylsulfinyl), a phosphonyl group (having preferably 1 to 50 carbon atoms, for example, phenoxyphosphonyl, octyloxyphosphonyl, and phenylphosphonyl), an aryloxycarbonyl group (having preferably 7 to 50 carbon atoms, for example, phenoxycarbonyl), an acyl group (having preferably 2 to 50 carbon atoms, for example, acetyl, 3-phenylpropanoyl, benzoyl, and 4-dodecyloxybenzoyl), and an azolyl group (having preferably 1 to 50 carbon atoms, for example, imidazolyl, pyrazolyl, 3-chloro-pyrazole-1-yl, and triazolyl).

There can be preferably given as $R_3$, an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, and an azolyl group.

$R_3$ is further preferably an alkyl group or an aryl group. It is more preferably an alkyl group or aryl group having at least one substituent which provides a flocculation property, and further preferably an alkyl group or aryl group each having at least one alkoxy group, sulfonyl group, sulfamoyl group, carbamoyl group, acylamido group, or sulfonamido group as a substituent. It is particularly preferably an alkyl group or aryl group each having at least one acylamido group or sulfonamido group as a substituent. These substituents when substituted on an aryl group are more preferably substituted at least at an ortho position.

In the cyan coupler of the present invention, $R_1$ and $R_2$ each is electron attractive groups having a $\sigma_p$ value of 0.2 or more, and the value of 0.65 or more in the total of the $\sigma_p$ values of $R_1$ and $R_2$ makes it possible to develop a color to form a cyan dye image. The total of the $\sigma_p$ values of $R_1$ and $R_2$ is preferably 0.70 or more, and the upper limit thereof is not much more than 1.8.

$R_1$ and $R_2$ each are an electron attractive group having a Hammett's substituent constant $\sigma_p$ of 0 20 or more, preferably 0.30 or more. The upper limit thereof is 1.0 or less. The Hammett's rule is an empirical rule which was proposed by L. P. Hammett in 1935 in order to quantitatively asseses the affects exerted by a substituent on a reaction or equilibrium of a benzene derivative. In these days, the propriety thereof is widely accepted.

The $\sigma_p$ value and $\sigma_m$ value are available as the substituent constant obtained according to the Hammett's rule and the values thereof are described in many publications. They are described in, for example, *Lange's Handbook of Chemistry* Vol. 12, edited by J. A. Dean, 1979 (McGrow-Hill), and *Chemical Region* No. 122, pp. 96 to 103, 1979 (Nankohdo). $R_1$ and $R_2$ are regulated by Hammett's substituent constant $\sigma_p$ value, but this does not mean that they are limited to the substituents the $\sigma_p$ values of which are described in these publications. Even if the $\sigma_p$ values of a particular group are not described in the publications, the particular group is naturally included in the scope of the present invention as long as it satisfies the above Hammett's substituent range when it is measured according to the Hammett's rule.

There can be given as specific examples of the groups represented by $R_1$ and $R_2$ which are the electron attractive groups having the $\sigma_p$ values of 0.20 or more, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with the an electron attractive group having a $\sigma_p$ of 0.20 or more, a heterocyclic group, a halogen atom, an azo group, and a selenocyanato group. Of these substituents, groups capable of further having substituents may further have the substituents exemplified for $R_3$.

To explain $R_1$ and $R_2$ in more detail, there can be given as specific examples of the electron attractive groups having $\sigma_p$ values of 0.20 or more, an acyl group (having preferably 1 to 50 carbon atoms, for example, acetyl, 3-phenylpropanoyl, benzoyl, and 4-dodecyloxybenzoyl), an acyloxy group (for example acetoxy), a carbamoyl group (having preferably 0 to 50 carbon atoms, for example, carbamoyl, N-ethylcarbamoyl, N-phenylcarbamoyl, N,N-dibutylcarbamoyl, N-(2-dodecyloxyethyl)carbamoyl, N-(4-n-pentadecanamide)-phenylcarbamoyl, N-methyl-N-dodecylcarbamoyl, and N-[3-(2,4-di-t-amylphenoxy)-propyl]carbamoyl), an alkoxycarbonyl group (having preferably 2 to 50 carbon atoms, for example, methoxycarbonyl, ethoxycarbonyl, isopropyloxycarbonyl, tert-butyloxycarbonyl, isobutyloxycarbonyl, butyloxycarbonyl, dodecyloxycarbonyl, and octadodecyloxycarbonyl), an aryloxycarbonyl group (having preferably 7 to 50 carbon atoms, for example, phenoxycarbonyl), a cyano group, a nitro group, a dialkylphosphono group (having preferably 2 to 50 carbon atoms, for example, dimethylphosphono), a diarylphosphono group (having preferably 12 to 60 carbon atoms, for example, diphenylphosphono), a diarylphosphinyl group (having preferably 12 to 60 carbon atoms, for example, diphenylphosphinyl), an alkylsulfinyl group (having preferably 1 to 50 carbon atoms; for example, 3-phenoxypropylsulfinyl), an arylsulfinyl group (having preferably 6 to 50 carbon atoms, for example, 3-pentadecylphenylsulfinyl), an alkylsulfonyl group (having preferably 1 to 50 carbon atoms, for example, methanesulfonyl and octanesulfonyl), an arylsulfonyl group (having preferably 6 to 50 carbon atoms, for example, benzenesulfonyl and toluenesulfonyl), a sulfonyloxy group (having preferably 1 to 50 carbon atoms, for example, methanesulfonyloxy and toluenesulfonyloxy), an acylthio group (having preferably 1 to 50 carbon atoms, for example, acetylthio and benzoylthio), a sulfamoyl group (having preferably 0 to 50 carbon atoms, for example, N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a thiocyanate group, a thiocarbonyl group (having preferably 2 to 50 carbon atoms, for example, methylthiocarbonyl and phenylthiocarbonyl), a halogenated alkyl group (having preferably 1 to 20 carbon atoms, for example, trifluoromethane and heptafluoropropane), a halogenated alkoxy group (having preferably 1 to 20 carbon atoms, for example, trifluoromethyloxy), a halogenated aryloxy group (having preferably 6 to 12 carbon atoms, for example, pentafluorophenyloxy), a halogenated alkylamino group (having preferably 1 to 20 carbon atoms, for example, N,N-di-(trifluoromethyl)amino), a halogenated alkylthio group (having preferably 1 to 20 carbon atoms, for example, difluoromethyl and 1,1,2,2-tetrafluoroethylthio), an aryl group substituted with an electron attractive group having a $\sigma_p$ of 0.20 or more (having preferably 6 to 20 carbon atoms, for example, 2,4-dinitrophenyl, 2,4,6-trichlorophenyl, and pentachlorophenyl), a heterocyclic group (having preferably 0 to 40 carbon atoms, for example, 2-benzoxazolyl, 2-benzothiazolyl 1-phenyl-2-benzimidazol-yl, 5-chloro-1-tetrazolyl, and 1-pyrrolyl), a halogen atom (for example, a chlorine atom and a bromine atom), an azo group (having preferably 6 to 40 carbon atoms, for example, phenylazo), and a selenocyanato group. Of these substituents, groups capable of further having substituents may further have the substituents exemplified for $R_3$.

There can be given as the preferable substituents represented by $R_1$ and $R_2$, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, an aryl group substituted with an electron attractive group having a $\sigma_p$ of 0.20 or more, and a heterocyclic group. More preferred are an alkoxycarbonyl group, a nitro group, a cyano group, an arylsulfonyl group, a carbamoyl group, a halogenated alkyl group and an aryloxycarbonyl group.

Most preferred as $R_1$ is a cyano group. Particularly preferred as $R_2$ is an alkoxycarbonyl group and most preferred is a branched alkoxycarbonyl group.

$X_1$ represents a hydrogen atom or a group capable of splitting off by a coupling reaction with an oxidation product of an aromatic primary amine color developing agent. To explain the group capable of splitting off in detail, there can be given as examples a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino group, a 5-membered or 6-membered nitrogen containing heterocyclic group, an imido group, and an arylazo group. These groups may further be substituted with the substituents exemplified for $R_3$.

To be more detailed, there can be given as suitable examples of $X_1$ a halogen atom (for example, a fluorine atom, a chlorine atom and a bromine atom), an alkoxy group (having preferably 1 to 50 carbon atoms, for example, ethoxy, dodecyloxy, methoxyethylcarbamoylmethoxy, carboxypropyloxy, methylsulfonylethoxy, and ethoxycarbonylmethoxy), an aryloxy group (having preferably 6 to 50 carbon atoms, for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (having preferably 2 to 50 carbon atoms, for example, acetoxy, tetradecanoyloxy, and benzolyoxy), an alkyl or arylsulfonyloxy group (having preferably 1 to 50 carbon atoms, for example, methanesulfonyloxy and toluenesulfonyloxy), an acylamino group (having preferably 2 to 50 carbon atoms, for example, dichloroacetylamino and heptafluorobutylylamino), an alkyl or arylsulfonamido group (having preferably 1 to 50 carbon atoms, for example, methane sulfonamido, trifluoromethanesulfonamido, and p-toluenesulfonylamino), an alkoxycarbonyloxy group (having preferably 2 to 50 carbon atoms, for example, ethoxycarbonyloxy and benzyloxycarbonyloxy), an aryloxycarbonyloxy group (having preferably 7 to 50 carbon atoms, for example, phenoxycarbonyloxy), an alkyl, aryl or heterocyclic thio group (having preferably 1 to 50 carbon atoms, for example, dodecylthio, 1-carboxydodecylthio, phenylthio, 2-butoxy-5-t-octylphenylthio, and tetrazolylthio), a carbamoylamino group (having preferably 2 to 50 carbon atoms, for example, N-methylcarbamoylamino and N-phenylcarbamoylamino), a 5-membered or 6-membered nitrogen-containing heterocyclic group (having preferably 1 to 50 carbon atoms, for example, imidazolyl, pyrazolyl, triazolyl, tetrazolyl, and, 2-dihydro-2-oxo-1-pyridyl), an imido group (having preferably 1 to 50 carbon atoms, for example, succinimido and hydantoinyl), and an arylazo group (having preferably 6 to 40 carbon atoms, for example, phenylazo and 4-methoxyphenylazo). In addition to the above groups, $X_1$ may take, as a splitting group bonded through a carbon atom, a his type coupler form obtained by condensing a 4-equivalent coupler with aldehydes or ketones as described in *The Theory of the Photoqraphic Process,* by T. H. James, 4th Ed., (Macmillan Publishing Co., Inc.), Ch. 12, Sec. III.C. pp. 356–358 and in the *Paper from ICPS* '82 (International Congress of Photographic Science, University of Cambridge, Sept. 6–10, 1982, The Royal Phot. Sci. of Great Britain), No. 4.20 "Formation and Coupling Behaviour of 4,4'-Methylidene bis-and 4-Methylidene Pyrazoline-5-ones". Further, $X_1$ may contain a photographically useful group such as a development inhibitor or a development accelerator described in *Research Disclosure,* No. 307105, VII, Item F.

$X_1$ is preferably a halogen atom, an alkoxy group, an aryloxy group, an alkyl or arylthio group, or a 5-membered or 6-membered nitrogen-containing heterocyclic group bonded to a coupling active site via the nitrogen atom. $X_1$ is more preferably a halogen atom, an alkyl or arylthio group. Particularly preferred is an arylthio group.

In the cyan coupler represented by Formula (I) or (II), the group represented by $R_1$, $R_2$, $R_3$ or $X_1$ may be a divalent group resulting from the removal of one hydrogen atom from a monovalent group thereof, and form a dimer or a polymer which is higher than a dimer or combine with a high molecular weight chain to form a homopolymer or a copolymer. A typical example of a homopolymer or copolymer formed by combining a high molecular weight chain is a homopolymer or copolymer of an addition polymer ethylene type unsaturated compound having a cyan coupler group represented by Formula (I) or (II). In this case, two or more kinds of a cyan color development repetitive unit having the cyan coupler group represented by Formula (I) or (II) may be contained in the polymer and one or more kinds of a non-color developable ethylene type monomer may be contained therein as a copolymerization component. The cyan color development repetitive unit having the cyan coupler group represented by Formula (I) or (II) is represented preferably by the following Formula (P):

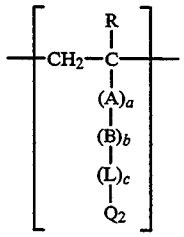

(P)

wherein R represents a hydrogen atom, an alkyl group having 1 to 4 carbon atoms, or a chlorine atom; A represents —CONH—, —COO—, or a substituted or unsubstituted phenylene group; B represents a substituted or unsubstituked alkylene group, phenylene group or alkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represent 0 and 1; and $Q_2$ represents a cyan coupler group formed by making a hydrogen atom split off from $R_1$, $R_2$, $R_3$ or $X_1$ in the compound represented by Formula (I) or (II).

Preferred as the polymer is a copolymer of a cyan color developing monomer represented by a coupler unit of Formula (I) or (II) and a non-color developable ethylene type monomer which is not capable of coupling with an oxidation product of an aromatic primary amine developing agent.

There are available as the non-color developable ethylene type monomer which is not capable of coupling with an oxidation product of an aromatic primary amine developing agent, acrylic acid, α-chloroacrylic acid, α-alkylacrylic acid (for example, methacrylic acid), an amide or ester derived from these acrylic acids (for example, acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxy methacrylate), a vinyl ester (for example, vinyl acetate, vinyl propionate, and vinyl laurate), acrylonitrile, methacrylonitrile, an aromatic vinyl compound (for example, styrene and derivatives thereof, for example, vinyl toluene, divinylbenzene, vinyl acetophenone, and sulfostyrene), itaconic acid, citraconic acid, crotonic acid, vinylidene chloride, vinyl alkyl ether (for example, vinyl ethyl ether), maleic acid ester, N-vinyl-2-pyrrolidone, N-vinylpyridine, and 2- and 4-vinylpyridne.

Particularly preferred are acrylic acid ester, methacrylic acid ester, and maleic acid ester. The non-color developable ethylene type monomer used herewith can be used in combination of two or more kinds. For example, there can be used methyl methacrylate and butyl acrylate, butyl acrylate and styrene, butyl methacrylate and methacrylic acid, and methyl acrylate and diacetone acrylamide.

As known in the art of polymer couplers, the ethylene type unsaturated monomer which is subjected to a copolymerization with the vinyl type monomer (P) corresponding to the compound represented by Formula (I) or (II) can be selected so that the physical properties and/or chemical properties of the copolymer formed, for example, solubility, compatibility with a binder for a photographic colloid composition, such as gelatin, and flexibility and thermal stability thereof, are favorably affected.

In order to incorporate the cyan coupler of the present invention into a silver halide light-sensitive material, preferably a red-sensitive silver halide emulsion layer, it is converted preferably to a coupler-in-emulsion type coupler. For meeting this purpose, at least one of the groups represented by $R_1$, $R_2$, $R_3$ and $X_1$ is preferably a so-called ballast group (preferably having 10 or more total carbon atoms, more preferably 10 to 50 total carbon atoms). In particular, $R_3$ is preferably the ballast group.

In the present invention, the cyan coupler represented by Formula (I), particularly the cyan coupler represented by Formula (I-a), is preferred in terms of the effect thereof.

Specific examples of cyan couplers of the present invention are shown below as Compounds (C-1) to (C-60) but the present invention is not limited thereto.

C-1

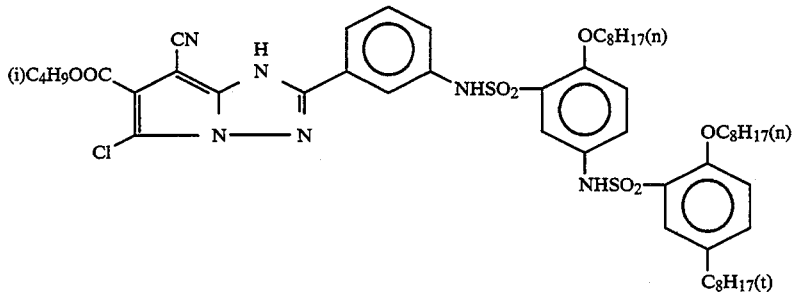

C-2

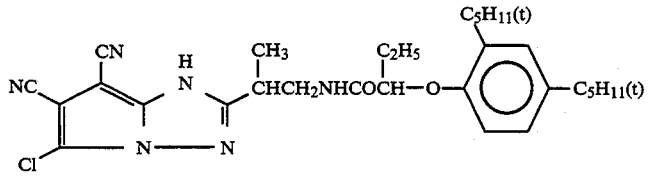

C-3

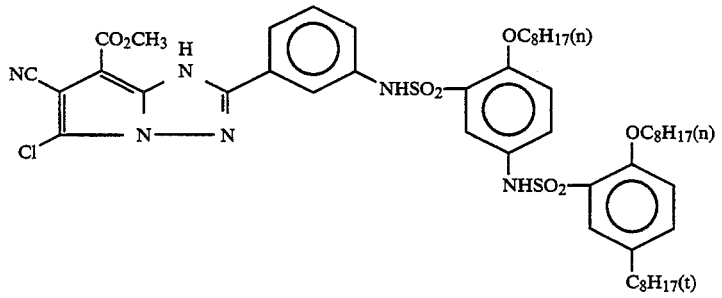

C-4

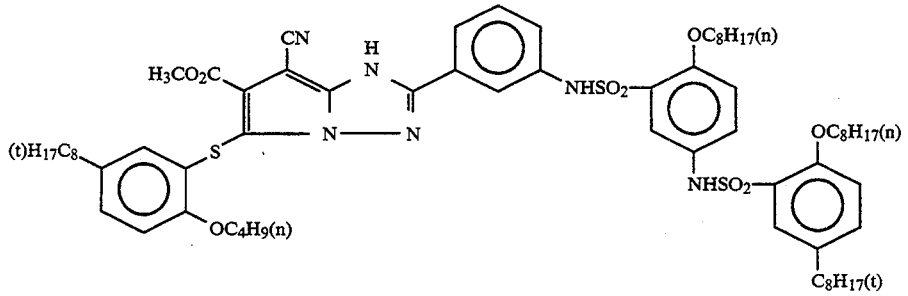

C-5

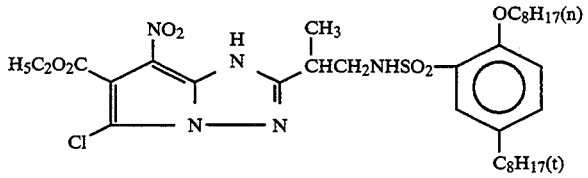

-continued
C-6
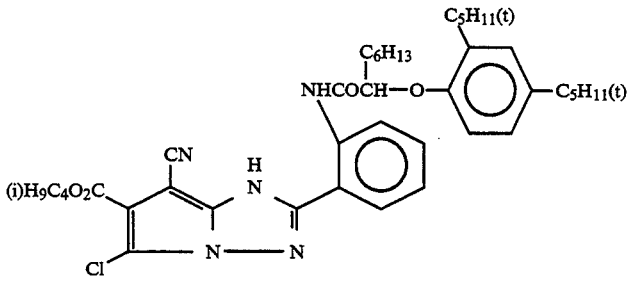
C-7
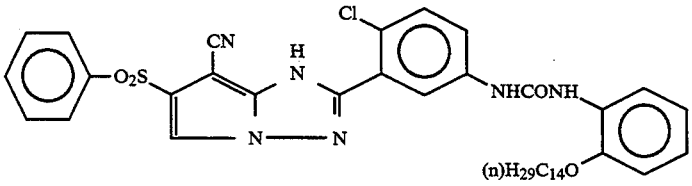
C-8
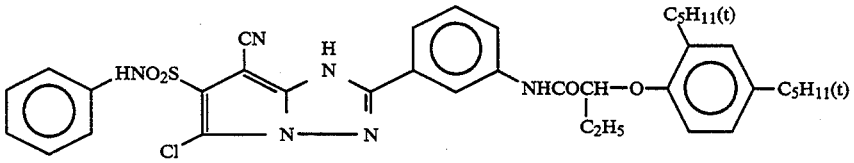
C-9
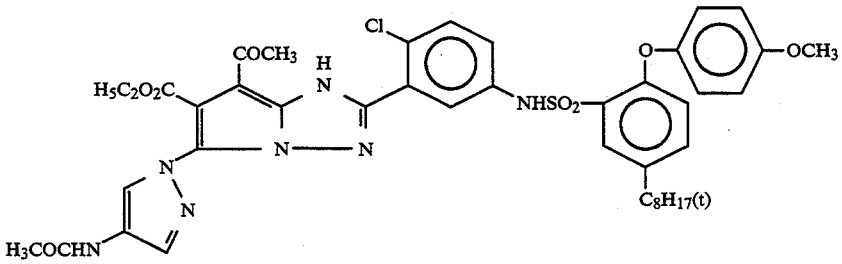
C-10
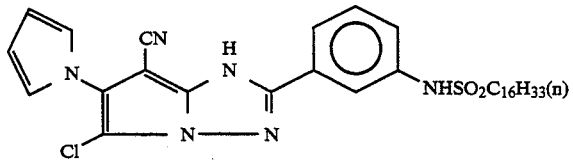
C-11
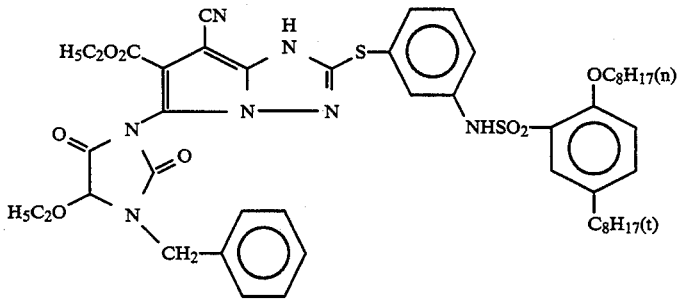

-continued
C-12
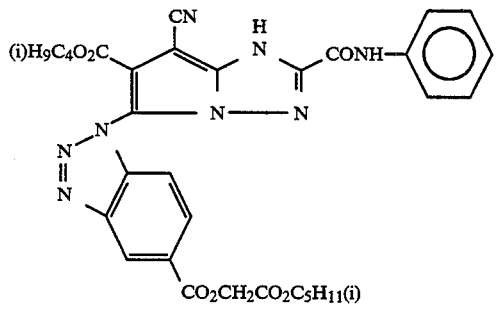
C-13
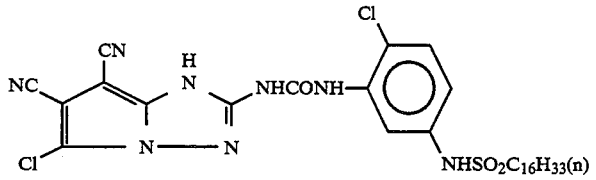
C-14
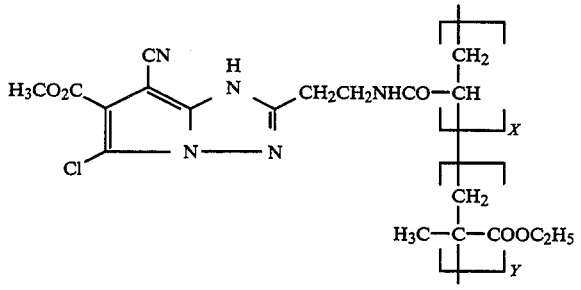
X:Y = 50:50
C-15
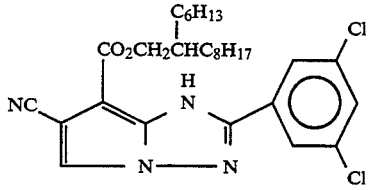
C-16
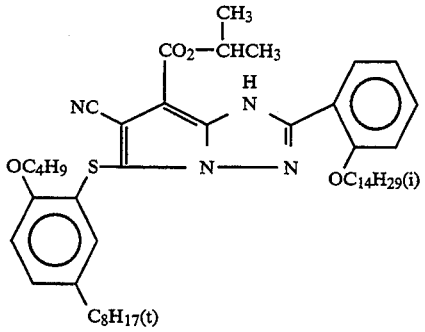
C-17
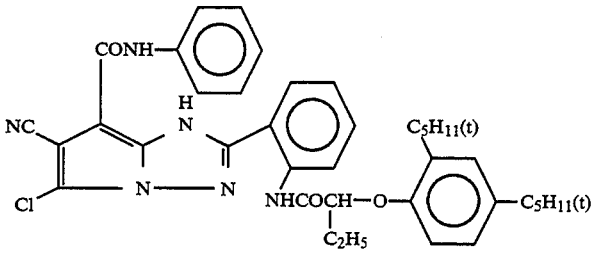

-continued
C-18
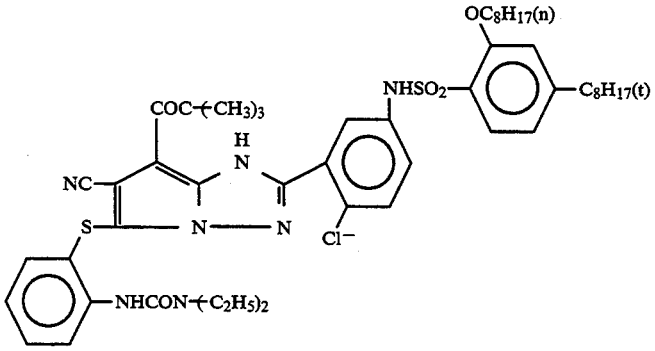
C-19
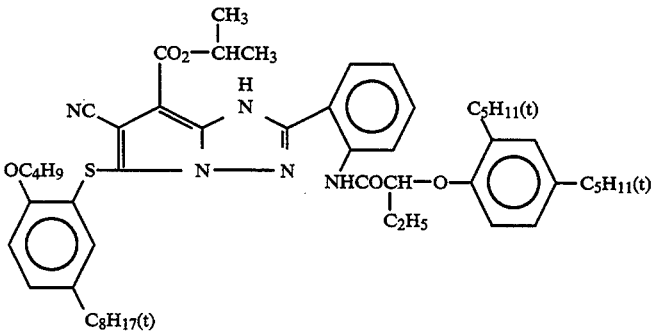
C-20
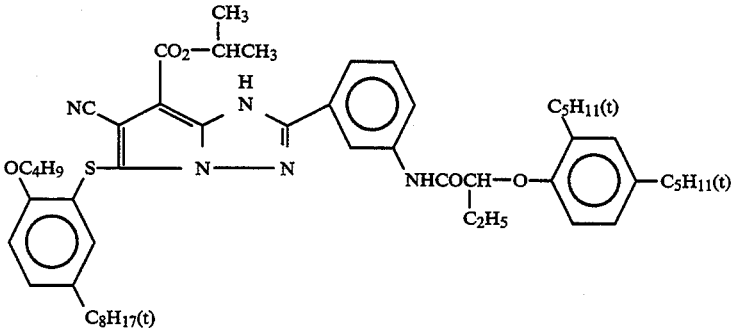
C-21
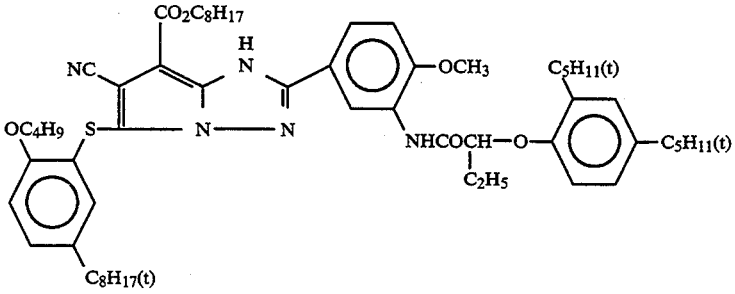
C-22
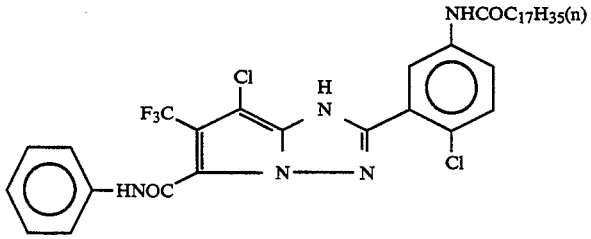

-continued
C-23
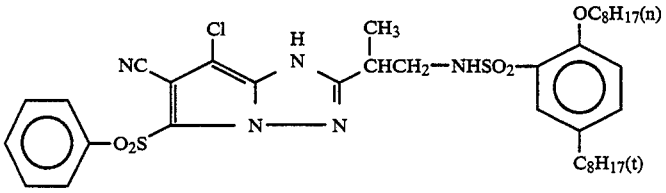
C-24
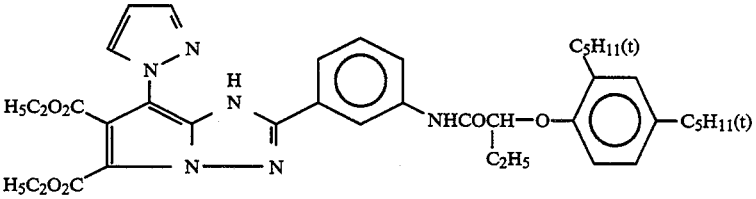
C-25
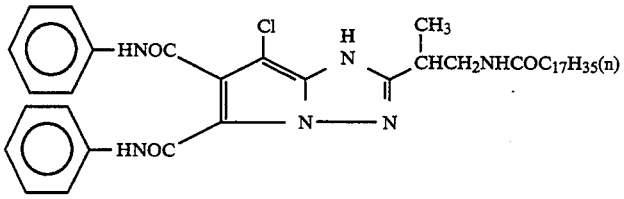
C-26
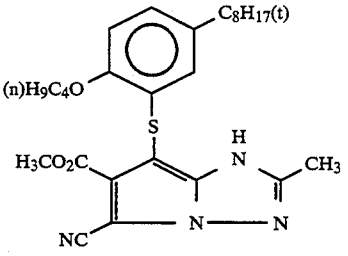
C-27
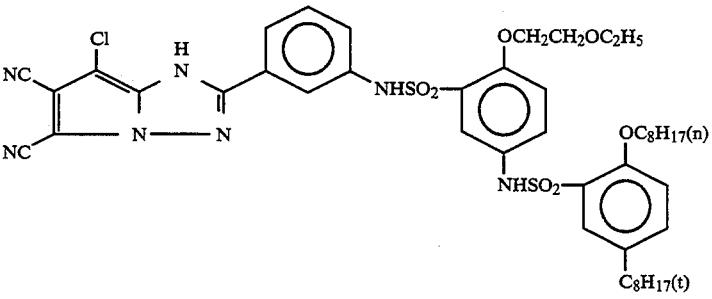
C-28
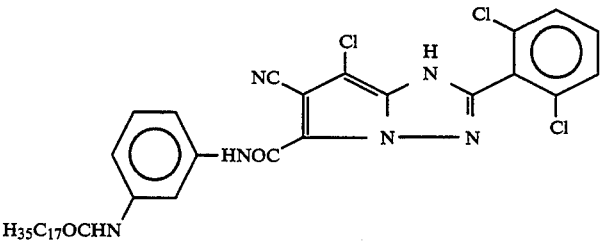
C-29
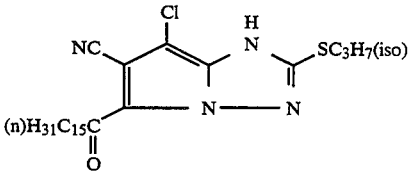

-continued
C-30
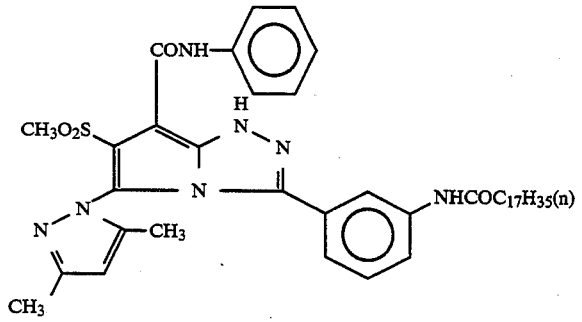
C-31
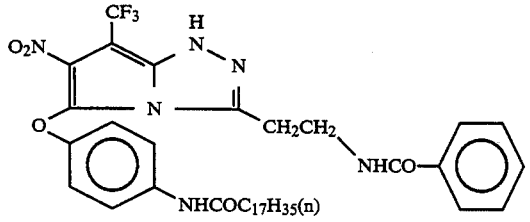
C-32
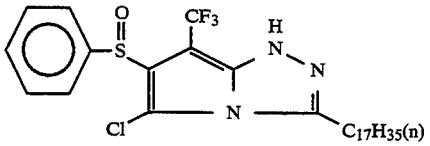
C-33
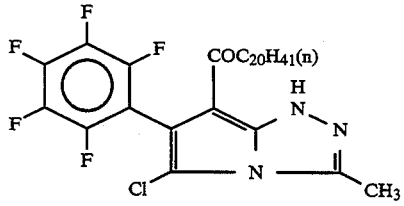
C-34
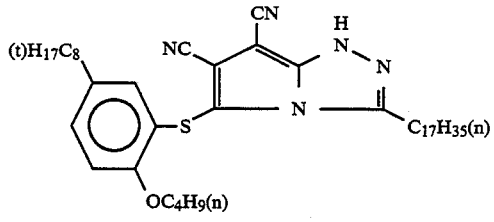
C-35
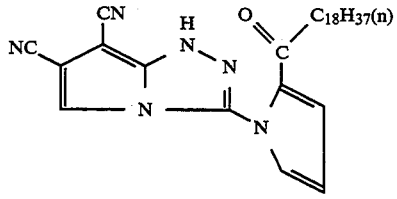
C-36
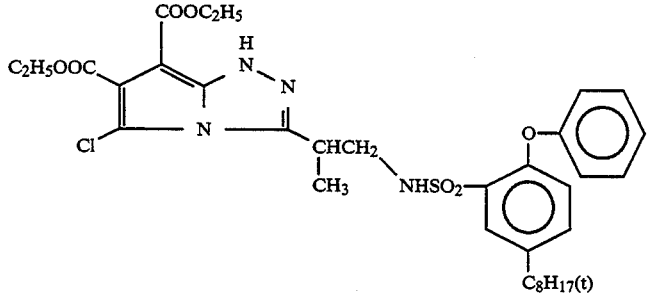

-continued
C-37
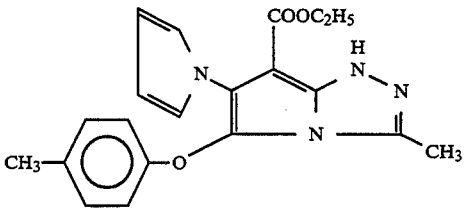
C-38
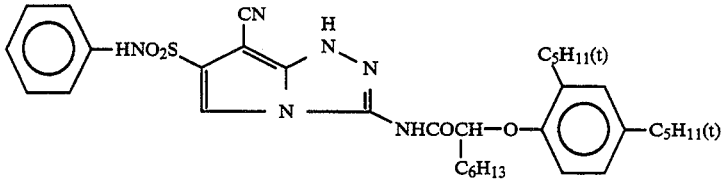
C-39
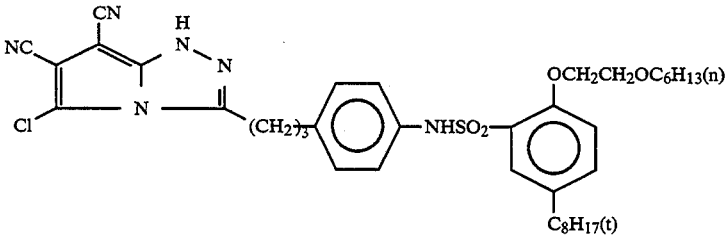
C-40
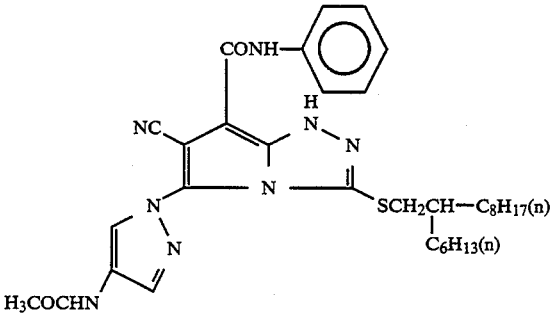
C-41
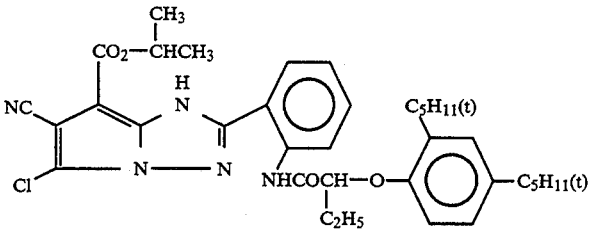
C-42
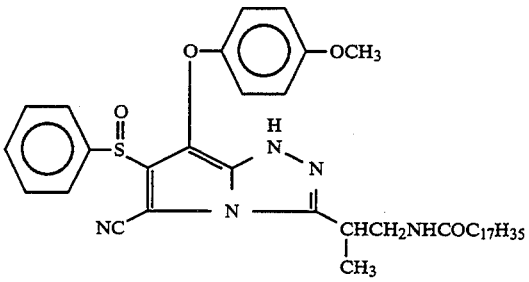
C-43
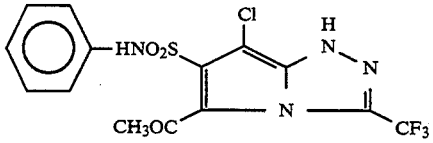

-continued
C-44
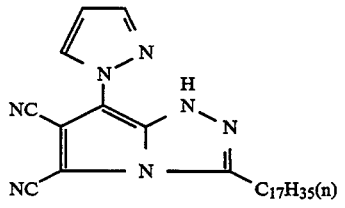
C-45
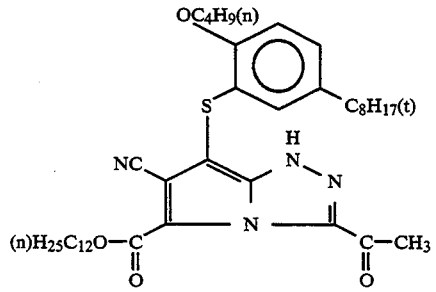
C-46
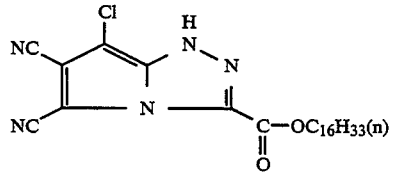
C-47
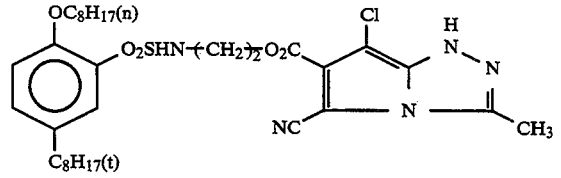
C-48
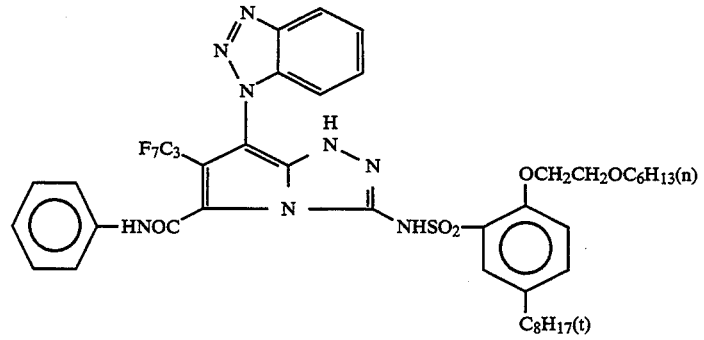
C-49
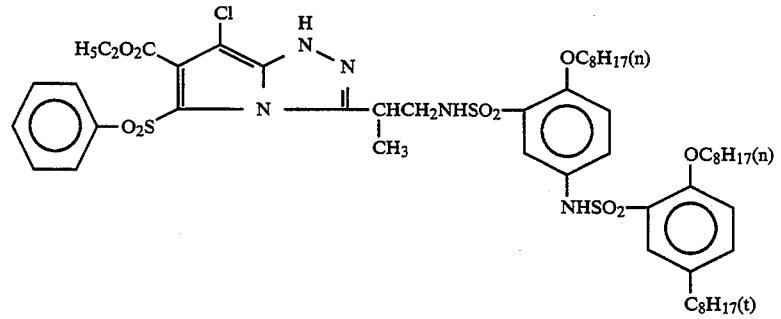

-continued
C-50
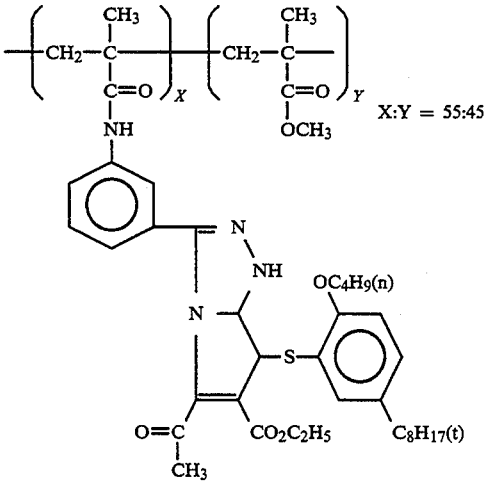
C-51
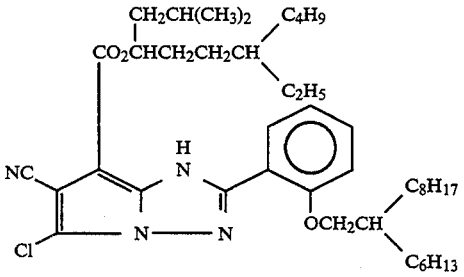
C-52
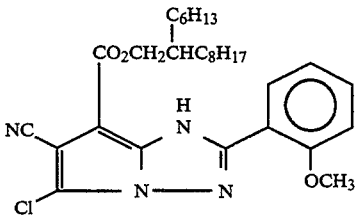
C-53
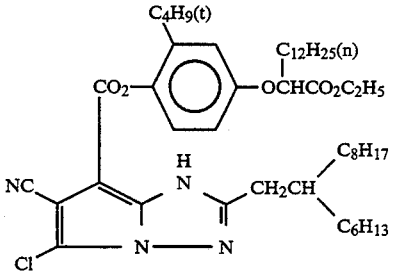
C-54
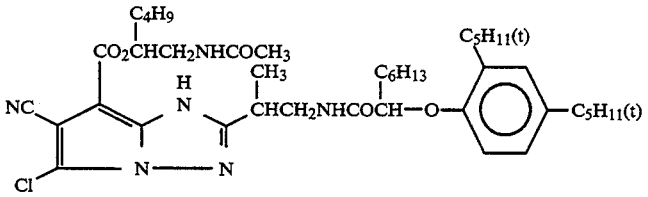

-continued
C-55
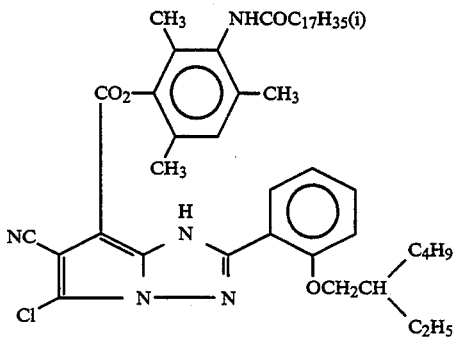
C-56
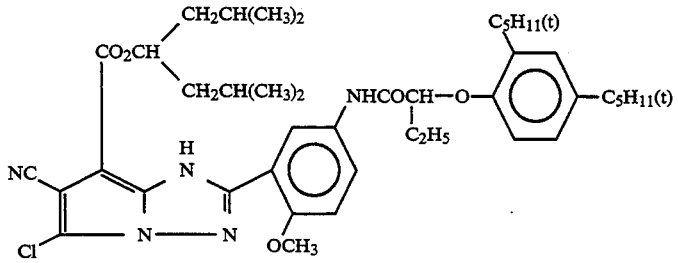
C-57
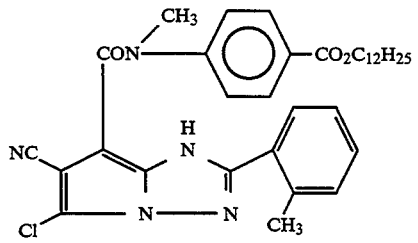
C-58
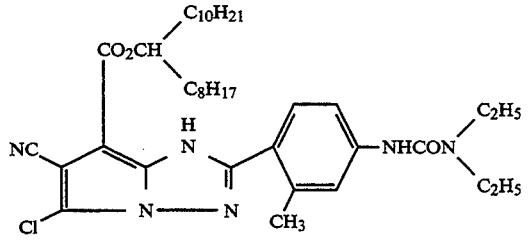
C-59
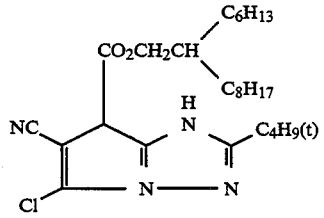
C-60
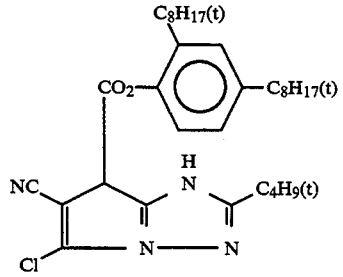
Next, synthesis examples of the cyan couplers of the present invention will be shown in order to explain the synthesis method thereof.

Synthesis of Compound C-1
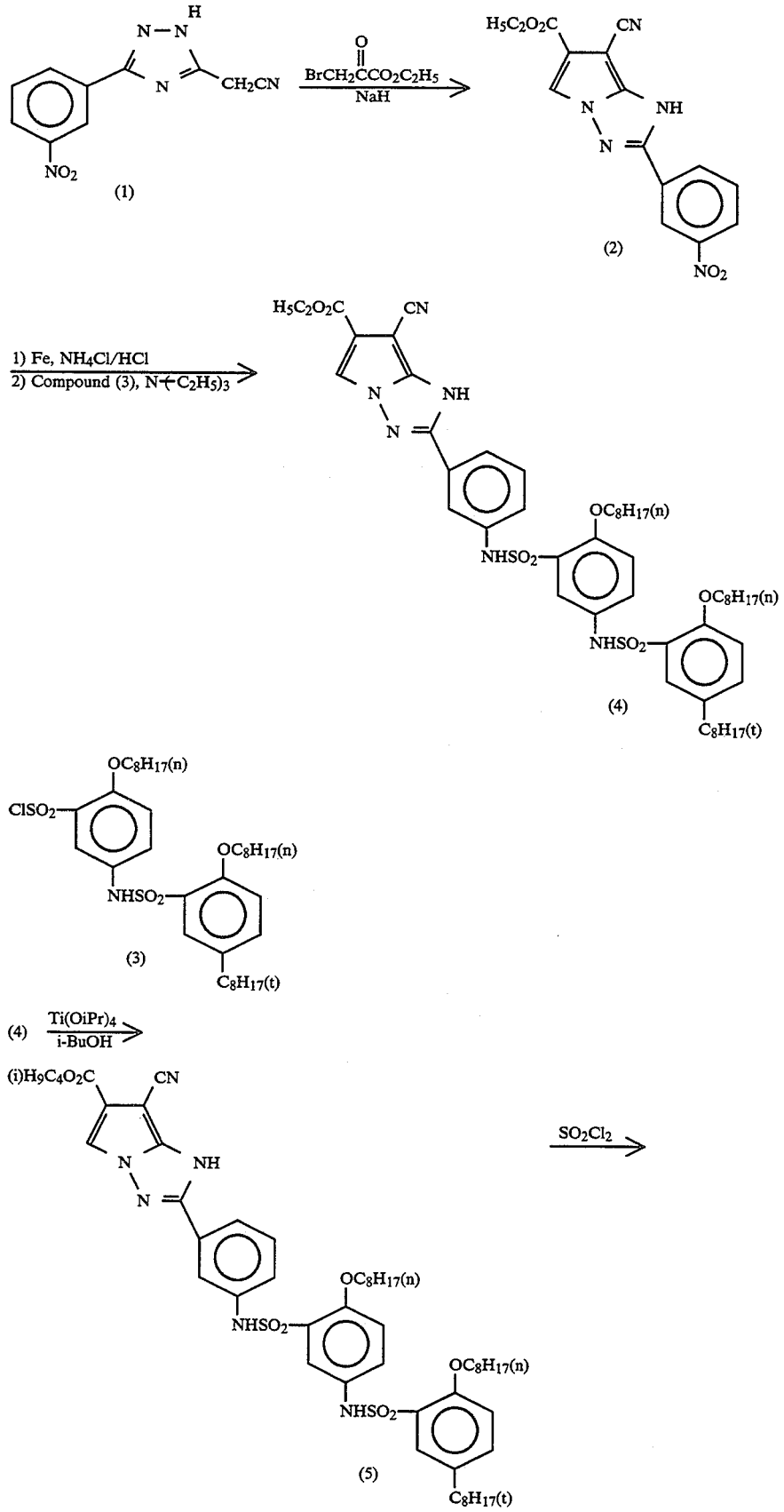

-continued

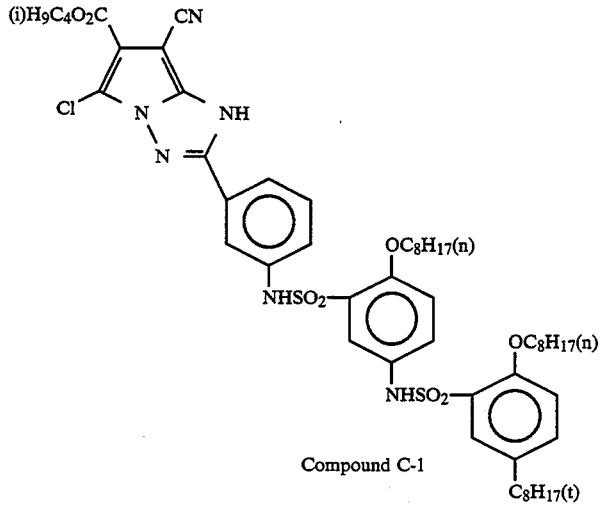

Compound C-1

There was dissolved 3-m-nitrophenyl-5-methylcyano-1,2,4-triazole (compound (1)) (20.0 g, 87.3 mmol) in dimethylacetamide (150 ml), and NaH (60% by weight in oil) (7.3 g, 183 mmol) was added thereto little by little, followed by heating to 80° C. A 50% (by weight) dimethylacetamide solution (50 ml) of ethyl bromopiruvate (13.1 ml, 105 mmol) was slowly added dropwise to the above solution. The resulting reaction solution was stirred at 80° C. for 30 minutes after the dropwise addition was completed, and then was cooled down to room temperature. Hydrochloric acid 1N then was added to the cooled reaction solution to make it acid, and then the solution was extracted with ethyl acetate. After drying on sodium sulfate, the solvent was distilled off under a reduced pressure. The residue was refined with a silica gel chromatography to obtain compound (2): (10.79 g) (yield: 13.8%).

Reduced iron (9.26 g, 166 mmol) and ammonium chloride (0.89 g, 16.6 mmol) were suspended in isopropanol (300 ml) and then, water (30 ml) and conc. hydrochloric acid-(2 ml) were further added and the resulting solution was heated at refluxing for 30 minutes. Compound (2) (10.79 g, 33.2 mmol) was added little by little while heating for refluxing. After heating at refluxing for a further 4 hours, the solution was immediately filtered with celite and the filtrate was subjected to a distillation under a reduced pressure. The residue was dissolved in a mixed solvent of dimethylacetamide (40 ml) and ethyl acetate (60 ml), and compound (3) (25.6 g, 36.5 mmol) was added thereto. Then, triethylamine (23.1 ml, 166 mmol) was added and the solution was heated at 70° C. for 5 hours. After the reaction solution was cooled down to room temperature, water was added thereto and the solution was extracted with ethyl acetate. After the extract was washed with water, it was dried on sodium sulfate and the solvent was distilled off under a reduced pressure. The residue was refined with a silica gel chromatography to obtain compound (4): (16.5 g) (yield: 52%).

Compound (4) (7.0 g, 7.30 mmol) was dissolved in isobutanol (14 ml) and tetraisopropyl orthotitanate (0.43 ml, 1.46 mmol) was added, followed by heating at refluxing for 6 hours. After the reaction solution was cooled down to room temperature, water was added thereto and the solution was extracted with ethyl acetate. The extract was dried on sodium sulfate and the solvent was distilled off under a reduced pressure. The residue was refined with a silica gel chromatography to obtain compound (5): (5.0 g) (yield: 69%).

Compound (5) (5.0 g, 5.04 mmol) was dissolved in tetrahydrofuran (50 ml) and $SO_2Cl_2$ (0.40 ml, 5.04 mmol) was added dropwise while cooling with water. After the dropwise addition was completed, the solution was stirred for a further 4 hours while cooling with water. Water was added to the reaction solution and the solution was extracted with ethyl acetate. The extract was dried on sodium sulfate and the solvent was distilled off under a reduced pressure. The residue was refined with a silica gel chromatography to obtain the exemplified Compound C-1: (3.9 g) (yield: 76%).

SYNTHESIS EXAMPLE 2

Synthesis of Exemplified Compound C-39

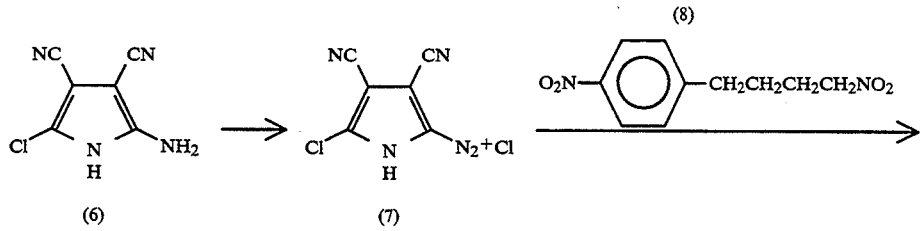

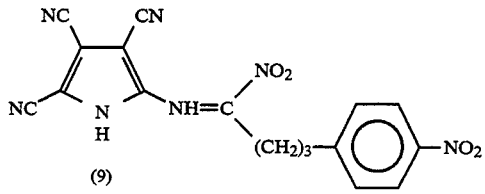

(9)

-continued

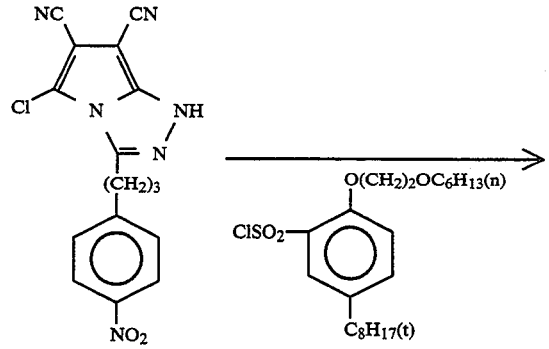

(11)

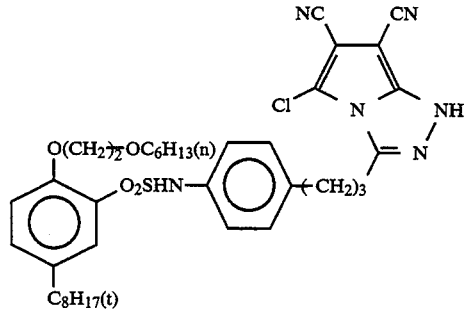

Compound C-39

Hydrochloric acid (36% by weight) (38 ml) was added to 2-amino-5-chloro-3,4-dicyanopyrrole (compound (6)) (6.78 g, 40.7 mmol), and an aqueous solution (5.9 ml) of sodium sulfite (2.95 g, 42.7 mmol) was slowly added dropwise while stirring and cooling with ice, followed by stirring for 1.5 hours, whereby compound (7) was prepared. While stirring and cooling with ice, the solution of compound (7) thus prepared was slowly added dropwise to a solution prepared by adding sodium methylate (28%) (102 ml) to an ethanol solution (177 ml) of compound (8) (9.58 g, 427 mmol) while stirring and cooling with ice, and then stirring was continued for 1 hour. Next, the resulting reaction solution was heated at refluxing for 1.5 hours. Then, ethanol was distilled off from the reaction solution under a reduced pressure, and the residue was dissolved in chloroform. The solution thus prepared was washed with a saturated brine, and after drying on sodium sulfate, chloroform was distilled off under a reduced pressure. The residue was refined with a silica gel chromatography to obtain compound (10): (4.19 g) (the yield from compounds (6) through (10): 29%).

Compound (6) was synthesized as illustrated below by subjecting 3,4-dicyanopyrrole to a nitration and a reduction with iron after chlorination. Also, compound (8) was synthesized as illustrated below from compound (a) synthesized from γ-lactone and benzene by a known method, according to the method described in *Journal of the American Chemical Society,* 76, pp. 3209 (1954).

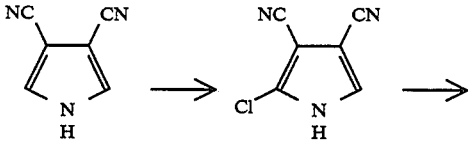

-continued

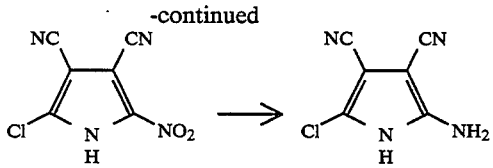

(6)

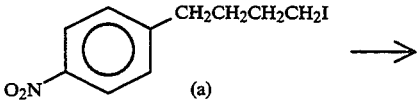

(a)

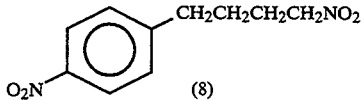

(8)

Water (10 ml), ammonium chloride (0.3 g, 5.9 mmol) and acetic acid (0.34 ml, 5.9 mmol) were added to reduced iron powder (3.3 g, 59.0 mmol), and the solution thus prepared was heated at refluxing for 15 minutes while stirring. Then, isopropanol (31 ml) was added thereto and the solution was heated for refluxing for a further 20 minutes while stirring. Next, an isopropanol solution (14 ml) of compound (10) (4.1 g, 11.8 mmol) was added dropwise and the resulting reaction solution was heated at refluxing for 2 hours. Then, the reaction solution was filtered using celite as a filter aid and the the residue was washed with ethyl acetate, followed by distilling the solution under a reduced pressure.

The residue was dissolved in a mixed solvent of ethyl acetate (16 ml) and dimethylacetamide (24 ml). There were added thereto compound (11) (5.6 g, 13.0 mmol) and then triethylamine (8.2 ml, 59.0 mmol), and the resulting solution was stirred at room temperature for 4 hours. Water was added thereto and the solution was extracted with ethyl acetate, followed by washing the extract with a saturated brine. After drying on sodium sulfate, the solvent was distilled off under a reduced pressure and the residue was refined with a silica gel chromatography, whereby the exemplified Compound C-39 (6.46 g) (yield: 76%) was obtained.

The amount of cyan coupler of the present invention in a light-sensitive material is suitably $1\times10^{-3}$ mole to 1 mole, preferably $2\times10^{-3}$ mole to $3\times10^{-1}$ mole per mole of silver halide.

Next, the yellow couplers represented by Formula (III) will be explained.

When a substituent in Formula (III) contains an alkyl moiety, the alkyl means a linear, branched or cyclic alkyl which may be substituted, unless specifically defined (for example, methyl, isopropyl, t-butyl, cyclopentyl, t-pentyl, cyclohexyl, 2-ethylhexyl, 1,1,3,3-tetramethylbutyl, dodecyl, hexadecyl, benzyl, trifluoromethyl, hydroxymethylmethoxyethyl, ethoxycarbonylmethyl, and phenoxyethyl).

When a substituent in Formula (III) contains an aryl moiety, the aryl means a monocyclic or condensed aryl which may be substituted, unless specifically defined (for example, phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidephenyl, and 3,4-dichlorophenyl).

When a substituent in Formula (III) is a hetero-cyclic group or contains a heterocyclic group, the heterocyclic group means a 3 to 8-membered monocyclic or condensed heterocyclic group which contains at least one hetero atom selected from O, N, S, P, Se and Te in the ring and may be substituted, unless specifically defined (for example, 2-furyl, 2-pyridyl, 4-pyridyl, 1-pyrazolyl, 1-imidazolyl, 1-benzotriazolyl, 2-benzotriazolyl, succinimide, phthalimide, and 1-benzyl-2,4-imidazolidinedione-3-yl).

In Formula (III), there can be given as $R_4$ for a monovalent group, a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an acyloxy group, a nitro group, a heterocyclic group, a cyano group, an acyl group, an amino group, an imido group, an alkyl-sulfonyloxy group, an arylsulfonyloxy group, a carboxyl group, a sulfo group, and a hydroxy group. These groups may be substituted with the same groups.

$R_4$ is preferably a halogen atom, a cyano group, an alkyl group or alkoxy group having a total number of carbon atoms (the total number of carbon atoms in a group is hereinafter referred to throughout the specification as the C number) of 1 to 30, or an aryl group or aryloxy group having a C number of 6 to 30. An alkyl group, an alkoxy group, an aryl group or an aryloxy group may be substituted with a halogen atom, an alkyl group, an alkoxy group, a nitro group, an amino group, a carbonamido group, a sulfonamido group, and an acyl group. Particularly preferred is an unsubstituted linear alkyl group having a C number of 1 to 5.

$R_4$ is most preferably methyl, ethyl or propyl.

In Formula (III), Q represents a group of non-metallic atoms necessary to form a 3 to 5-membered hydrocarbon ring which may be substituted and has a C number of 3 to 30, or a heterocyclic group which contains at least one hetero atom selected from N, S, O and P in the ring and has a C number of 2 to 30 together with C. Further, the ring formed by Q together with C may contain an unsaturated bond therein.

There can be given as the examples of the ring formed by Q together with C, a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thietane ring, a thiolane ring, and a pyrrolidine ring. There can be given as the examples of the substituent which may be substituted on a ring, a halogen atom, a hydroxyl group, an alkyl group, an aryl group, an acyl group, an alkoxy group, an aryloxy group, a cyano group, an alkoxycarbonyl group, an alkythio group, and an arylthio group. Q is more preferably a group of the atoms necessary to form a 3 to 5-membered hydrocarbon ring together with C. It is, for example, $-[C(R)_2]_2-$, $-[C(R)_2]_3-$, or $-[C(R)_2]_4-$, wherein R represents a hydrogen atom, a halogen atom or an alkyl group, provided that plural R and $C(R)_2$ may be the same of different.

Q is particularly preferably $-[C(R)_2]_2-$ which forms a 3-membered ring together with C bonded to Q.

Q is most preferably a cyclopropane ring.

In Formula (III), $R_5$ represents a hydrogen atom, a halogen atom, an alkoxy group, an aryloxy group, an alkyl group, or an amino group. $R_5$ is preferably a halogen atom, an alkoxy group having a C number of 1 to 30, an aryloxy group having a C number of 6 to 30, an alkyl group having a C number of 1 to 30, or an amino group having a C number of 0 to 30, each of which may be substituted. There can be given as the substituent therefor, for example, a halogen atom, an alkyl group, an alkoxy group, and an aryloxy group.

$R_5$ is particularly preferably a chlorine atom, a fluorine atom, an alkyl group having a C number of 1 to 6 (for example, methyl, trifluoromethyl, ethyl, isopropyl, and t-butyl), an alkoxy group having a C number of 1 to 8 (for example, methoxy, ethoxy, methoxyethoxy, and butoxy), or an aryloxy group having a C number of 6 to 24 (for example, phenoxy, p-tolyloxy and p-methoxyethoxy). It is most preferably a chlorine atom, methoxy or trifluoromethyl.

In Formula (III), $R_6$ represents a substituent group, and r represents an integer of 0 to 4, provided that when r is plural, the plural $R_6$ groups may be the same or different. There can be given as the examples of the group represented by $R_6$, a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an acyloxy group, a nitro group, a heterocyclic group, a cyano group, an acyl group, an amino group, an imido group, an alkylsulfonyloxy group, an arylsulfonyloxy group, a carboxyl group, a sulfo group, and a hydroxy group. $R_6$ is preferably a halogen atom, an alkyl group having a C number of 1 to 30, an aryl group having a C number of 6 to 30, an alkoxy group having a C number of 1 to 30, an alkoxycarbonyl group having a C number of 2 to 30, an aryloxycarbonyl group having a C number of 7 to 30, a carbonamido group having a C number of 1 to 30, a sulfonamido group having a C number of 1 to 30, a carbamoyl group having a C number of 1 to 30, a sulfamoyl group having a C number of 0 to 30, an alkylsulfonyl group having a C number of 1 to 30, an arylsulfonyl group having a C number of 6 to 30, a ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30, or an arylsulfonyloxy group having a C number of 6 to 30, each of which may be substituted. There can be given as the substituent therefor, for example, the groups enumerated for the above $R_6$.

$R_6$ is particularly preferably a halogen atom, an alkoxy group, an alkoxycarbonyl group, an aryloxycarbonyl group, a carbonamido group, a sulfonamido group, a carbamoyl group, or a sulfamoyl group, and most preferably an alkoxy group, an alkoxycarbonyl group, a carbonamido group, or a sulfonamido group. r is preferably represents an integer of 1 or 2. The substitution position of $R_6$ is preferably a para or meta position to

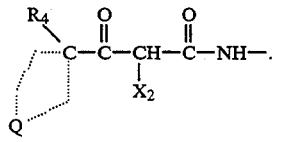

In Formula (III), $X_2$ represents a hydrogen atom or a group capable of splitting off upon a coupling reaction with an oxidation product of an aromatic primary amine color developing agent (hereinafter referred to as a splitting-off group).

There can be given as the examples of the splitting-off group represented by $X_2$, a heterocyclic group bonded to a coupling active site via a nitrogen atom, an aryloxy group, an arylthio group, an acyloxy group, an alkylsulfonyloxy group, an arylsulfonyloxy group, a heterocyclicoxy group, and a halogen atom. $X_2$ is preferably a heterocyclic group bonded to a coupling active site via a nitrogen atom, or an aryloxy group.

When $X_2$ represents a heterocyclic group bonded to a coupling active site via a nitrogen atom, $X_2$ is preferably a 5 to 7-membered condensed heterocyclic ring which may be substituted. There are available as examples thereof, succinimide, maleimide, phthalimide, diglycolimide, pyrrole, pyrazole, imidazole, 1,2,4-triazole, tetrazole, indole, indazole, benzimidazole, benztriazole, imidazotidine-2,4-dione, oxazolidine-2,4-dione, thiazolidine-2,4-dione, imidazolidine-2-one, oxazolidine-2-one, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidine-4-one. These heterocyclic rings may be substituted. The groups enumerated for the above $R_6$ can be given as the examples of the substituents for these heterocyclic rings.

When $X_2$ represents an aryloxy group, $X_2$ is preferably an aryloxy group having a C number of 6 to 30 and may be substituted with the groups enumerated for above $R_3$. Preferred as the substituent for the aryloxy group are a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, and a cyano group.

$X_2$ is particularly preferably a 5-membered heterocyclic ring bonded to a coupling active site via a nitrogen atom (for example, imidazolidine-2,4-dione-3-yl and oxazoline-2,4-dione-3-yl) or an aryloxy group, most preferably imidazolidine-2,4-dione-3-yl.

The groups represented by $R_5$, $R_6$ and $X_2$ may further be substituted with the groups enumerated for $R_6$ according to necessity. Further, $R_6$ and $X_2$ may be a divalent linkage group to form a dimer or may be bonded to a polymer.

Specific examples of the yellow couplers of formula (III) of the present invention are shown below by Compounds Y-1 to Y-49.

Y-1

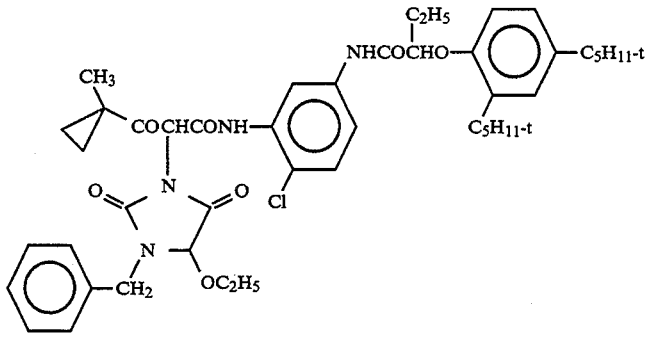

-continued
Y-2
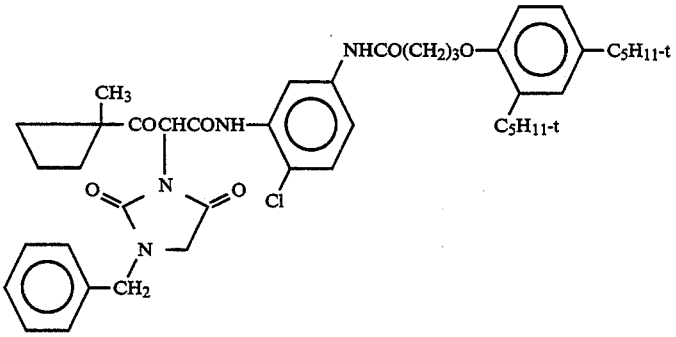
Y-3
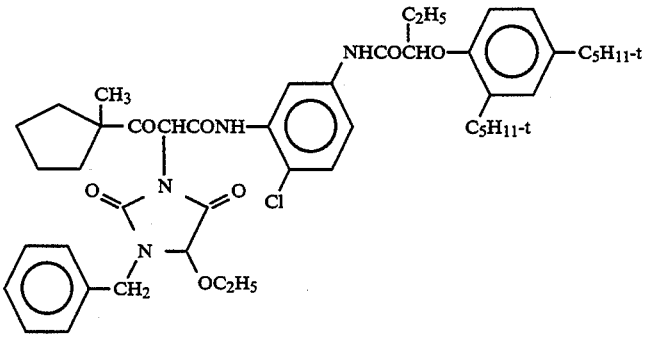
Y-4
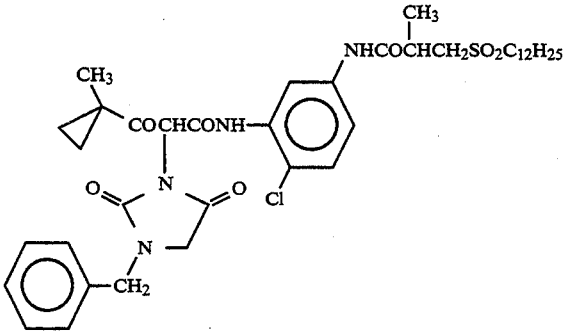
Y-5
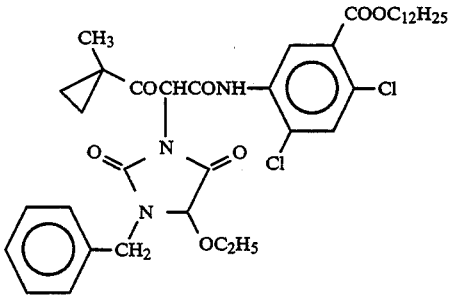
Y-6
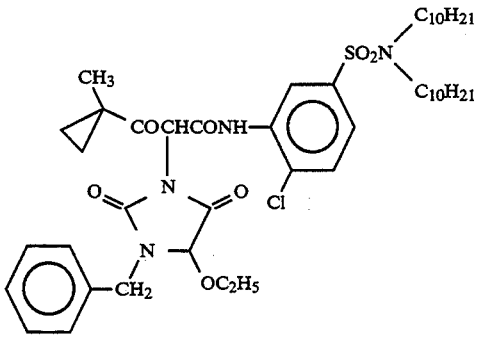
Y-7
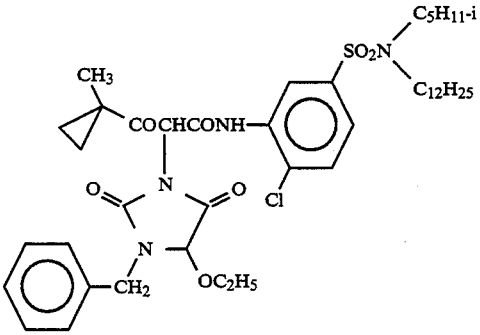
Y-8
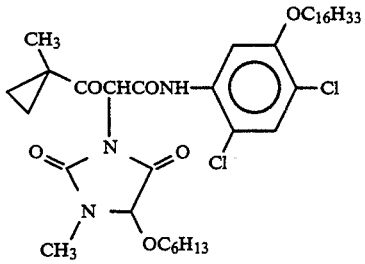

-continued
Y-9
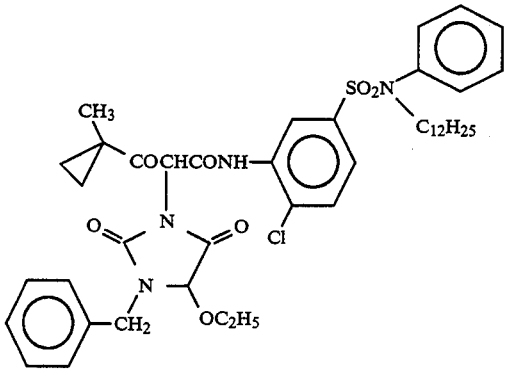
Y-10
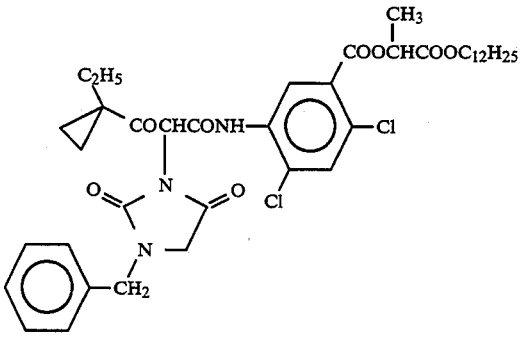
Y-11
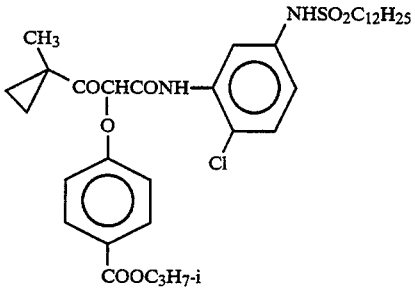
Y-12
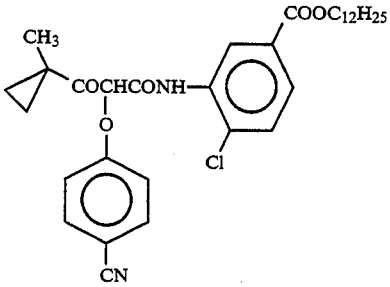
Y-13
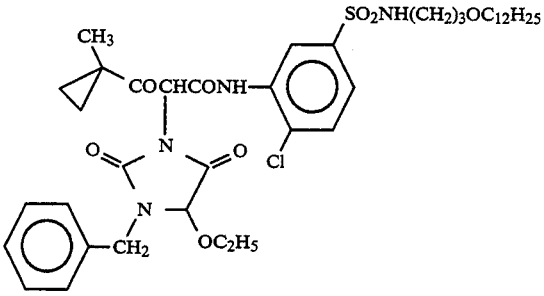
Y-14
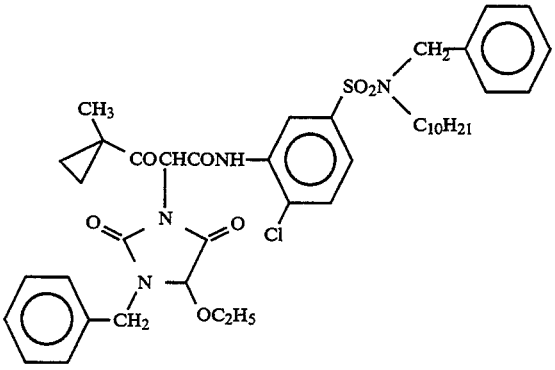
Y-15
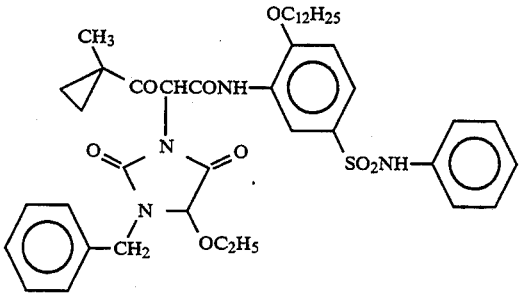
Y-16
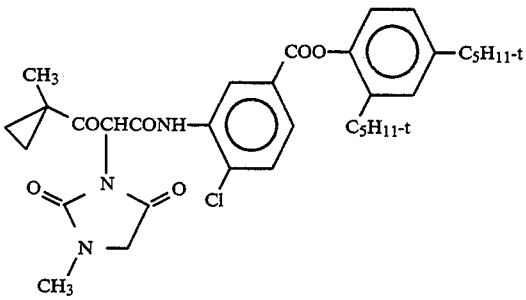

-continued
Y-17
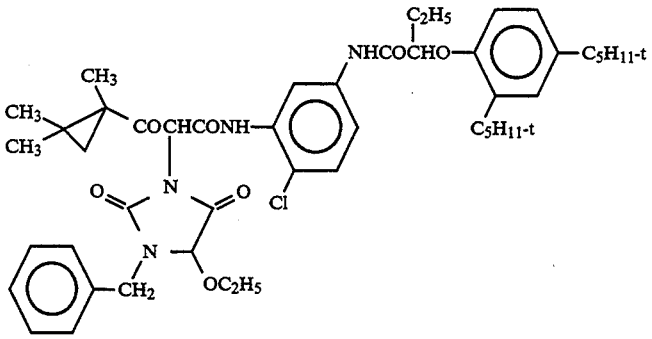
Y-18
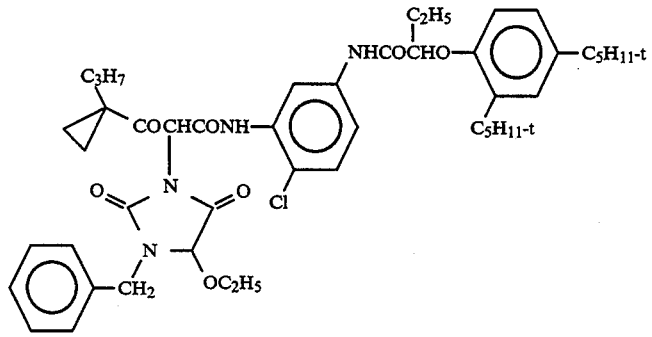
Y-19
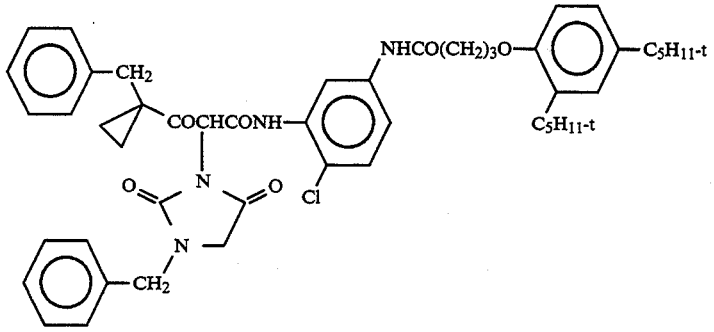
Y-20
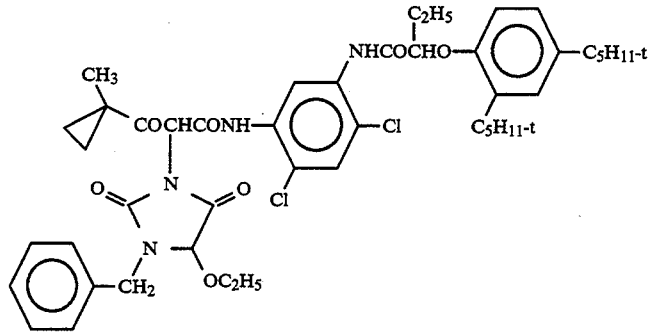
Y-21
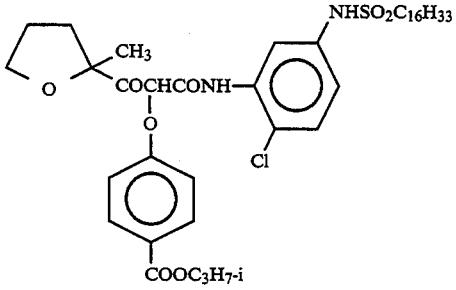
Y-22
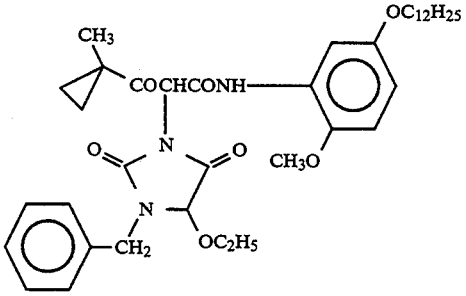

-continued
Y-23
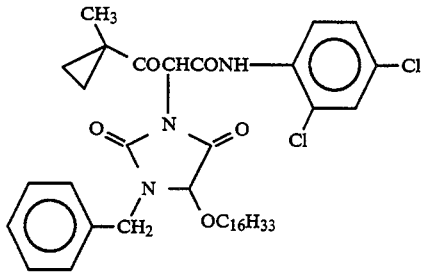
Y-24
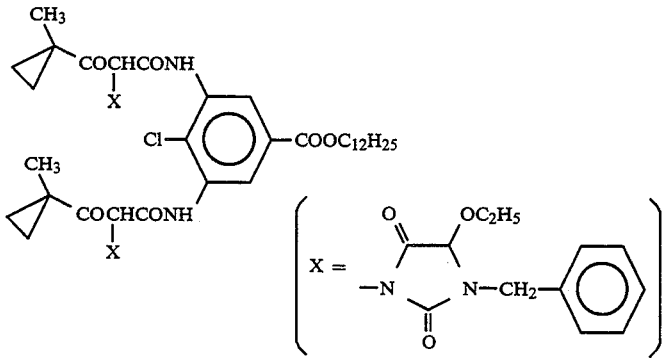
Y-25
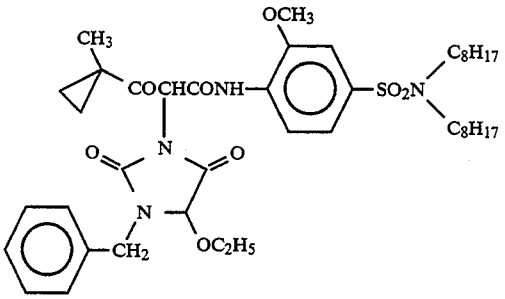
Y-26
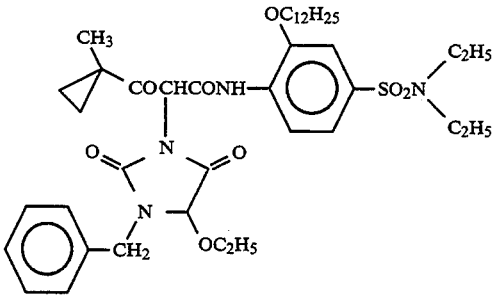
Y-27
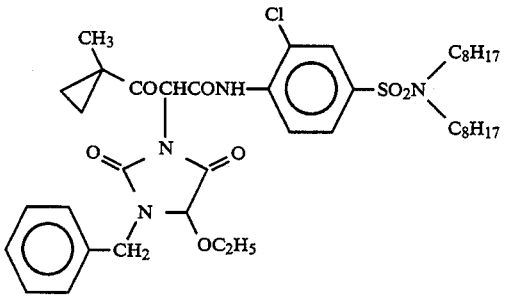
Y-28
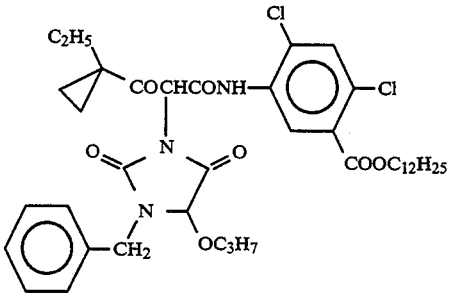
Y-29
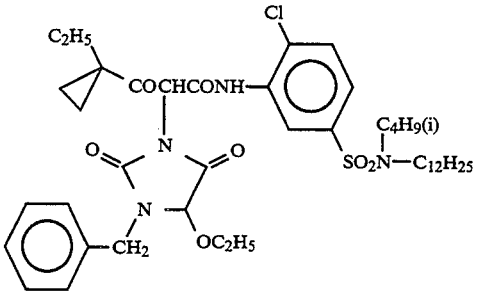
Y-30
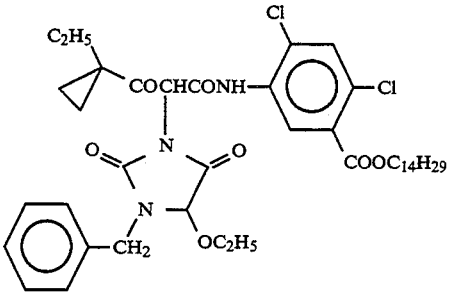

-continued
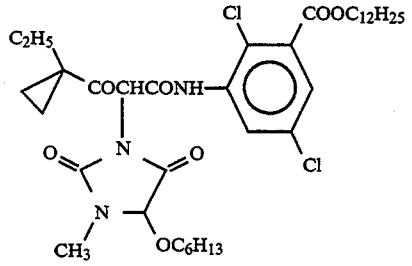
Y-31
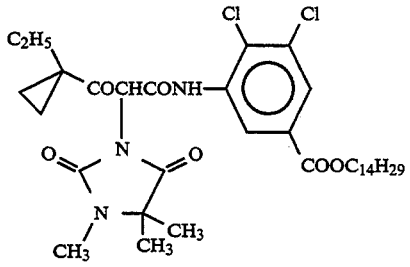
Y-32
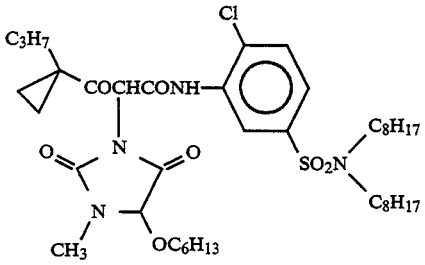
Y-33
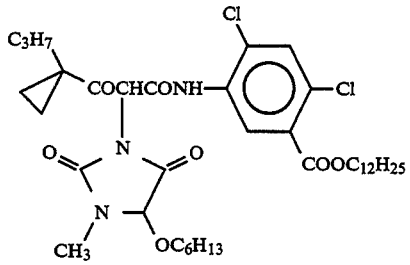
Y-34
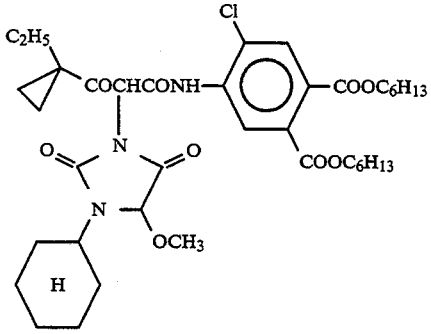
Y-35
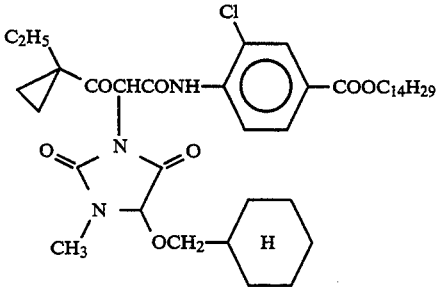
Y-36
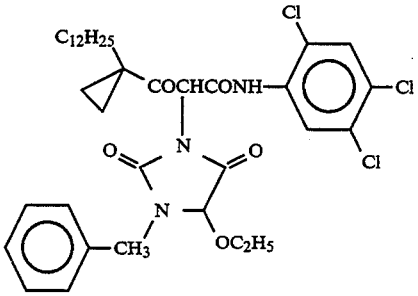
Y-37
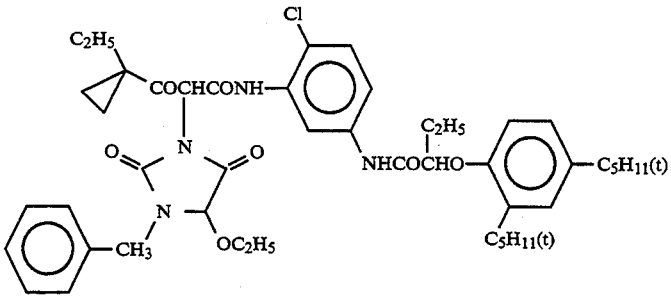
Y-38

-continued
Y-39
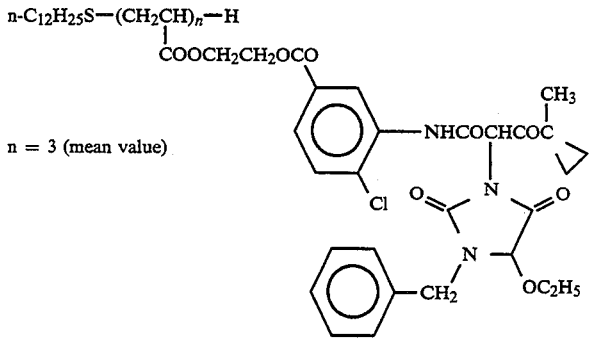
Y-40
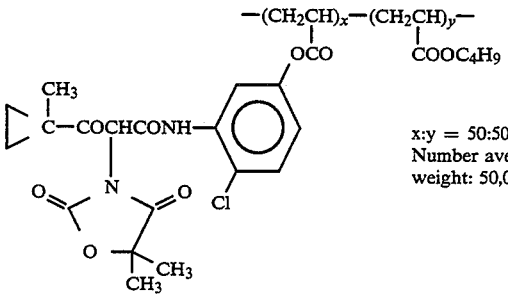
x:y = 50:50 (by weight)
Number average molecular weight: 50,000
Y-41
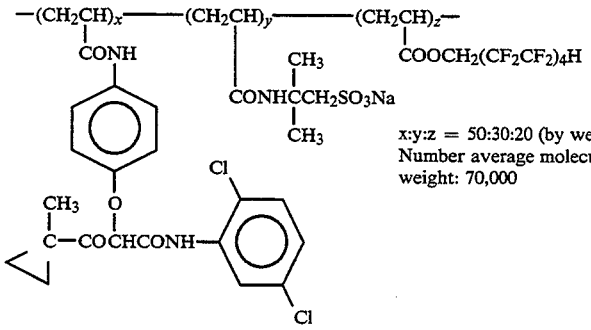
x:y:z = 50:30:20 (by weight)
Number average molecular weight: 70,000
Y-42
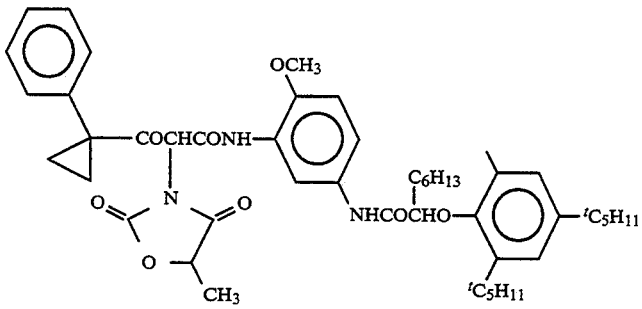
Y-43
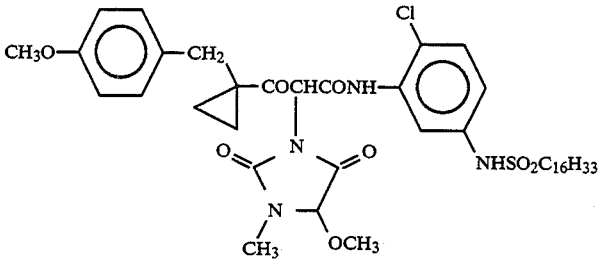

-continued
Y-44
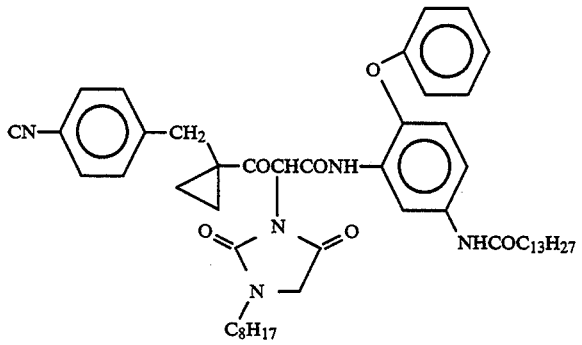
Y-45
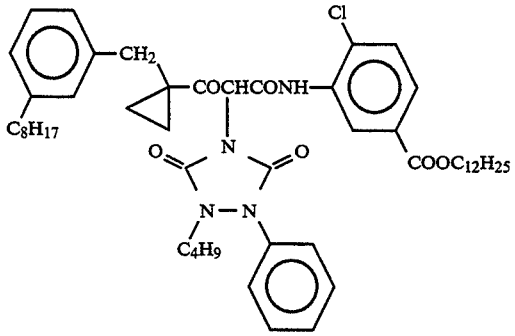
Y-46
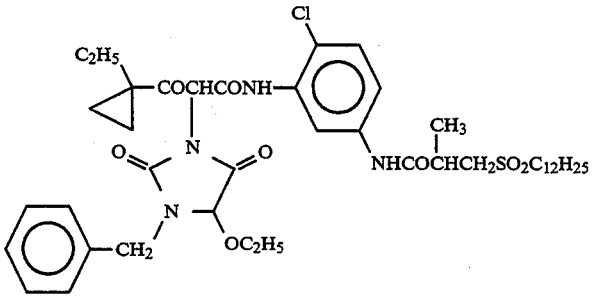
Y-47
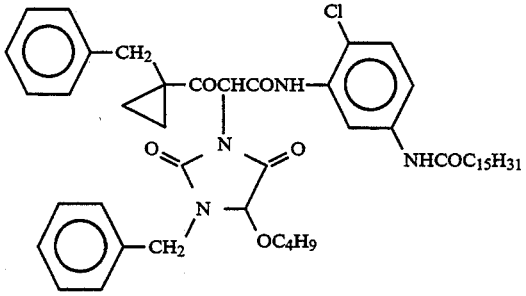
Y-48
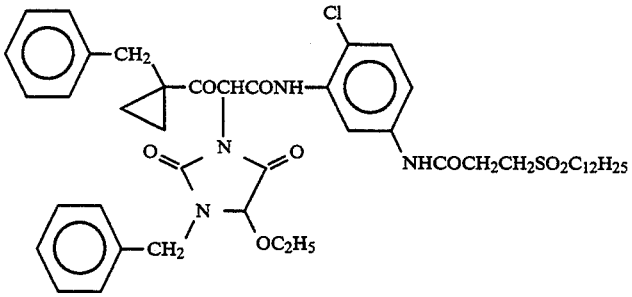

-continued

Y-49

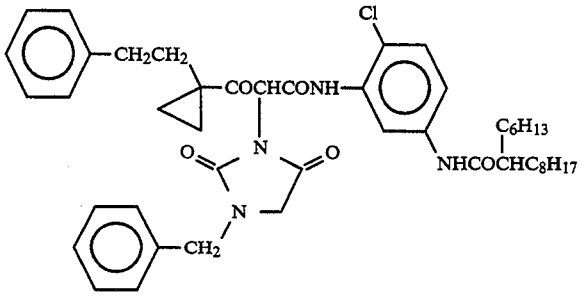

Specific examples of the yellow couplers of formula (III) of the present invention other than the above ones and the synthesis methods thereof are described in European Patent Publication 0447969.

Next, the yellow couplers represented by Formula (IV) will be explained in detail.

In Formula (IV), $R_7$ represents a halogen atom (for example, a chlorine atom and a fluorine atom) or an alkoxy group having preferably a C number of 1 to 30 (for example, methoxy, ethoxy, octoxy, dodecoxy, and hexadecoxy).

In Formula (IV), $R_8$, $R_9$ and $R_{10}$ each represent a substituent. There can be given as the examples of the substituent, a halogen atom (for example, a fluorine atom and a chlorine atom), an alkoxycarbonyl group having a C number of 2 to 30, preferably 2 to 20 (for example, methoxycarbonyl, dodecyloxycarbonyl, and hexadecyloxycarbonyl), an acylamino group having a C number of 2 to 30, preferably 2 to 20 (for example, acetamido, tetradecanamido, 2-(2,4-di-t-amylphenoxy), butanamido, and benzamido), a sulfonamido group having a C number of 1 to 30, preferably 1 to 20 (for example, methanesulfonamido, dodecanesulfonamido, hexadecylsulfonamido, and benzenesulfonamido), a carbamoyl group having a C number of 1 to 30, preferably 1 to 20 (for example, N-butylcarbamoyl and N,N-diethylcarbamoyl), an N-sulfonylcarbamoyl group having a C number of 1 to 30, preferably 1 to 20 (for example, N-mesylcarbamoyl and N-dodecylsulfonylcarbamoyl), a sulfamoyl group having a C number of 1 to 30, preferably 1 to 20 (for example, N-butylsulfamoyl, N-dodecylsulfamoyl, N-hexadecylsulfamoyl, N-3-(2,4-di-t-amylphenoxy)butylsulfamoyl, and N,N-diethylsulfamoyl), an alkoxy group having a C number of 1 to 30, preferably 1 to 20 (for example, methoxy, hexadecyloxy, and isopropoxy), an aryloxy group having a C number of 6 to 20, preferably 6 to 10 (for example, phenoxy, 4-methoxyphenoxy, 3-t-butyl-4-hydroxyphenoxy, naphthoxy), an aryloxycarbonyl group having a C number of 7 to 21, preferably 7 to 11 (for example, phenoxycarbonyl), an N-acylsulfamoyl group having a C number of 2 to 30, preferably 2 to 20 (for example, N-propanoylsulfamoyl and N-tetradecanoylsulfamoyl), a sulfonyl group having a C number of 1 to 30, preferably 1 to 20 (for example, methanesulfonyl, octanesulfonyl, 4-hydroxyphenylsulfonyl, and dodecanesulfonyl), an alkoxycarbonylamino group having a C number of 1 to 30, preferably 1 to 20 (for example, ethoxycarbonylamino), a cyano group, a nitro group, a carboxyl group, a hydroxyl group, a sulfo group, an alkylthio group having a C number of 1 to 30, preferably 1 to 20 (for example, methylthio, dodecylthio, and dodecylcarbamoylmethylthio), a ureido group having a C number of 1 to 30, preferably 1 to 20 (for example, N-phenylureido and N-hexadecylureido), an aryl group having a C number of 6 to 20, preferably 6 to 10 (for example, phenyl, naphthyl, and 4-methoxyphenyl), a heterocyclic group having a C number of 1 to 20, preferably 1 to 10 (a 3 to 12-membered, preferably 5 or 6-membered monocyclic or condensed ring containing at least one or more of a nitrogen atom, an oxygen atom and a sulfur atom as a hetero atom; for example, 2-pyridyl, 3-pyrazolyl, 1-pyrrolyl, 2,4-dioxo-1,3-imidazolidine-1-yl, 2-benzoxazolyl, morpholino, and indolyl), a linear, branched or cyclic alkyl group having a C number of 1 to 30, preferably 1 to 20 (for example, methyl, ethyl, isopropyl, cyclopropyl, t-pentyl, t-octyl, cyclopentyl, t-butyl, s-butyl, dodecyl, and 2-hexyldecyl), an acyl group having a C number of 1 to 30, preferably 1 to 20 (for example, acetyl and benzoyl), an acyloxy group having a C number of 2 to 30, preferably 2 to 20 (for example, propanoyloxy and tetradecanoyloxy), an arylthio group having a C number of 6 to 20, preferably 6 to 10 (for example, phenylthio and naphthylthio), a sulfamoylamino group having a C number of 0 to 30, preferably 0 to 20 (for example, N-butylsulfamoylamino, N-dodecylsulfamoylamino, and N-phenylsulfamoylamino), and an N-sulfonylsulfamoyl group having a C number of 1 to 30, preferably 1 to 20 (for example, N-mesylsulfamoyl, N-ethanesulfonylsulfamoyl, N-dodecanesulfonylsulfamoyl, and N-hexadecanesulfonylsulfamoyl). The above substituents may further have substituents. There can be given as examples of the further substituents, the substituents given herewith.

Of the above substituents, there can be given as a preferable substituent, an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, or an aryl group.

In Formula (IV), m is an integer of 0 to 3, preferably 0 or 1. When plural $R_8$ groups are present, the plural groups may be the same or different. n is an integer of 0 to 4, preferably 0 or 1. When plural $R_{10}$ groups are present, the plural groups may be the same or different.

In Formula (IV), when $R_{11}$ and $R_{12}$ each represent an alkyl group, they each are a linear, branched or cyclic, saturated or unsaturated alkyl group having a C number of 1 to 30, preferably 1 to 20. $R_{11}$ and $R_{12}$ may be the same or different. There can be given as examples of the alkyl group, methyl, ethyl, propyl, butyl, cyclopropyl, t-octyl, i-butyl, dodecyl, and 2-hexyldecyl. The substituents defined for $R_8$ can be given as the substituents the alkyl groups represented by $R_{11}$ and $R_{12}$ may have.

An aryl group represented by $R_{12}$ is a substituted or unsubstituted aryl group having the C number of 6 to 20, preferably 6 to 10. The representative examples of the aryl group are phenyl and naphthyl. The substituents defined for $R_8$ can be given as the substituents the aryl groups represented by $R_{12}$ may have.

In Formula (IV), Y represents a substituted or unsubstituted alkoxycarbonyl group, a sulfamoyl group, a carbamoyl group, an N-sulfonylsulfamoyl group, an N-acylsulfamoyl group, an acylamino group, an N-sulfonylcarbamoyl group, or a sulfonamido group. Y represents preferably $—CO_2R_{13}$, $—SO_2NHR_{13}$, $—SO_2N(M)SO_2R_{13}$, $—SO_2NHCOR_{13}$, $—NHCOR_{13}$, or $—NHSO_2R_{13}$ wherein $R_{13}$ each represents a substituted or unsubstituted alkyl group or an aryl group, and M represents a hydrogen atom or an alkali metal atom (for example, Na and K). More preferably, Y represents $—SO_2NHR_{13}$, $—SO_2NHCOR_{13}$, or $—NHSO_2R_{13}$.

The splitting-off group represented by $Z_c$ in Formula (IV) may be anyone of the splitting-off groups which have so far been known. There can be given as the preferred $Z_c$, a nitrogen-containing heterocyclic group bonded to a coupling site via a nitrogen atom, an aryloxy group, and a heterocyclic oxy group.

When $Z_c$ represents a nitrogen-containing heterocyclic group bonded to a coupling site via a nitrogen atom, it is preferably a 5 or 6-membered, substituted or unsubstituted, saturated or unsaturated, monocyclic or condensed heterocyclic group having a C number of 1 to 15, preferably 1 to 10. In addition to the nitrogen atom via which the heterocyclic group is bonded to the coupling site, $Z_c$ may contain a nitrogen atom, an oxygen atom or a sulfur atom. There can be given as the preferred examples of the heterocyclic group, 1-pyrazolyl, 1-imidazolyl, pyrrolino, 1,2,4-triazole-2-yl, 1,2,3-triazole-3-yl, benzotriazolyl, benzimidazolyl, imidazolidine-2,4-dione-3-yl, oxazolididne-2,4-dione-3-yl, 1,2,4-triazolidine-3,5-dione-4-yl, 2-imidazolinone-l-yl, 3,5-dioxomorpholino, and 1-imidazolyl. When these heterocyclic groups have substituents, the substituents defined for above $R_8$ can be given as the substituents therefor. The preferred substituents for $Z_c$ are an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, or a sulfonyl group.

When $Z_c$ represents an aryloxy group, it is preferably a substituted or unsubstituted aryloxy group having a C number of 6 to 10. Particularly preferred is a substituted or unsubstituted phenoxy group. When $Z_c$ has a substituent, there can be given as the examples of the substituent, an arylazo group (for example, 4-diethylaminosulfonylphenylazo) and a heterocyclic thio group (for example, 5-methylthio-1,3,4-thiadiazolyl-5-thio) in addition to the substituents defined for above $R_8$. Among them, a preferred substituent is an electron attractive group. There can be given as the examples thereof, a sulfonyl group, an alkoxycarbonyl group, a sulfamoyl group, a halogen atom, a carboxyl group, a carbamoyl group, a nitro group, a cyano group, and an acyl group.

When $Z_c$ represents a heterocyclic oxy group, the heterocyclic portion generally is a 3 to 12-membered, preferably 5 or 6-membered, substituted or unsubstituted, monocyclic or condensed heterocyclic group having a C number of 1 to 20, preferably 1 to 10 and containing at least one of a nitrogen atom, an oxygen atom and a sulfur atom.

There can be given as examples of the heterocyclic oxy group represented by $Z_c$, a pyridyloxy group, a pyrazolyloxy group, and a furyloxy group. When the heterocyclic oxy group has a substituent, the substituents exemplified for $R_8$ can be given as examples thereof. The preferred substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, or a sulfonyl group.

$Z_c$ is preferably a nitrogen-containing heterocyclic group bonded to a coupling site via a nitrogen atom, or an aryloxy group.

Specific examples of the yellow couplers represented by Formula (IV) are shown below by compounds y-1 to y-59, but the present invention is not limited thereto.

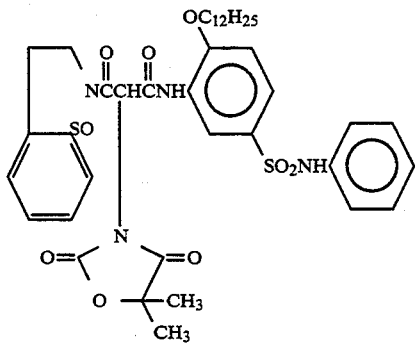

y-1

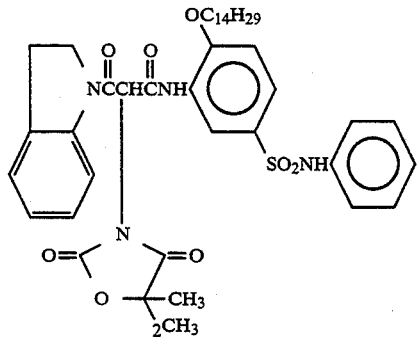

y-2

-continued
y-3
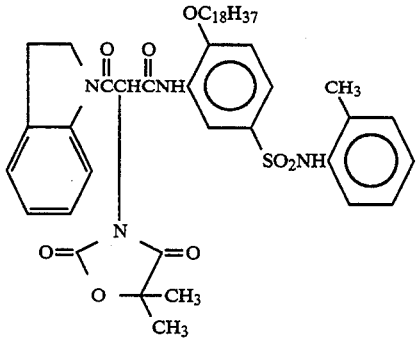
y-4
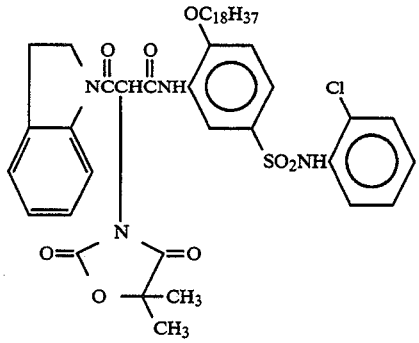
y-5
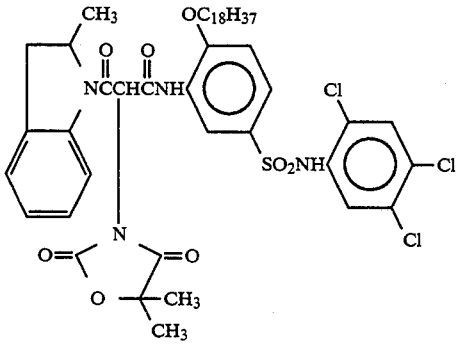
y-6
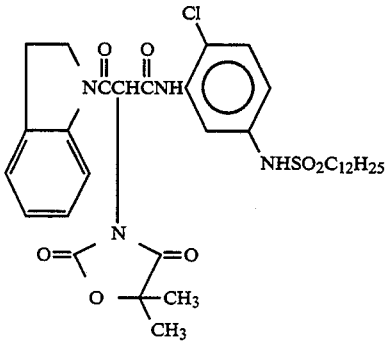
y-7
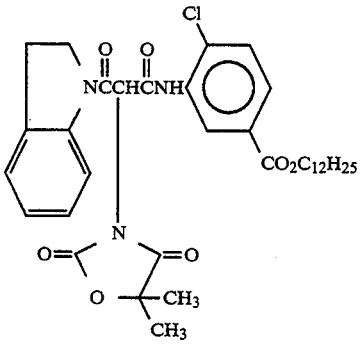
y-8
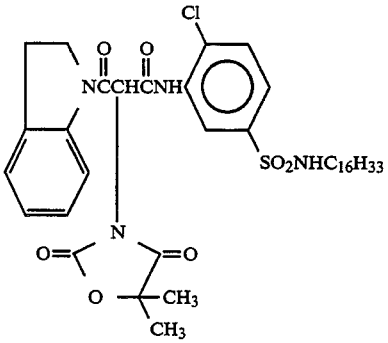
y-9
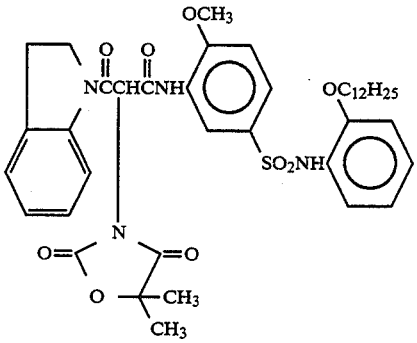
y-10
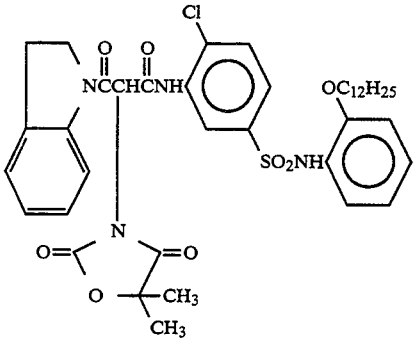

-continued
y-11
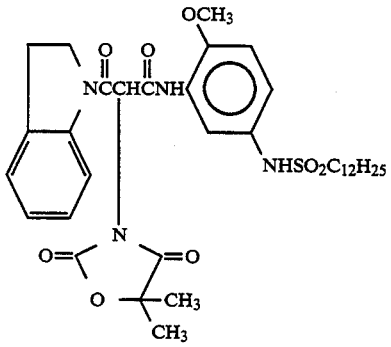
y-12
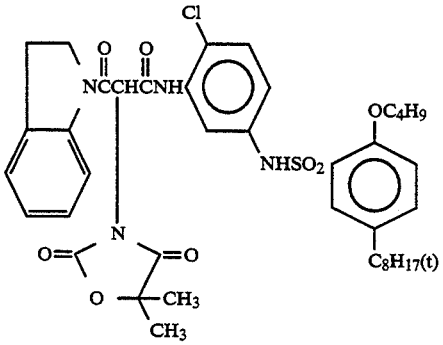
y-13
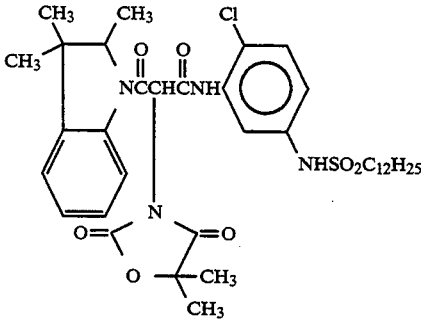
y-14
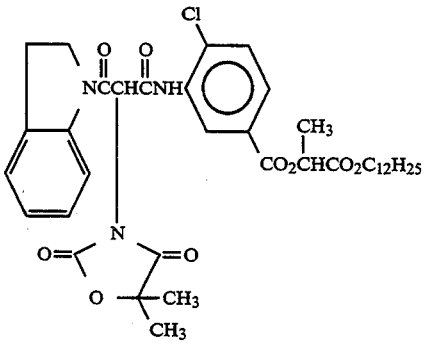
y-15
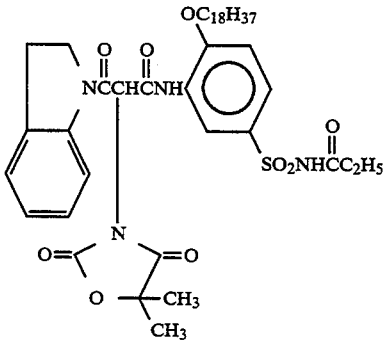
y-16
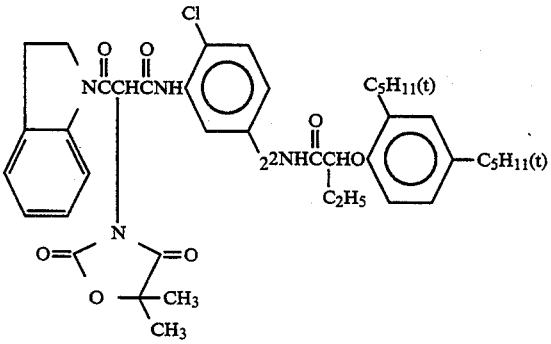
y-17
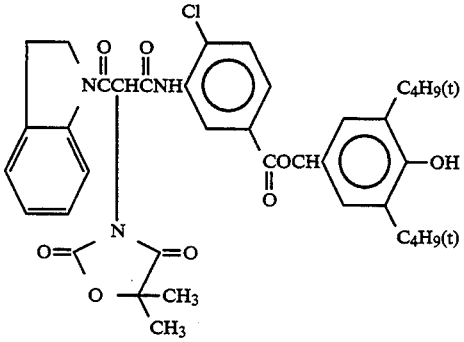
y-18
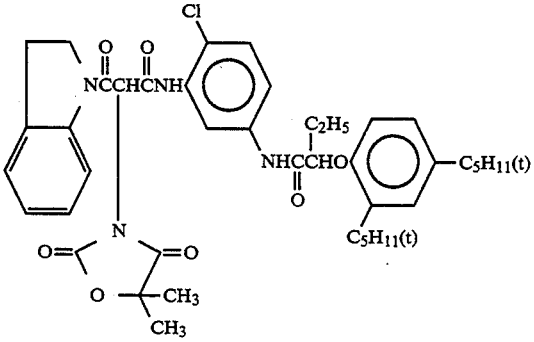

-continued
y-19
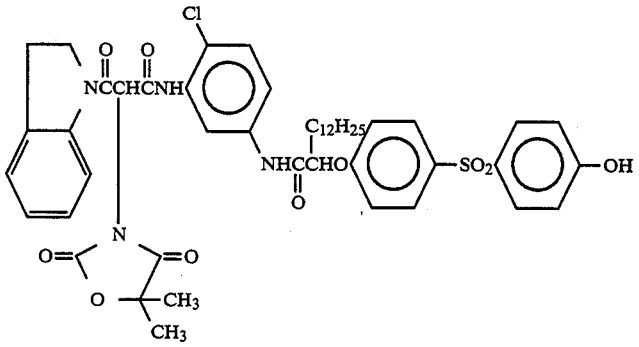
y-20
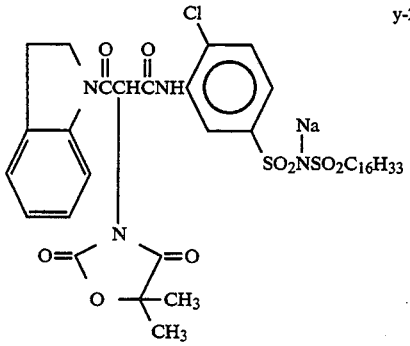
y-21
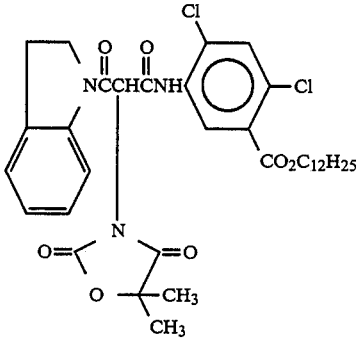
y-22
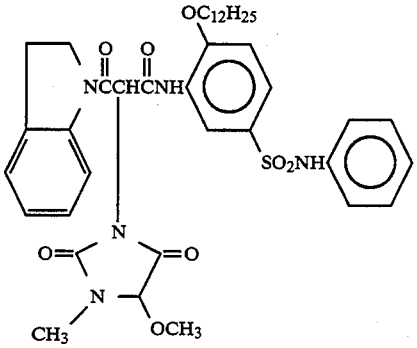
y-23
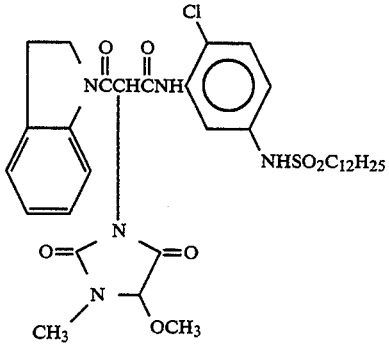
y-24
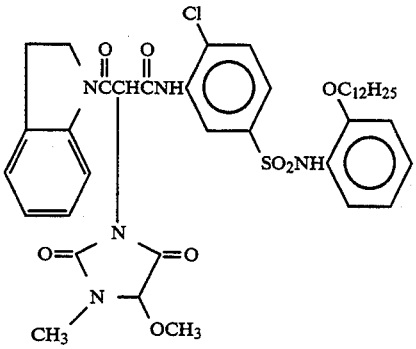
y-25
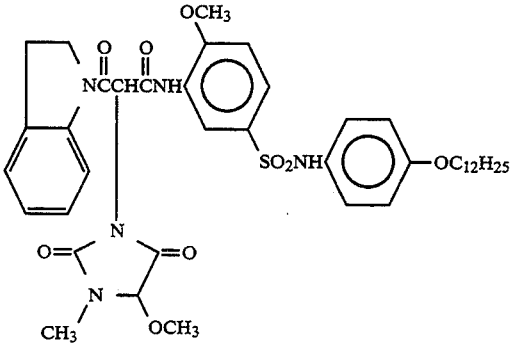
y-26
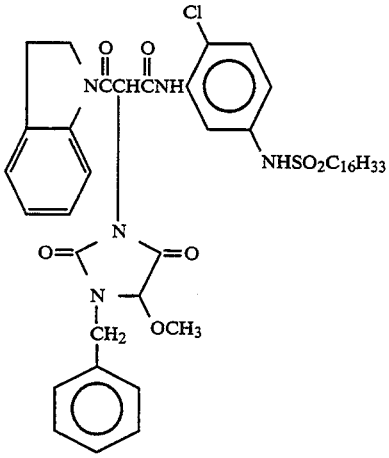

-continued
y-27
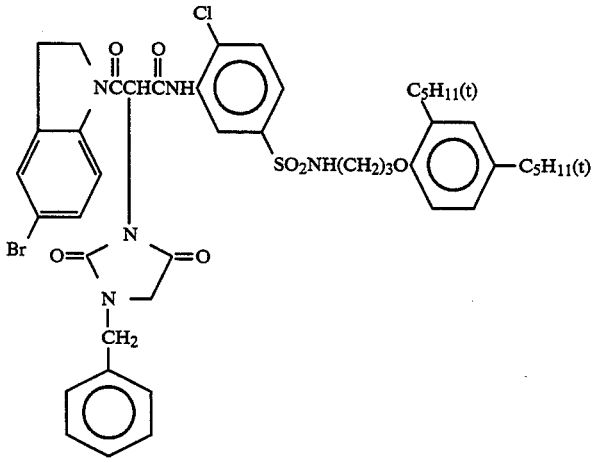
y-28
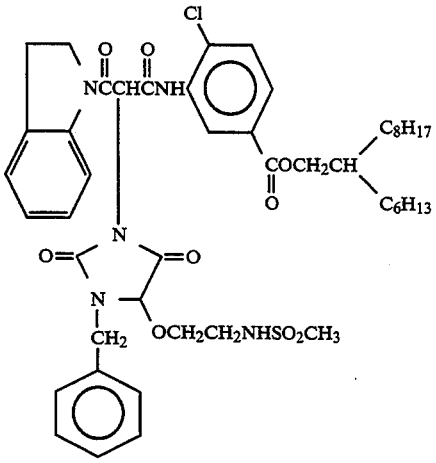
y-29
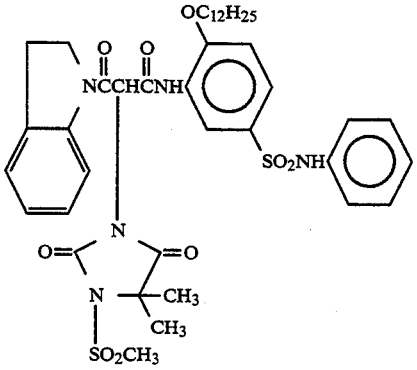
y-30
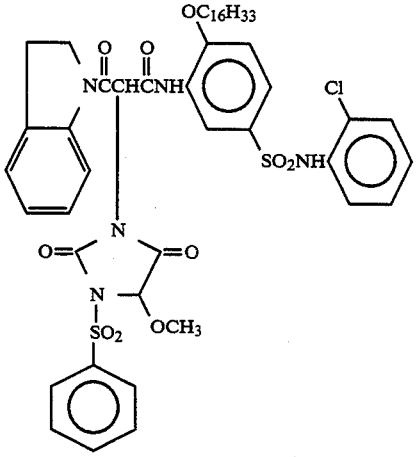
y-31
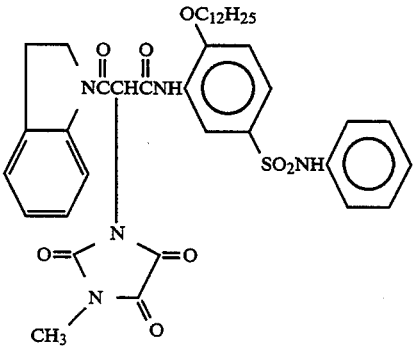
y-32
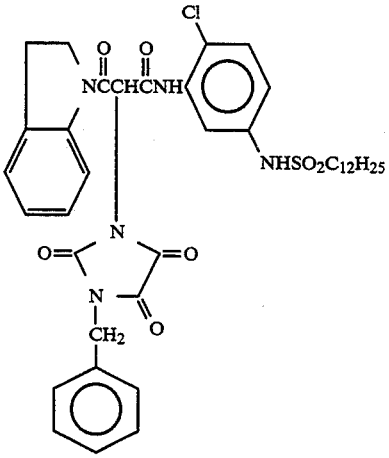

-continued
y-33
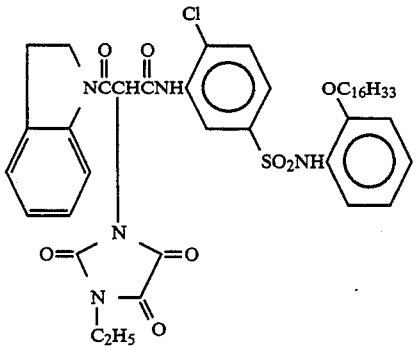
y-34
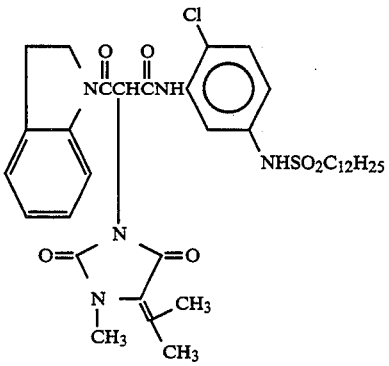
y-35
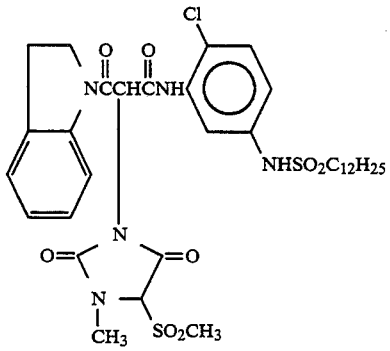
y-36
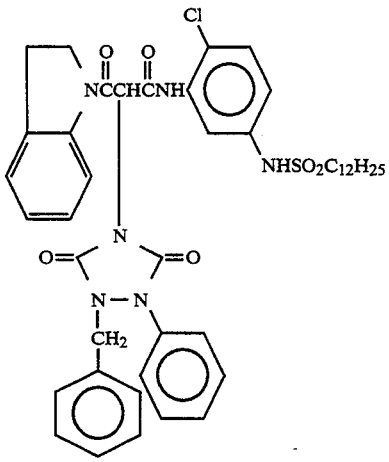
y-37
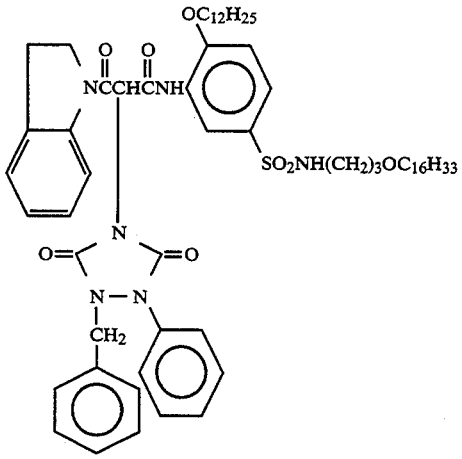
y-38
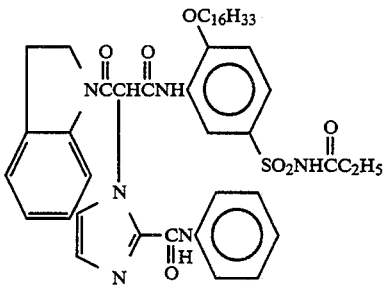

-continued
y-39
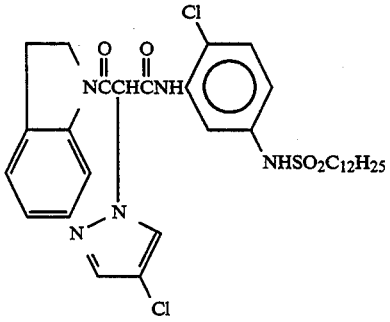
y-40
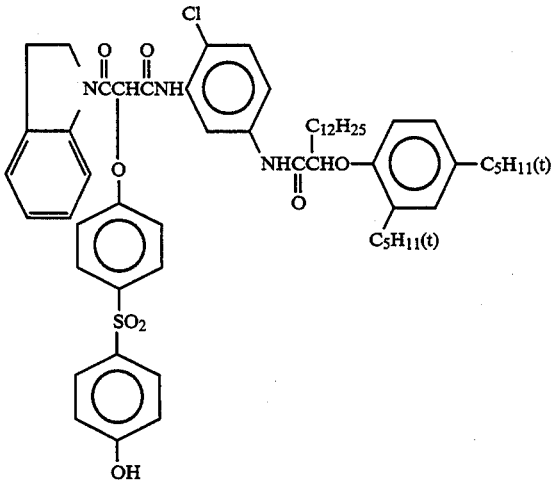
y-41
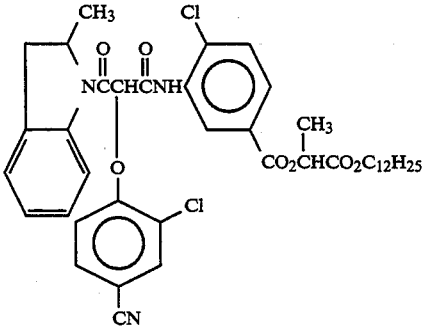
y-42
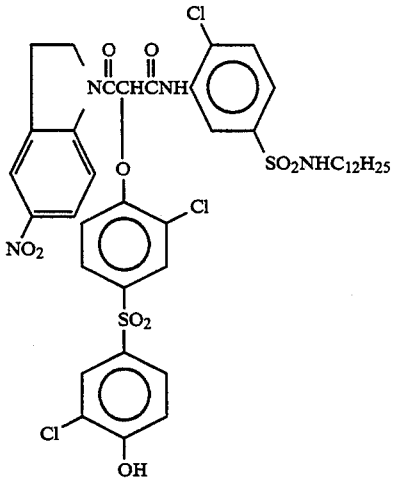
y-43
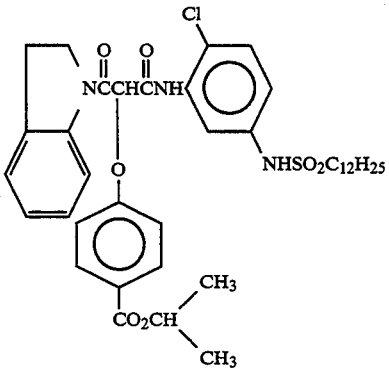
y-44
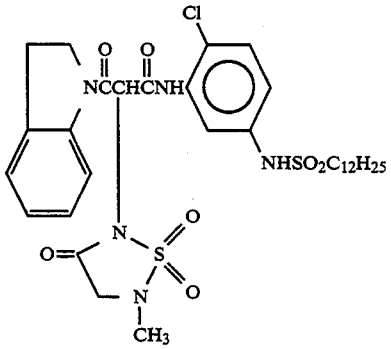
y-45
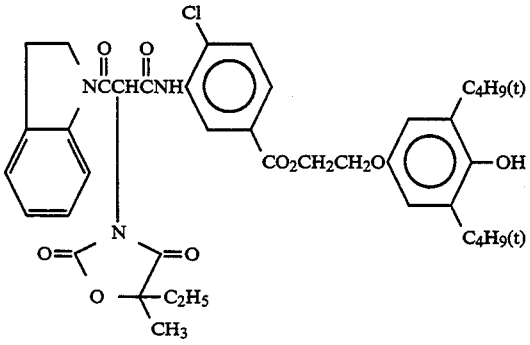
y-46
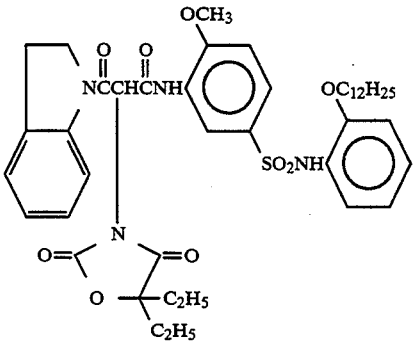

-continued
y-47
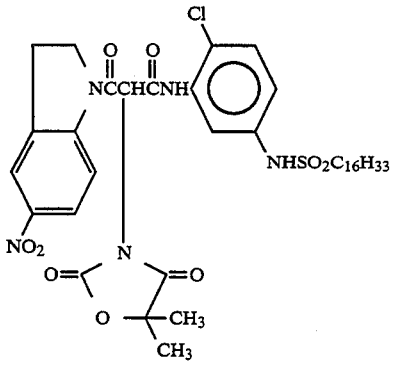
y-48
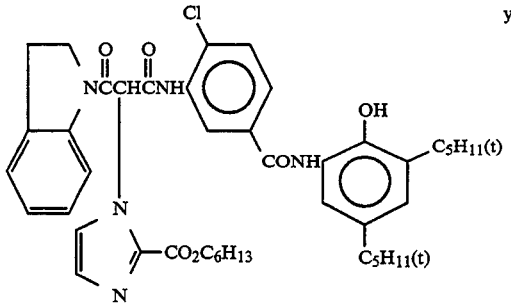
y-49
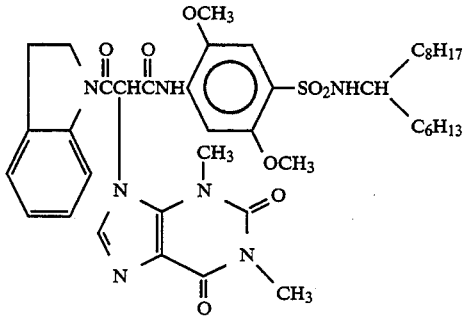
y-50
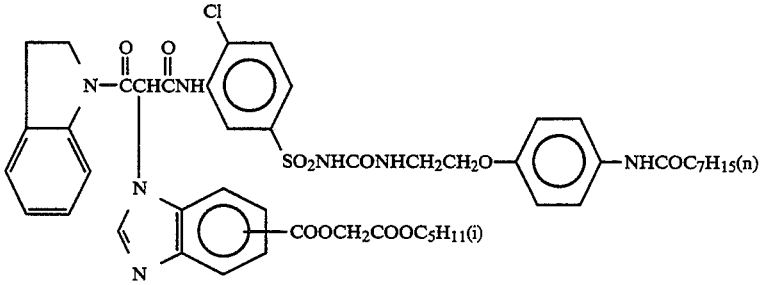
y-51
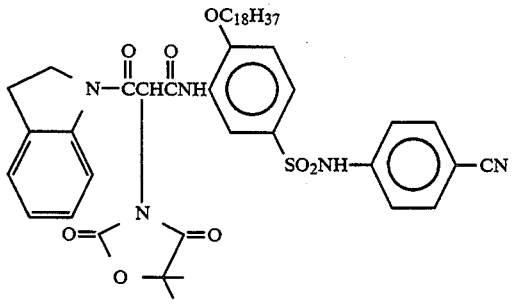
y-52
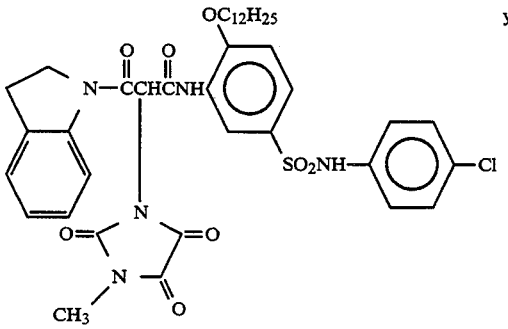
y-53
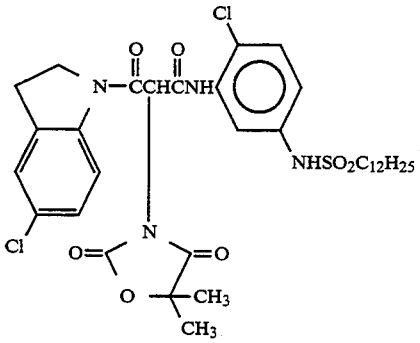
y-54
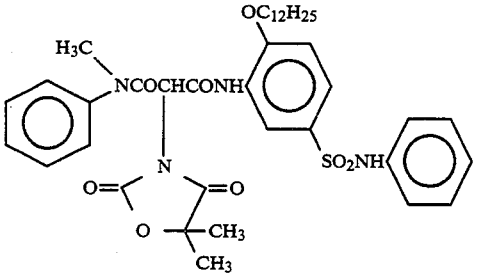

-continued y-55

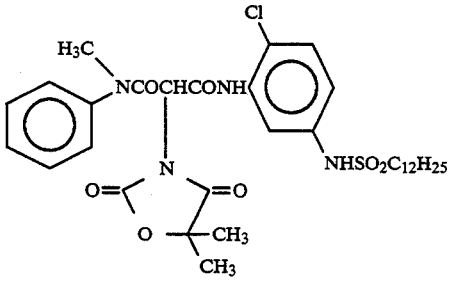

y-56

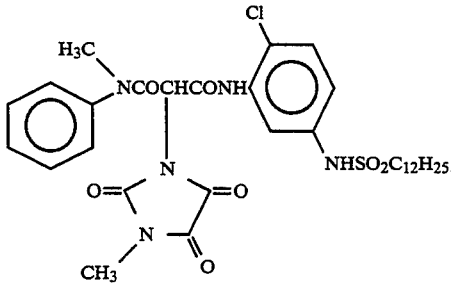

y-57

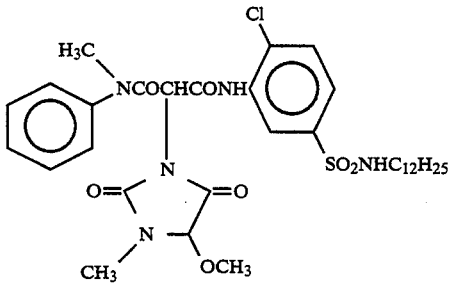

y-58

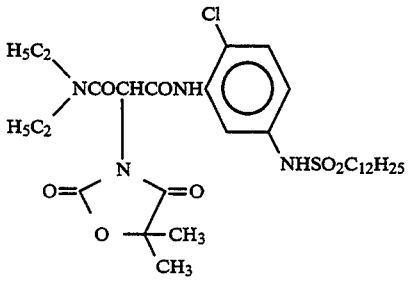

y-59

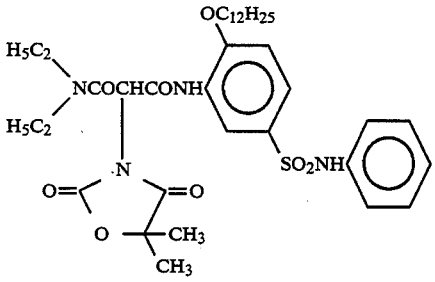

SYNTHESIS EXAMPLE (3)

Synthesis of Exemplified Coupler (y-6)

The synthesis was carried out via the following synthesis route:

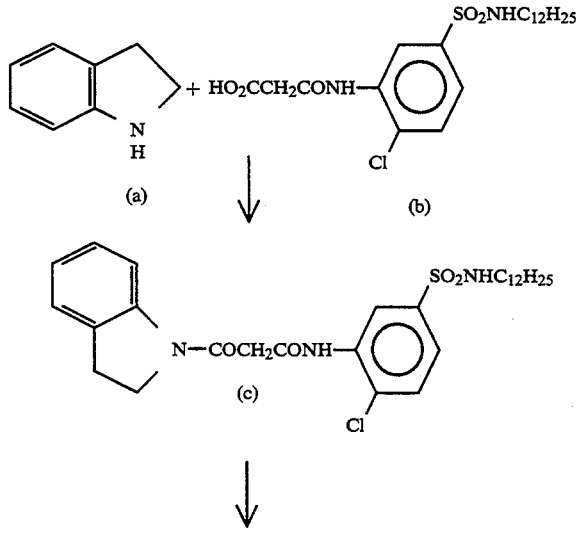

-continued

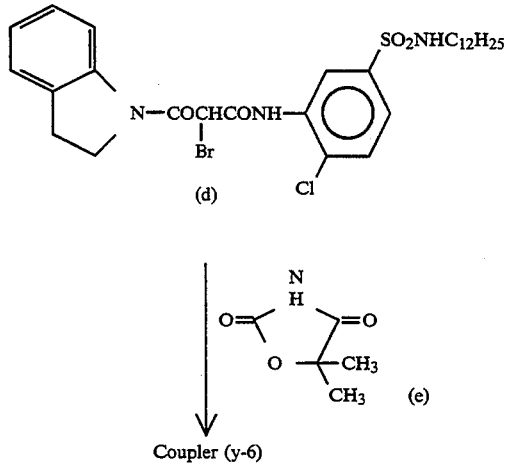

Stage (1): Compound (a) (3.5 g) and compound (b) (13 g) were dissolved in a mixed solvent of N,N-dimethylforamide (100 ml) and acetonitrile (100 ml). Then, an acetonitrile solution (40 ml) containing dissolved N,N'-dicyclohexylcarbodiimide (6 g) was added dropwise to this solution at a room temperature. After reacting for 2 hours, deposited N,N'-dicyclohexylurea was filtered off. The filtrate was added to 500 ml water and the solution was extracted with ethyl acetate. Then, the extract was transferred to a separating funnel and washed with water, followed by separating an oil layer. The solvent was distilled off under a reduced pressure and hexane was added to the residue to deposit a crystal, whereby compound (c) (16.1 g) was obtained.

Stage (2): Compound (c) (16 g) was mixed in dichloromethane (150 ml), and a dichloromethane solution (10 ml) containing 4.8 g bromine was added dropwise to this solution while cooling with ice (5° to 10° C.). After reacting for 10 minutes, the reaction solution was transferred to a separating funnel and washed with water. An oil layer containing compound (d) was recovered and used in the following step.

Stage (3): Compound (e) (8.2 g) and triethyl-amine (8.8 ml) were added to N,N-dimethylformamide (160 ml). Then, a dichloromethane solution containing compound (d) prepared above was added dropwise to this solution at a room temperature. After reacting for one hour, ethyl acetate (500 ml) was added thereto and the solution was transferred to a separating funnel, followed by washing with water. The solution was neutralized with dilute hydrochloric acid and then washed once again with water. An oil layer was separated and the solvent was distilled off under a reduced pressure. The residue was separated and refined with a column chromatography, wherein there were used silica gel as a column packing and ethyl acetate/hexane (1:1 vol.) as an eluting solution. The fraction containing the desired compound was collected and the solvent was distilled off under a reduced pressure, whereby a waxy Compound (y-6) 16.3 g was obtained.

The other couplers of Formula (IV) can be synthesized in the same manner.

The amount of yellow dye-forming coupler represented by Formula (III) or (IV) which is added to a light-sensitive material generally is $1\times10^{-5}$ to $1\times10^{-2}$ mole, preferably $5\times10^{-5}$ to $5\times10^{-3}$ mole per $m^2$ of the light-sensitive material.

The silver halide color photographic light-sensitive material of the present invention comprises at least a silver halide emulsion layer containing a yellow dye-forming coupler, a silver halide emulsion layer containing a magenta dye-forming coupler and a silver halide emulsion layer containing a cyan dye-forming coupler, and these emulsion layers are preferably blue-sensitive, green-sensitive and red-sensitive, respectively. The light-sensitive material of the present invention can be of the constitution in which the emulsion layers are provided in this order, but may be of the constitution in which the order is different from this. Also, at least one of the above light-sensitive emulsion layers can be replaced with an infrared-sensitive silver halide emulsion layer.

A pyrazoloazole type magenta coupler preferably used in the present invention is represented by Formula (M):

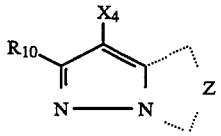

(M)

wherein $R_{10}$ represents a hydrogen atom or a substituent; z represents a group of non-metallic atoms necessary to form a 5-membered azole ring containing 2 or 3 nitrogen atoms, the azole ring being allowed to have a substituent; and $X_4$ represents a hydrogen atom or a group of splitting off upon a reaction with an oxidation product of an aromatic primary amine color developing agent.

Among the pyrazoloazole type couplers represented by Formula (M), preferred in terms of an absorption characteristic of a dye image are imidazo[1,2-b]pyrazoles described in U.S. Pat. No. 4,500,630, pyrazolo-[1,5-b][1,2,4]triazoles described in U.S. Pat. No. 4,540,654, and pyrazolo[1,5-c][1,2,4]triazoles described in U.S. Pat. No. 3,725,067. Of them, pyrazolo[1,5-b][1,2,4]triazoles are particularly preferred in terms of a light fastness.

The details of the substituents for the azole ring represented by $R_{10}$, $X_4$ and Z are described, for example, on the 41st line of the second column to the 27th line of the eighth column of U.S. Pat. No. 4,540,654. Preferred is a pyrazoloazole coupler in which a branched alkyl group is bonded to a 2, 3 or 6-position of a pyrazolotriazole ring, described in JP-A-61-65245, a pyrazoloazole coupler containing a sulfonamido group in a molecule, described in JP-A-61-147254, a pyrazolo-triazole coupler having an alkoxyphenylsulfonamido ballast group, described in JP-A-61-65246, a pyrazolo-azole coupler having an alkoxy group or an aryloxy group at a 6-position, described in JP-A-62-209457 or JP-A-63-307453, and a pyrazolotriazole coupler having a carbonamido group in a molecule, described in JP-A-1-22279.

Preferred magenta couplers represented by formula (M) are those represented by formula (M-I) or (M-II).

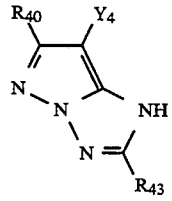

(M-I)

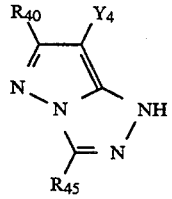

(M-II)

wherein $R_{40}$, $R_{43}$ and $R_{45}$ each has the same meaning as $R_{10}$ in formula (V) and $Y_4$ has the same meaning as $X_4$ in formula (M).

Of these couplers, specific examples of the pyrazoloazole couplers of formula (M-I) or (M-II) are enumerated below:

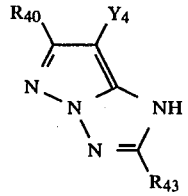
| Compound | $R_{40}$ | $R_{43}$ | $Y_4$ |
|---|---|---|---|
| M-1 | $CH_3$— | 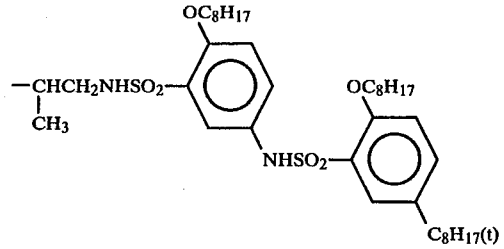 | Cl |
| M-2 | $CH_3$— | 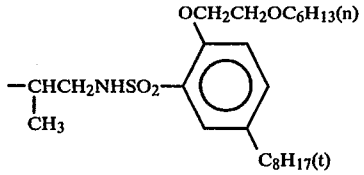 | Cl |
| M-3 | $(CH_3)_3C$— | 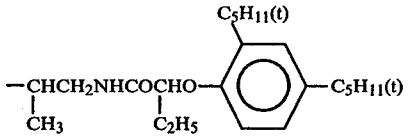 | 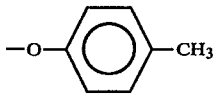 |
| M-4 | 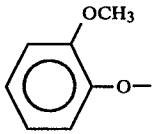 | 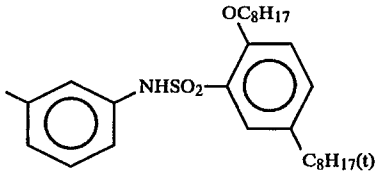 | 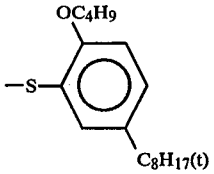 |

-continued
| | | | |
|---|---|---|---|
| M-5 | $CH_3$— | 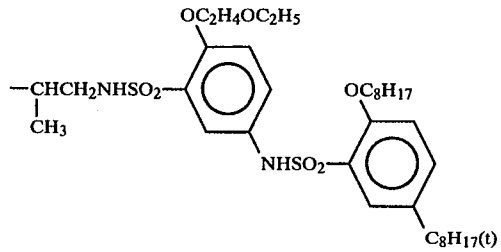 | Cl |
| M-6 | $CH_3$— | 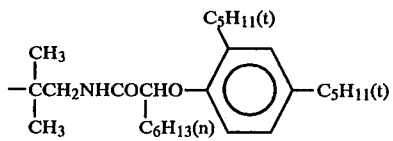 | Cl |
| M-7 | $CH_3$— | 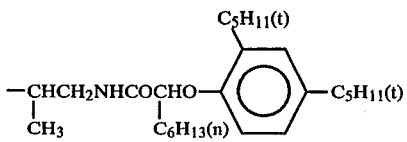 | Cl |
| M-8 | —$CH_3$ | 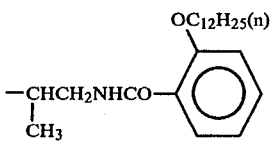 | Cl |
| M-9 | —$CH_3$ | 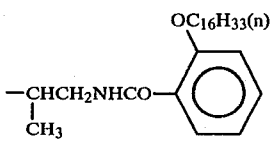 | Cl |

-continued
| | | | |
|---|---|---|---|
| M-10 | 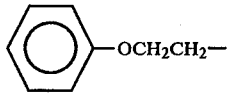 | 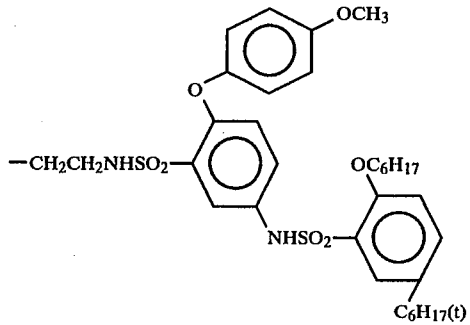 | 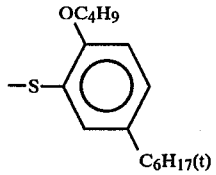 |
| M-11 | $CH_3CH_2O$— | " | " |
| M-12 | 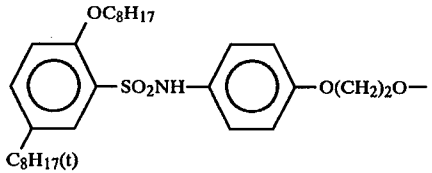 | 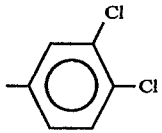 | 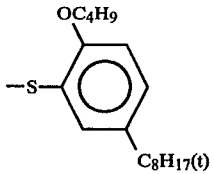 |
| M-13 | 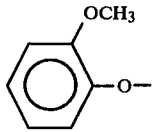 | 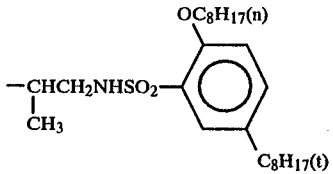 | Cl |
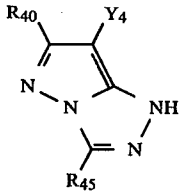
| Compound | $R_{40}$ | $R_{45}$ | $Y_4$ |
|---|---|---|---|
| M-14 | $CH_3$— | 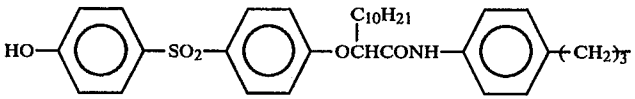 | Cl |

-continued

| | | | |
|---|---|---|---|
| M-15 | $CH_3-$ | $(n)C_6H_{13}$<br>$CHCH_2SO_2(CH_2)_2$<br>$(n)C_6H_{13}$ | Cl |
| M-16 | $CH_3$<br>$CH-$<br>$CH_3$ | $OC_4H_9$<br>$SO_2(CH_2)_3$<br>$C_8H_{17}(t)$ | Cl |
| M-17 | $CH_3$<br>$(CH-CH_2)_{50}(CH_2-C)_{50}$<br>$COOCH_2CH_2OCH_3$ $CONH-$ | $CH_3-CH-$<br>$CH_2NHSO_2CH_3$ | Cl |
| M-18 | $-O-$ | $OC_8H_{17}$<br>$(CH_2)_2NHSO_2$<br>$C_8H_{17}(t)$ | Cl |
| M-19 | $CH_3-$ | $CH_3$<br>$CH_3$<br>$CH_3$ $NHCOCHO$ $SO_2$ $OCH_2$<br>$(n)C_{10}H_{21}$ | Cl |
| M-20 | $(CH_3)_3C-$ | $CH_3$<br>$CH_3$ $C_5H_{11}(t)$<br>$CH_3$ $NHCOCHO$ $C_5H_{11}(t)$<br>$C_4H_9(n)$ | Cl |

-continued
| | | | |
|---|---|---|---|
| M-21 | 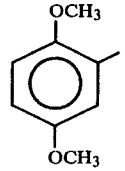 | 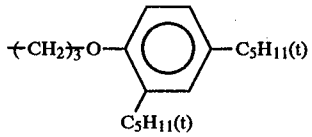 | Cl |
| M-22 | $CH_3$— | $-CH(C_2H_5)-N(n)C_{18}H_{37}COCH_2CH_2COOH$ | Cl |

Specific examples and syntheses examples other than the above examples are described in U.S. Pat. Nos. 4,540,654 and 4,705,863, JP-A-61-65245, JP-A-62-209457 and JP-A-62-249155, JP-B-47-27411 (the term "JP-B" as used herewith means an examined published Japanese patent application), and U.S. Patent 3,725,067.

In the present invention, the amount of the magenta coupler used in a light-sensitive material generally is $1\times10^{-5}$ to $1\times10^{-2}$ mole, preferably $5\times10^{-5}$ to $5\times10^{-3}$ mole per $m^2$ of the light-sensitive material.

The couplers of the present invention represented by Formulas (I) to (V) can be incorporated into a light-sensitive material by various conventional methods. Preferred is an oil-in-water dispersion method in which they are dissolved in a high boiling solvent (a low boiling solvent is used in combination according to necessity) and are emulsified and dispersed in a gelatin aqueous solution to add to a silver halide emulsion.

Examples of the high boiling solvent used in the oil-in-water dispersion method are described in U.S. Pat. No. 2,322,027.

There can be given as the high boiling organic solvent which can be used in the above oil-in-water dispersion method, phthalic acid esters (for example, dibutyl phthalate, dioctyl phthalate, dicyclohexyl phthalate, di-2-ethylhexyl phthalate, decyl phthalate, bis(2,4-di-tertamylphenyl)isophthalate, and bis(1,1-diethylpropyl)phthalate), phosphoric acid or phosphonic acid esters (for example, diphenyl phosphate, triphenyl phosphate, tricresyl phosphate, 2-ethylhexyldiphenyl phosphate, dioctylbutyl phosphate, tricyclohexyl phosphate , tri-2-ethylhexyl phosphate, tridodecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl p-hydroxybenzoate amides (for example, N,N-diethyl-dodecanamide and N,N-diethyl laurylamide), alcohols or phenols (for example, isostearyl alcohol and 2,4-di-tertamylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), aniline derivatives (for example, N,N-dibutyl-2-butoxy-5-tert-octylaniline), chlorinated paraffin (for example, paraffins having a chlorine content of 10 to 80%), trimesic acid esters (for example, tributyl trimesate), dodecylbenzene, diisopropylnaphthalene, phenols (for example, 2,4-di-tertamylphenol, 4 -dodecylphenol, 4-dodecyloxycarbonylphenol, and 4-(4-dodecyloxyphenylsulfonyl)phenol) carboxylic acids (for example, 2-(2,4-di-tertamylphenoxy)butyric acid, and 2-ethoxy-octanedecanoic acid), and alkylphosphoric acids (for example, di-2(ethylhexyl)phosphoric acid and diphenylphosphoric acid). Further, there may be used in combination as an auxiliary solvent, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide).

The high boiling solvents can be used in an amount of 0 to 10.0 times, preferably 0 to 4.0 by weight of a coupler.

The couplers of the present invention represented by Formulas (I) to (V) can also be incorporated into a light-sensitive material by a latex dispersing method. Examples of polymer dispersing methods and examples of a latex for impregnation are described in U.S. Pat. No. 4,199,363, German Patent Applications (OLS) 2,541,274 and 2,541,230, JP-B-53-41091, and European Patent Application 029104. Further, a dispersion method by an organic solvent-soluble polymer is described in PCT International Patent Publication W088/00723.

The present invention can be applied to a conventional multilayered silver halide color photographic light-sensitive material (for example, a color negative film, a color reversal film, a color positive film, a color negative film for a movie, a color photographic paper, a reversal color photographic paper, and a direct positive color photographic paper), and an infrared-sensitive material for a laser scanner. The silver halide color photographic light-sensitive material of the present invention comprises a support and provided thereon at least a silver halide emulsion layer containing a yellow dye-forming coupler, a silver halide emulsion layer containing a magenta dye-forming coupler and a silver halide emulsion layer containing a cyan dye-forming coupler. It can have various layer constitutions on one side or both sides thereof (for example, a subbing layer, an antihalation layer, a filter layer, an intermediate layer, and a surface protective layer) arranged according to the objects thereof.

Those described in the following patent publications, particularly European Patent EP 0,355,660A2 are preferably used as the silver halide emulsions, other materials (the additives) and photographic constitutional layers (a layer arrangement) applied in the present invention, and the processing methods and additives for processing, which are applied for processing the light-sensitive material:

| Photographic element | JP-A-62-215272 | JP-A-2-33144 | EP 0355660A2 |
|---|---|---|---|
| Silver halide emulsion | p. 10, right upper column, line 6 to p. 12, left lower column, line 5, and p.12, right lower column, line 4 from bottom to p. 13, left upper column, line 17. | p. 28, right upper column, line 16 to p. 29, right lower column, line 11, and p. 30, lines 2 to 5. | p. 45, line 53 to p. 47, line 3, and p. 47, lines 20 to 22. |
| Silver halide solvent | p. 12, left lower column, line 6 to 14, and p. 13, left upper column, line 3 from bottom to p. 18, left lower column, last line. | — | — |
| Chemical sensitizer | p. 12, left lower column, line 3 from bottom to right lower column, line 5 from bottom, and p. 18, right lower column, line 1 to p. 22, right upper | p. 29, right lower column, line 12 to last line. | p. 47, lines 4 to 9. |

-continued

| Photographic element | JP-A-62-215272 | JP-A-2-33144 | EP 0355660A2 |
|---|---|---|---|
| | column, line 9 from bottom. | | |
| Spectral sensitizer (spectral sensitizing method) | p. 22, right upper column, line 8 from bottom to p. 38, last line. | p. 30, left upper column, lines 1 to 13. | p. 47, lines 10 to 15. |
| Emulsion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers) | p. 91, right upper column, line 4 to p. 121, left upper column, line 6. | p. 3, right upper column, line 14 to p. 18, left upper column, last line, and p. 30, right upper column, line 6 to p. 35 right lower column, line 11. | p. 4, lines 15 to 27, p. 5, line 30 to p. 28, last line, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, lines 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, line 33 to 40, and p. 65, lines 2 to 21. |
| High boiling and/or low boiling organic solvent | p. 137, left lower column, line 9 to p. 144, right upper column, last line. | p. 35, right lower column, line 14 to p. 36, left upper, line 4. | p. 64, lines 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to p. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, line 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67 line 13. |
| Light-sensitive layer structure | p. 156, left upper column, line 15 to right lower column, line 14. | p. 28, right upper column, lines 1 to 15. | p. 45, lines 41 to 52. |
| Dye | p. 156, right lower column, line 15 to p. 184, right lower column, last line. | p. 38, left upper column, line 12 to right upper column, line 7. | p. 66, lines 18 to 22. |
| Anti-color mixing agent | p. 185, left upper column, line 1 to p. 188, right lower column, line 3. | p. 36, right upper column, lines 8 to 11. | p. 64, line 57 to line 1. |
| Gradation controller | p. 188, right lower column, line 4 to 8. | — | — |
| Anti-stain agent | p. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line | p. 18, right upper column, line 1 to p. 24, right lower column, last line, and p. 27, left lower column, line 10 from bottom to right lower column, line 9. | — |
| Fluorinated compound (anti-electrification agent, coating aid, lubricant and anti- | p. 210, left lower column, line 1 to p. 222, left lower column, line 5. | p. 25, left upper column, line 1 to p. 27, right lower column, line 9. | |

-continued

| Photographic element | JP-A-62-215272 | JP-A-2-33144 | EP 0355660A2 |
|---|---|---|---|
| adhesion agent) | | | |
| Binder (hydrophilic colloid) | p. 222, left lower column, line 6 to p. 225, left upper column, last line | p. 38, right upper column, lines 8 to 18. | p. 66, lines 23 to 28. |
| Thickener | p. 225, right upper column, line 1 to p. 227, right upper column, line 2. | — | — |
| Anti-electrification agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited items of JP-A-62-215272, the subject matter amended according to the Amendment of March 16, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

There can be used as silver halide used in the present invention, silver chloride, silver bromide, silver bromochloride, silver bromochloroiodide, silver bromoiodide, and silver chloroiodide.

For the purpose of improving sharpness of an image, there are preferably incorporated into a hydrophilic colloid layer of the light-sensitive material according to the present invention so that an optical reflection density of the light-sensitive material at 680 nm becomes 0.70 or more, dyes (among them, an oxonol type dye) capable of being decolored by processing, described at pages 27 to 76 of European Patent EP 0,337,490A2, and into a hydrophobic resin layer of a support, titanium oxide which is subjected to a surface treatment with di- to tetrahydric alcohols (for example, trimethylolethane) in a proportion of 12% by weight or more (more preferably 14% by weight or more).

Also, in the light-sensitive material according to the present invention, color image preservability-improving compounds such as described in European Patent 0,277,589A2 are preferably used together with couplers. In particular, they are used preferably in combination with a pyrazoloazole coupler.

Preferably used simultaneously or singly for preventing side effects of, for example, the generation of stain due to the reaction of a color developing agent or an oxidation product thereof remaining in a layer during storage after processing with a coupler are compounds (A) described in European Patent EP0,277,589A2, which chemically combine with an aromatic amine type developing agent remaining after a color development processing to form a chemically inactive and substantially colorless compound, and/or compounds (B) described in European Patent EP0,277,589A2, which chemically combine with an oxidation product of an aromatic amine type developing agent remaining after a color development processing to form a chemically inactive and substantially colorless compound.

Further, anti-mold agents such as described in JP-A-63-271247 are preferably added to the light-sensitive material according to the present invention for the purpose of preventing various molds and bacteria which grow in a hydrophilic colloid layer to deteriorate an image.

There may be used as a support for the light-sensitive material according to the present invention for display, a white color polyester type support or a support in which a layer containing a white pigment is provided on a support side having a silver halide emulsion layer. An anti-halation layer is preferably provided on a support side coated thereon with a silver halide emulsion layer or the backside thereof in order to further improve a sharpness. In particular, the transmission density of a support is controlled preferably to be 0.35 to 0.8 so that a display can be admired with either a reflected light or a transmitted light.

The light-sensitive material according to the present invention may be exposed with either a visible ray or an infrared ray. The method of exposure may be either a low illuminance exposure or a high illuminance exposure for a short time. Particularly in the latter case, preferred is a laser scanning exposing method in which an exposing time per a picture element is shorter than $10^{-4}$ second.

During exposure, a band stop filter described in U.S. Pat. No. 4,880,726 is preferably used, whereby a light mixture is removed to notably improve color reproduction.

The present invention will be further described in the following examples, but the present invention should not be construed as being limited thereto.

EXAMPLE 1

A paper support laminated on both sides thereof with polyethylene, which was subjected to a corona discharge treatment, was provided with a gelatin subbing layer containing sodium dodecylbenzenesulfonate, and further was coated with the various photographic constitutional layers, whereby a multilayered color photographic paper (Sample 101) having the following layer constitution was prepared. The coating solutions were prepared in the following manner.

Preparation of the Fifth Layer Coating Solution

Ethyl acetate (50.0 ml) and a solvent (Solv-6) (14.0 g) were added to a cyan coupler (ExC) (32.0 g), a dye image stabilizer (Cpd-2) (3.0 g), a dye image stabilizer (Cpd-4) (2.0 g), a dye image stabilizer (Cpd-6) (18.0 g), a dye image stabilizer (Cpd-7) (40.0 g), and a dye image stabilizer (Cpd-8) (5.0 g) to dissolve them. This solution was added to 500 ml of a 20% aqueous gelatin solution containing sodium dodecylbenzenesulfonate (8 g), and then was dispersed with a supersonic homogenizer to thereby prepare an emulsified dispersion.

Meanwhile, there was prepared a silver bromochloride emulsion (cube, a 1:4 mixture by Ag mole ratio of a large size emulsion with an average grain size of 0.58 μm and a small size emulsion with an average grain size of 0.45 μm, wherein the variation coefficients of the distribution of particle size were 0.09 and 0.11, respectively, and both size emulsions contained grains in which AgBr 0.6 mol% was partially located on the surface thereof). Added to this emulsion was the following red-sensitive sensitizing dye E in an amount of $0.9\times10^{-4}$ mole per mole of silver based on the large size emulsion and $1.1\times10^{-4}$ mole per mole of silver based on the small size emulsion. Further, this emulsion was subjected to a chemical ripening after adding a sulfur sensitizer and a gold sensitizer. The foregoing emulsified dispersion and this red-sensitive silver bromochloride emulsion were mixed and dissolved, whereby a fifth layer coating solution was prepared so that it was of the following composition.

The coating solutions for the 1st layer to 4th layer, the 6th layer and the 7th layer were prepared in a similar manner as the 5th layer coating solution. H-1 and H-2 were used as a gelatin hardener for the respective layers. Further, Cpd-10 and Cpd-11 were added to the respective layers so that the entire amounts thereof became 25.0 mg/m$^2$ and 50.0 mg/m$^2$, respectively.

The following spectral sensitizing dyes were used for the silver bromochloride emulsions contained in the respective light-sensitive emulsion layers.

Blue-sensitive emulsion layer

Sensitizing dye A

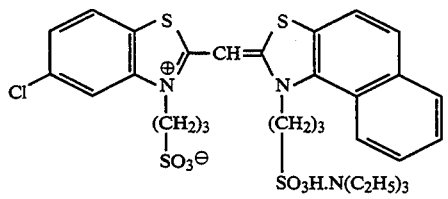

-continued and

Sensitizing dye B

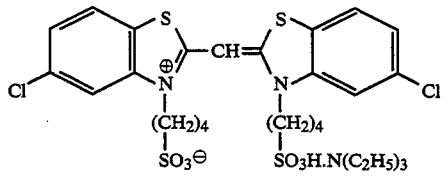

(each $2.0\times10^{-4}$ mole per mole of silver to the large size emulsion and each $2.5\times10^{-4}$ mole per mole of silver to the small size emulsion).

Green-sensitive emulsion layer

Sensitizing dye C

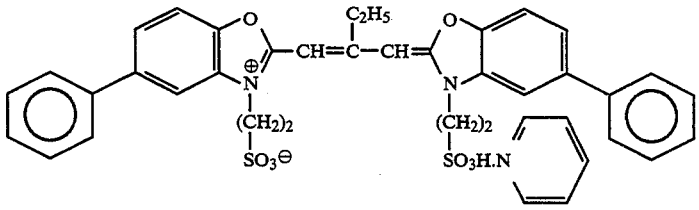

($4.0\times10^{-4}$ mole per mole of silver to the large size emulsion and $5.6\times10^{-4}$ mole per mole of silver to the small size emulsion), and Sensitizing dye D

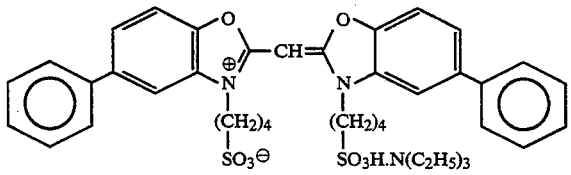

($7.0\times10^{-5}$ mole per mole of silver to the large size emulsion and $1.0\times10^{-5}$ mole per mole of silver to the small size emulsion).

Red-sensitive emulsion layer

Sensitizing dye E

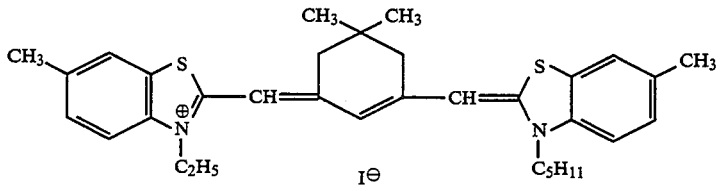

(0.9×10$^{-4}$ mole per mole of silver to the large size emulsion and 1.1×10$^{-4}$ mole per mole of silver to the small size emulsion).

Further, the following compound was added to each layer in an amount of 2.6×10$^{-3}$ mole per mole of silver:

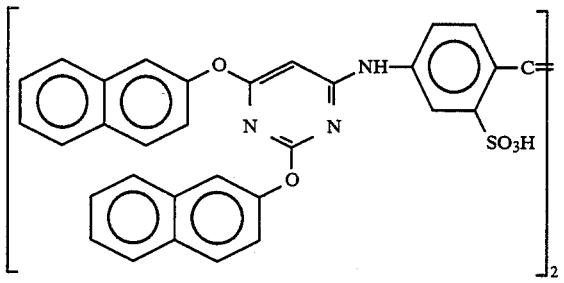

Further there was added to the blue-sensitive layer, green-sensitive layer and red-sensitive layer, 1-(5-methylureidophenyl)-5-mercaptotetrazole in the amounts of 8.5×10$^{-5}$ mole, 7.7×10$^{-4}$ mole and 2.5×10$^{-4}$ mole per mole of silver halide, respectively.

Further there was added to the blue-sensitive layer and green-sensitive layer, 4-hydroxy-6-methyl-1,3,3a,7-tetrazaindene in the amounts of 1×10$^{-4}$ mole and 2×10$^{-4}$ mole per mole of silver halide, respectively.

The following dyes (the number in the parenthesis represents a coated amount) were added to the following emulsion layers for preventing an irradiation:

First layer (blue-sensitive emulsion layer)

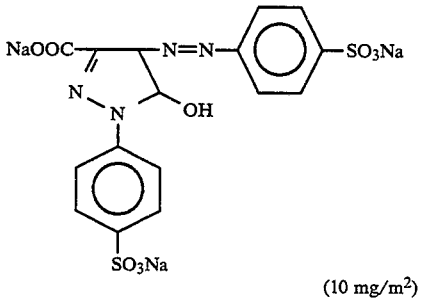

(10 mg/m$^2$)

Third layer (green-sensitive emulsion layer)

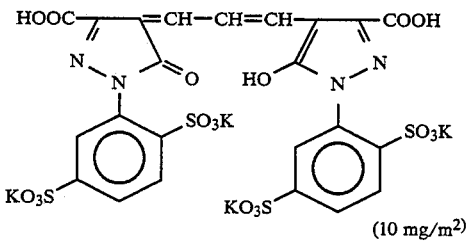

(10 mg/m$^2$)

Fifth layer (red-sensitive emulsion layer)

-continued

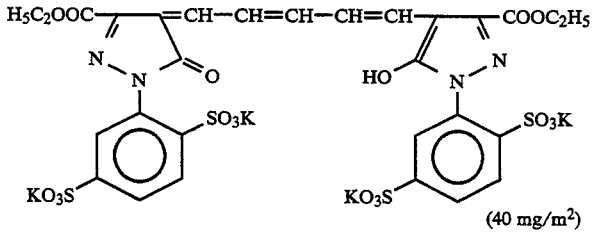

(40 mg/m²)

and

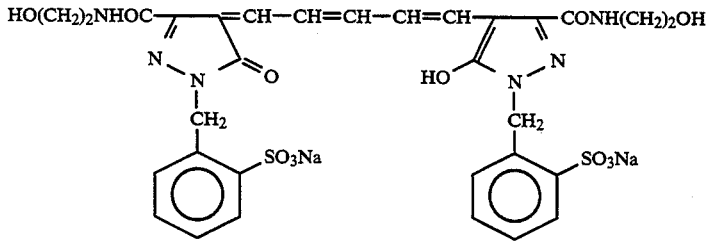

(20 mg/m²)

Layer constitution

The compositions of the respective layers are shown below. The numbers represent the coated amounts (g/m²). The coated amounts of the silver halide emulsions are expressed in terms of the amounts converted to silver.

Support

Polyethylene laminated paper (polyethylene coated on the 1st layer side contains a white pigment/$TiO_2$ and a blue dye/ultramarine).

| | |
|---|---|
| First layer: a blue-sensitive emulsion layer | |
| Silver bromochloride emulsion (cube; 3:7 mixture (silver mole ratio) of a large size emulsion having an average grain size of 0.88 μm and a small size emulsion having an average grain size of 0.70 μm, wherein the variation coefficients of the grain size distributions are 0.08 and 0.10, respectively, and both size emulsions contain grains in which AgBr 0.3 mol % is partially located on the surface thereof) | 0.26 |
| Gelatin | 1.52 |
| Yellow coupler (ExY) | 0.48 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| Dye image stabilizer (Cpd-9) | 0.04 |
| Stabilizer (Cpd-12) | 0.01 |
| Second layer: a color mixing prevention layer | |
| Gelatin | 0.99 |
| Color mixing prevention agent (Cpd-5) | 0.08 |
| Solvent (Solv-1) | 0.16 |
| Solvent (Solv-4) | 0.08 |
| Third layer: a green-sensitive emulsion layer | |
| Silver bromochloride emulsion (cube; 1:3 mixture (silver mole ratio) of a large size emulsion having an average grain size of 0.55 μm and a small size emulsion having an average grain size of 0.39 μm, wherein the variation coefficients of the grain size distributions are 0.10 and 0.08, respectively, and both size emulsions contain grains in which AgBr 0.8 mol % is partially located on the surface thereof) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| Fourth layer: a UV absorbing layer | |
| Gelatin | 1.58 |
| UV absorber (UV-1) | 0.47 |

-continued

| | |
|---|---|
| Color mixing prevention agent (Cpd-5) | 0.05 |
| Solvent (Solv-5) | 0.24 |
| Fifth layer: a red-sensitive emulsion layer | |
| Silver bromochloride emulsion (cube; 1:4 mixture (silver mole ratio) of a large size emulsion having an average grain size of 0.58 μm and a small size emulsion having an average grain size of 0.45 μm, wherein the variation coefficients of the grain size distributions are 0.09 and 0.11, respectively, and both size emulsions contain grains in which AgBr 0.6 mol % is partially located on the surface thereof) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| Sixth layer: a UV absorbing layer | |
| Gelatin | 0.53 |
| UV absorber (UV-1) | 0.16 |
| Color mixing prevention agent (Cpd-5) | 0.02 |
| Solvent (Solv-5) | 0.08 |
| Seventh layer: a protective layer | |
| Gelatin | 1.33 |
| Acryl-modified copolymer of polyvinyl alcohol (a modification degree: 17%) | 0.17 |
| Liquid paraffin | 0.03 |

Yellow coupler (ExY)

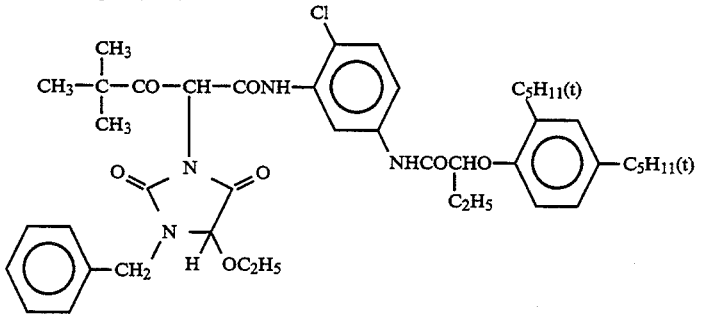

Magenta coupler (ExM)

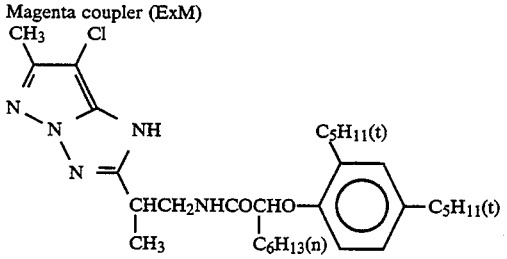

Cyan coupler (ExC)
A 1:1 mixture (mole ratio) of:

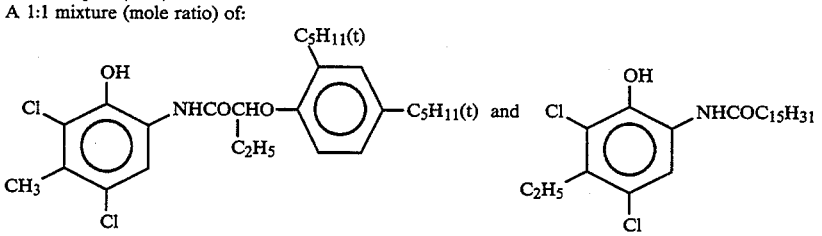

Dye image stabilizer (Cpd-1)

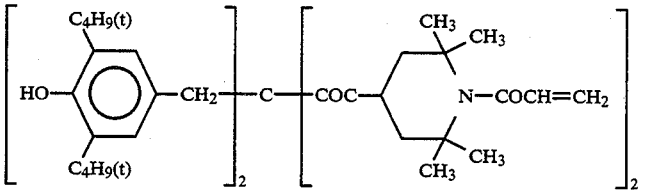

Dye image stabilizer (Cpd-2)

-continued
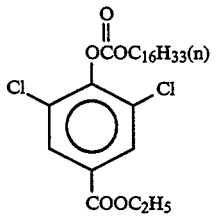
Dye image stabilizer (Cpd-3)
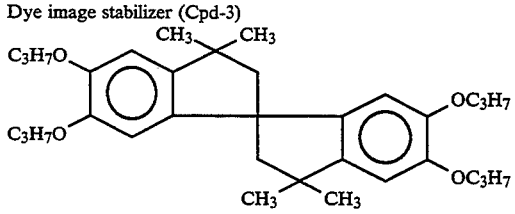
Dye image stabilizer (Cpd-4)
A 1:1 mixture (mole ratio) of:
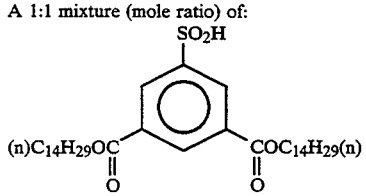
and
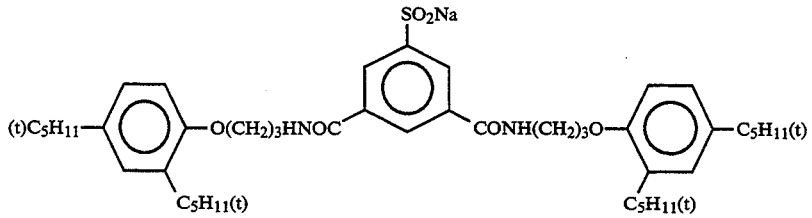
Dye image stabilizer (Cpd-5)
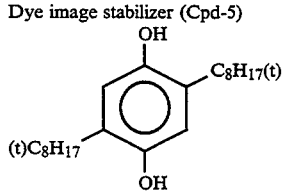
Dye image stabilizer (Cpd-6)
A 2:4:5 mixture (weight ratio) of:
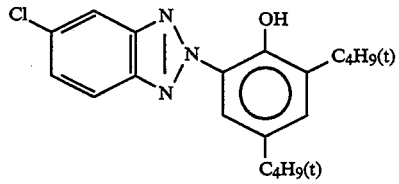
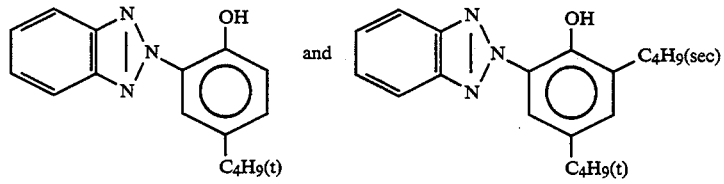
Dye image stabilizer (Cpd-7)
$\text{-}(CH_2\text{-}CH)_n\text{-}$ (Average molecular weight: 60,000)
$\quad\quad | \quad$
$\quad\quad CONHC_4H_9(t)$ -continued
Dye image stabilizer (Cpd-8)
A 1:1 mixture (mole ratio) of:
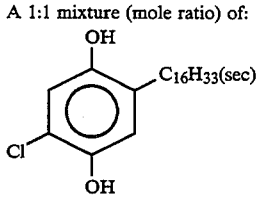
and
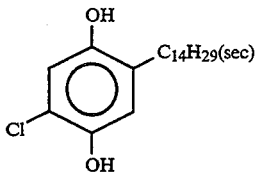
Dye image stabilizer (Cpd-9)
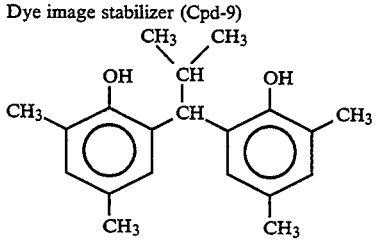
Preservative (Cpd-10)
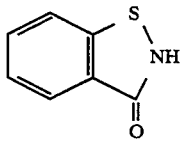
Preservative (Cpd-11)
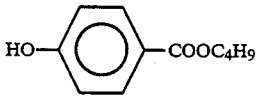
Stabilizer (Cpd-12)
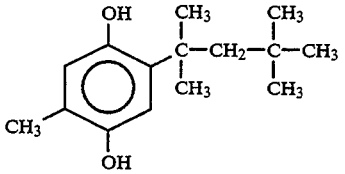
UV absorber (UV-1)
A 4:2:4: mixture (weight ratio) of:
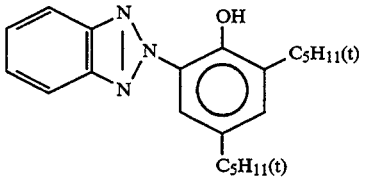
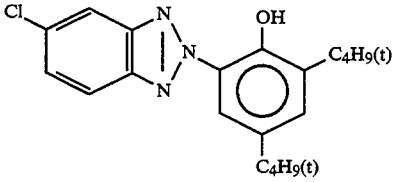
and
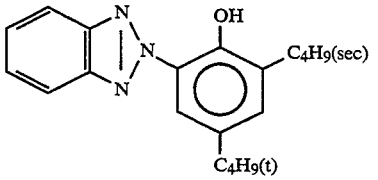
(H-1)
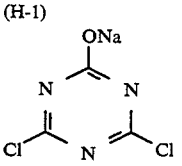
(H-2)

-continued $CH_2{=}CH{-}SO_2{-}CH_2{-}CONH{-}CH_2$
$CH_2{=}CH{-}SO_2{-}CH_2{-}CONH{-}CH_2$ Solvent (Solv-1)

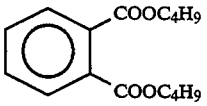

Solvent (Solv-2)
A 1:1 mixture (mole ratio) of:

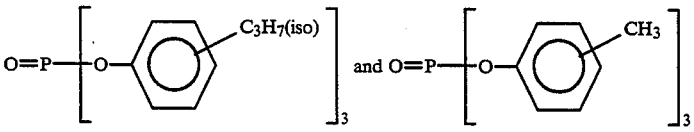

Solvent (Solv-3)
$O{=}P{+}O{-}C_9H_{19}(iso)]_3$

Solvent (Solv-4)

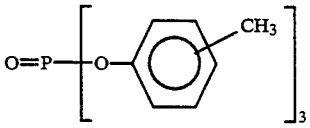

Solvent (Solv-5)
$COOC_8H_{17}$
$(CH_2)_8$
$COOC_8H_{17}$

Solvent (Solv-6)
A 80:20 mixture (volume ratio) of:

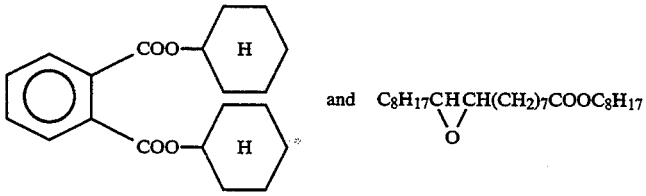

Solvent (Solv-7)
$C_8H_{17}CHCH(CH_2)_7COOC_8H_{17}$
O

Next, light-sensitive material Samples 102 to 123 were prepared in the same manner as Sample 101, except that the yellow coupler (ExY) contained in the first layer/blue-sensitive layer and the cyan coupler contained in the fifth layer/red-sensitive layer were replaced with equimolar amounts of yellow coupler and cyan coupler as shown in Table A, respectively.

The respective samples thus obtained were subjected to a gradational exposure via a three colors separation filter with a sensitometer (FWH type, a color temperature of a light source: 3200° K., manufactured by Fuji Photo Film Co., Ltd.), wherein the exposure was given so that an exposure became 250 CMS at an exposing time of 0.1 second. The exposed samples were subjected to continuous processing by the following steps with a paper processing machine until the total amount of the replenishing solution became two times as much as the tank capacity of the color developing solution.

| Processing step | Temperature | Time | Replenishing solution* | Tank capacity |
|---|---|---|---|---|
| Color developing | 35° C. | 45 seconds | 161 ml | 17 l |
| Bleach/fixing | 35° C. | 45 seconds | 215 ml | 17 l |
| Rinsing (1) | 35° C. | 20 seconds | — | 10 l |
| Rinsing (2) | 35° C. | 20 seconds | — | 10 l |
| Rinsing (3) | 35° C. | 20 seconds | 360 ml | 10 l |
| Drying | 80° C. | 60 seconds | | |

*Replenishing amount is per meter of the light-sensitive material.

The rinsing step is a 3 tank countercurrent system from Rinsing (3) to (1).

The compositions of the respective processing solutions are as follows:

| Color developing solution | Tank Solution | Replenishing solution |
|---|---|---|
| Water | 700 ml | 700 ml |
| Ethylenediaminetetracetic acid | 3.0 g | 3.0 g |
| Disodium 1,2-dihydroxybenzene-4,6-disulfonate | 0.5 g | 0.5 g |
| Potassium bromide | 0.01 g | — |
| Sodium chloride | 1.6 g | — |
| Potassium carbonate | 27.0 g | 27.0 g |
| N-ethyl-N-(β-methanesulfonamideethyl)-3-methyl-4-aminoaniline sulfate | 5.0 g | 7.1 g |
| Disodium N,N-di(sulfoethyl) hydroxylamine | 8.0 g | 10.0 g |
| Sodium sulfite | 0.1 g | 0.2 g |
| Fluorescent whitening agent (Whitex 4B manufactured by Sumitomo Chem. Ind.) | 1.0 g | 2.5 g |
| water was added to | 1000 ml | 1000 ml |
| pH (25° C.) | 10.05 | 10.45 |

| Bleach/fixing solution (the tank solution and replenishing solution are the same) | |
|---|---|
| Water | 600 ml |
| Ammonium thiosulfate (700 g/liter) | 100 ml |
| Iron (III) ammonium ethylenediaminetetracetate | 55 g |
| Disodium ethylenediaminetetracetate | 5 g |
| Ammonium bromide | 40 g |
| Nitric acid (67%) | 30 g |
| Water was added to | 1000 ml |
| pH (adjusted with acetic acid and aqueous ammonia at 25° C.) | 5.8 |

| Rinsing solution (the tank solution and replenishing solution are the same) |
|---|
| Deionized water (amount of calcium ions and magnesium ions: each 3 ppm or lower) |

The respective samples thus processed were subjected to a measurement of a reflection density with a TCD type sensitometer manufactured by Fuji Photo Film Co., Ltd. to obtain the maximum densities. Respective samples were subjected to exposure via a color negative film photographing cloths of various colors and then to processing in the same manner as above, and then were subjected to visual evaluation of color reproducibility (maximum density). In the evaluation, superiority or inferiority of the color reproducibility (hue and chroma) as compared with that of Sample 101 (Comparison) was judged.

TABLE A

| Sample No. | Yellow coupler | Cyan coupler | Maximum density Yellow | Magenta | Cyan | Color reproducibility Yellow | Cyan | Red | Green | Blue |
|---|---|---|---|---|---|---|---|---|---|---|
| 101 (Comp.) | ExY | ExC | 2.27 | 2.35 | 2.00 | Δ | Δ | Δ | Δ | Δ |
| 102 (Comp.) | ExY | C-16 | 2.27 | 2.34 | 2.35 | Δ | ○ | Δ | Δ | ○ |
| 103 (Comp.) | ExY | C-19 | 2.26 | 2.35 | 2.36 | Δ | ○ | Δ | Δ | ○ |
| 104 (Comp.) | ExY | C-1 | 2.28 | 2.35 | 2.35 | Δ | ○ | Δ | Δ | ○ |
| 105 (Comp.) | ExY | C-3 | 2.28 | 2.33 | 2.35 | Δ | ○ | Δ | Δ | ○ |
| 106 (Comp.) | ExY | C-4 | 2.29 | 2.34 | 2.36 | Δ | ○ | Δ | Δ | ○ |
| 107 (Comp.) | ExY | C-31 | 2.27 | 2.34 | 2.34 | Δ | ○ | Δ | Δ | ○ |
| 108 (Comp.) | Y-38 | ExC | 2.39 | 2.35 | 2.01 | Δ | ○ | ○ | Δ | Δ |
| 109 (Comp.) | Y-18 | ExC | 2.35 | 2.33 | 2.02 | Δ | ○ | ○ | Δ | Δ |
| 110 (Comp.) | y-3 | ExC | 2.32 | 2.33 | 2.02 | Δ | ○ | ○ | Δ | Δ |
| 111 (Comp.) | y-8 | ExC | 2.32 | 2.34 | 2.00 | ○ | Δ | ○ | Δ | Δ |
| 112 (Inv.) | Y-38 | C-16 | 2.38 | 2.34 | 2.37 | ○ | ○ | ○ | ○ | ○ |
| 113 (Inv.) | Y-38 | C-19 | 2.39 | 2.33 | 2.35 | ○ | ○ | ○ | ○ | ○ |
| 114 (Inv.) | Y-38 | C-1 | 2.39 | 2.33 | 2.36 | ○ | ○ | ○ | ○ | ○ |
| 115 (Inv.) | Y-28 | C-16 | 2.36 | 2.35 | 2.35 | ○ | ○ | ○ | ○ | ○ |
| 116 (Inv.) | Y-18 | C-19 | 2.37 | 2.34 | 2.36 | ○ | ○ | ○ | ○ | ○ |
| 117 (Inv.) | Y-18 | C-1 | 2.37 | 2.33 | 2.35 | ○ | ○ | ○ | ○ | ○ |
| 118 (Inv.) | Y-30 | C-16 | 2.35 | 2.34 | 2.37 | ○ | ○ | ○ | ○ | ○ |
| 119 (Inv.) | y-3 | C-16 | 2.33 | 2.34 | 2.36 | ○ | ○ | ○ | ○ | ○ |
| 120 (Inv.) | y-3 | C-31 | 2.34 | 2.36 | 2.37 | ○ | ○ | ○ | ○ | ○ |
| 121 (Inv..) | y-4 | C-4 | 2.33 | 2.33 | 2.36 | ○ | ○ | ○ | ○ | ○ |
| 122 (Inv.) | y-4 | C-31 | 2.31 | 2.35 | 2.34 | ○ | ○ | ○ | ○ | ○ |
| 123 (Inv.) | y-8 | C-16 | 2.33 | 2.36 | 2.37 | ○ | ○ | ○ | ○ | ○ |

Color reproducibility: Δ: same as Sample 101, ○: more excellent than Sample

As apparent from the results summarized in Table A, the samples of the invention has an excellent color reproducibility in every hue and a good color developability.

EXAMPLE 2

The respective layers having the following compositions were simultaneously coated on a cellulose triacetate film support provided with a subbing layer, whereby a multilayer color light-sensitive material Sample 201 was prepared.

Compositions of the light-sensitive layers

The substances used for the respective samples are classified as follows:

| | | | |
|---|---|---|---|
| ExC: | cyan coupler | UV: | UV absorber |
| ExM: | magenta coupler | HBS: | high boiling solvent |
| ExY: | yellow coupler | H: | gelatin hardener |
| ExS: | sensitizing dye | | |

The numerals corresponding to the respective components show the coated amounts expressed in term of $g/m^2$, except that the coated amounts of the sensitizing dyes are expressed in term of mole per mole of silver halide contained in the same layer.

Sample 101

| | |
|---|---|
| First layer (an anti-halation layer) | |
| Black colloidal silver | silver 0.18 |
| Gelatin | 1.40 |
| ExM-1 | 0.18 |
| ExF-1 | $2.0 \times 10^{-3}$ |
| Second layer (an intermediate layer) | |
| Emulsion G | silver 0.065 |

-continued

| | | |
|---|---|---|
| 2,5-Di-t-pentadecyl hydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| Third layer (a low red-sensitive layer) | | |
| Emulsion A | silver | 0.25 |
| Emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-4 | | 0.17 |
| ExC-7 | | 0.020 |
| UV-1 | | 0.070 |
| UV-2 | | 0.050 |
| UV-3 | | 0.070 |
| HBS-1 | | 0.060 |
| Gelatin | | 0.87 |
| Fourth layer (a medium red-sensitive layer) | | |
| Emulsion D | silver | 0.80 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.20 |
| ExC-2 | | 0.050 |
| ExC-4 | | 0.20 |
| ExC-5 | | 0.050 |
| ExC-7 | | 0.015 |
| UV-1 | | 0.070 |
| UV-2 | | 0.050 |
| UV-3 | | 0.070 |
| Gelatin | | 1.30 |
| Fifth layer (a high red-sensitive layer) | | |
| Emulsion E | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.097 |
| ExC-2 | | 0.010 |
| ExC-3 | | 0.065 |
| ExC-6 | | 0.020 |
| HBS-1 | | 0.22 |
| HBS-2 | | 0.10 |
| Gelatin | | 1.63 |
| Sixth layer (an intermediate layer) | | |
| Cpd-1 | | 0.040 |
| HBS-1 | | 0.20 |
| Gelatin | | 0.80 |
| Seventh layer (a low green-sensitive layer) | | |
| Emulsion C | silver | 0.30 |
| ExS-4 | | $2.6 \times 10^{-5}$ |
| ExS-5 | | $1.8 \times 10^{-4}$ |
| ExS-6 | | $6.9 \times 10^{-4}$ |
| ExM-1 | | 0.021 |
| ExM-2 | | 0.26 |
| ExM-3 | | 0.030 |
| ExY-1 | | 0.025 |
| HBS-1 | | 0.10 |
| HBS-3 | | 0.010 |
| Gelatin | | 0.63 |
| Eighth layer (a medium green-sensitive layer) | | |
| Emulsion D | silver | 0.55 |
| ExS-4 | | $2.2 \times 10^{-5}$ |

-continued

| | | |
|---|---|---|
| ExS-5 | | $1.5 \times 10^{-4}$ |
| ExS-6 | | $5.8 \times 10^{-4}$ |
| ExM-2 | | 0.094 |
| ExM-3 | | 0.026 |
| ExY-1 | | 0.018 |
| HBS-1 | | 0.16 |
| HBS-3 | | $8.0 \times 10^{-3}$ |
| Gelatin | | 0.50 |
| Ninth layer (a high green-sensitive layer) | | |
| Emulsion E | silver | 1.55 |
| ExS-4 | | $4.6 \times 10^{-5}$ |
| ExS-5 | | $1.0 \times 10^{-4}$ |
| ExS-6 | | $3.9 \times 10^{-4}$ |
| ExC-1 | | 0.015 |
| ExM-1 | | 0.013 |
| ExM-4 | | 0.065 |
| ExM-5 | | 0.019 |
| HBS-1 | | 0.25 |
| HBS-2 | | 0.10 |
| Gelatin | | 1.54 |
| Tenth layer (a yellow filter layer) | | |
| Yellow colloidal silver | silver | 0.035 |
| Cpd-1 | | 0.080 |
| HBS-1 | | 0.030 |
| Gelatin | | 0.95 |
| Eleventh layer (a low blue-sensitive layer) | | |
| Emulsion C | silver | 0.18 |
| ExS-7 | | $8.6 \times 10^{-4}$ |
| ExY-1 | | 0.042 |
| ExY-2 | | 0.72 |
| HBS-1 | | 0.28 |
| Gelatin | | 1.10 |
| Twelfth layer (a medium blue-sensitive layer) | | |
| Emulsion D | silver | 0.40 |
| ExS-7 | | $7.4 \times 10^{-4}$ |
| ExC-7 | | $7.0 \times 10^{-3}$ |
| ExY-2 | | 0.15 |
| HBS-1 | | 0.050 |
| Gelatin | | 0.78 |
| Thirteenth layer (a high blue-sensitive layer) | | |
| Emulsion F | silver | 0.70 |
| ExS-7 | | $2.8 \times 10^{-4}$ |
| ExY-2 | | 0.20 |
| HBS-1 | | 0.070 |
| Gelatin | | 0.69 |
| Fourteenth layer (the 1st protective layer) | | |
| Emulsion G | silver | 0.20 |
| UV-4 | | 0.11 |
| UV-5 | | 0.17 |
| HBS-1 | | $5.0 \times 10^{-2}$ |
| Gelatin | | 1.00 |
| Fifteenth layer (the 2nd protective layer) | | |
| H-1 | | 0.40 |
| B-1 (diameter: 1.7 μm) | | $5.0 \times 10^{-2}$ |
| B-2 (diameter: 1.7 μm) | | 0.10 |
| B-3 | | 0.10 |
| S-1 | | 0.20 |
| Gelatin | | 1.20 |

Further, W-1 to W-3, B-4 to B-6, F-1 to F-17, an iron salt, a lead salt, a gold salt, a platinum salt, an iridium salt, and a rhodium salt were suitably added to the respective layers in order to improve preservativity, processing performance, anti-pressure performance, anti-mold and fungicidal performances, anti-electrification performance, and coating performance.

TABLE 20

| Emulsion | Average AgI content (%) | Average grain size (μm) | Variation coefficient (%) | Diameter/ thickness ratio | Silver amount ratio [core/ middle/shell] (AgI content) | Grain structure/form |
|---|---|---|---|---|---|---|
| A | 4.0 | 0.45 | 27 | 1 | [1/3] (13/1) | Double structure octahedron grain |
| B | 8.9 | 0.70 | 14 | 1 | [3/7] (25/2) | Double structure octahedron grain |
| C | 2.0 | 0.55 | 25 | 7 | — | Uniform structure tabular grain |
| D | 9.0 | 0.65 | 25 | 6 | [12/59/29] (0/11/8) | Triple structure tabular grain |
| E | 9.0 | 0.85 | 23 | 5 | [8/59/33] (0/11/8) | Triple structure tabular grain |

TABLE 20-continued

| Emulsion | Average AgI content (%) | Average grain size (μm) | Variation coefficient (%) | Diameter/ thickness ratio | Silver amount ratio [core/ middle/shell] (AgI content) | Grain structure/form |
|---|---|---|---|---|---|---|
| F | 14.5 | 1.25 | 25 | 3 | [37/63] (34/3) | Double structure octahedron grain |
| G | 1.0 | 0.07 | 15 | 1 | — | Uniform structure tabular grain |

In Table 20, (1) Emulsions A to F were subjected to a reduction sensitization with thiourea dioxide and thiosulfonic acid in preparing the grains according to the examples of JP-A-2-191938, (2) Emulsions A to F were subjected to a gold sensitization, a sulfur sensitization and a selenium sensitization in the presence of the spectral sensitizing dyes described in the above respective light-sensitive layers and sodium thiocyanate according to the examples of JP-A-2-34090, (3) low molecular weight gelatin was used for preparing the tabular grains according to the examples of JP-A-1-158426, and (4) the tabular grains and the regular grains having a grain structure were observed with a high tension electron microscope as shown in JP-A-2-34090.

ExC-1

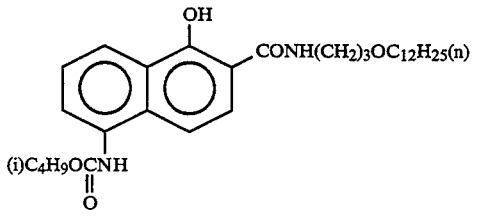

ExC-2

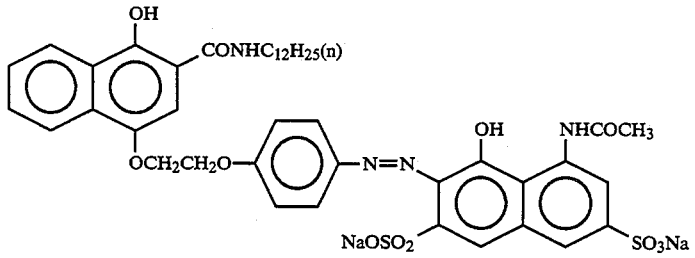

ExC-3

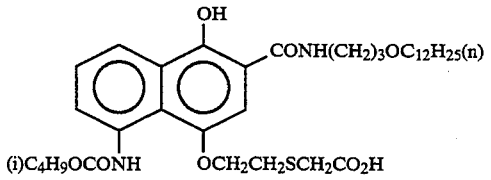

ExC-4

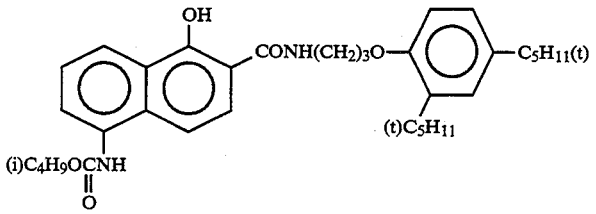

ExC-5

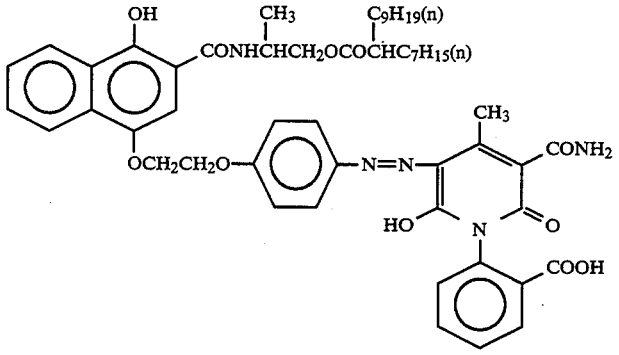

-continued
ExC-6
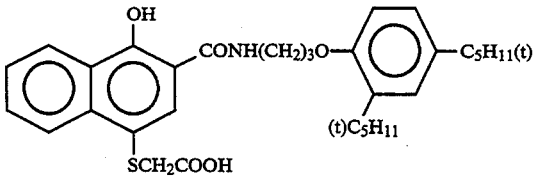
ExC-7
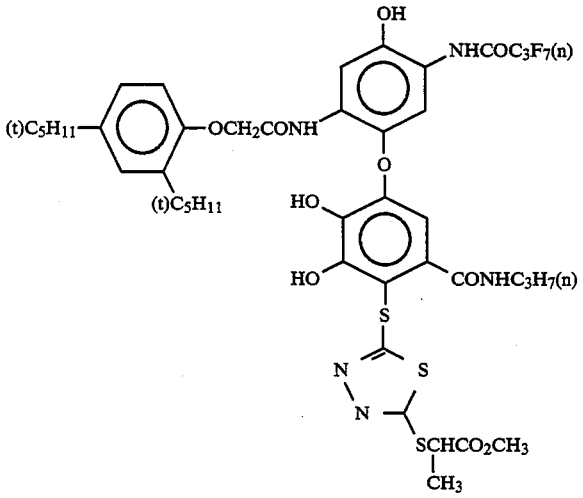
ExM-1
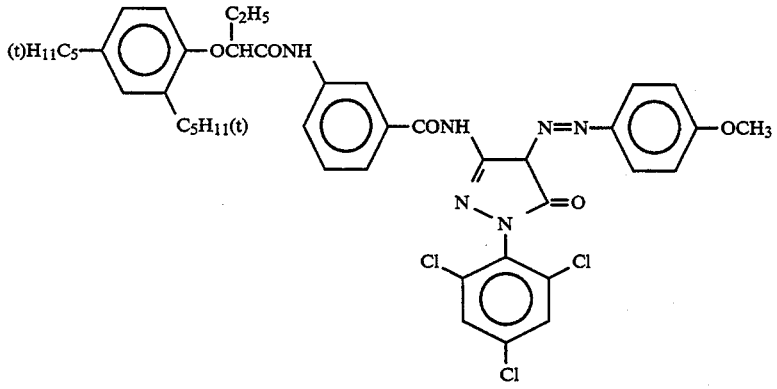
ExM-2
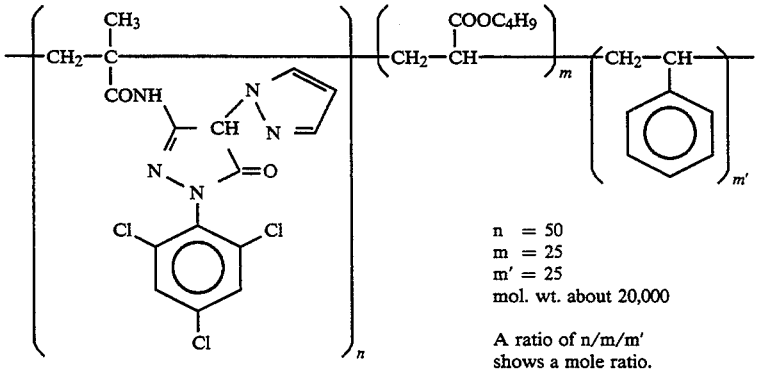
n = 50
m = 25
m' = 25
mol. wt. about 20,000
A ratio of n/m/m' shows a mole ratio.

-continued
ExM-3
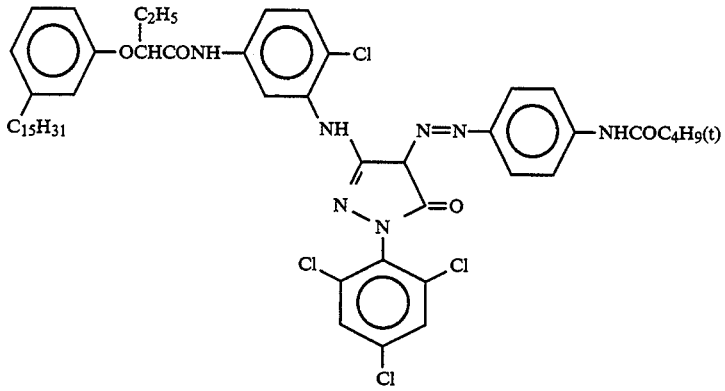
ExM-4
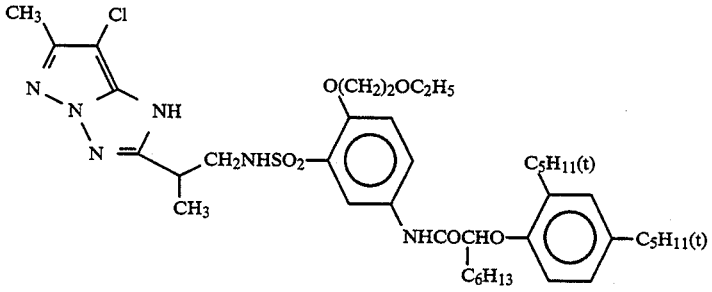
ExM-5
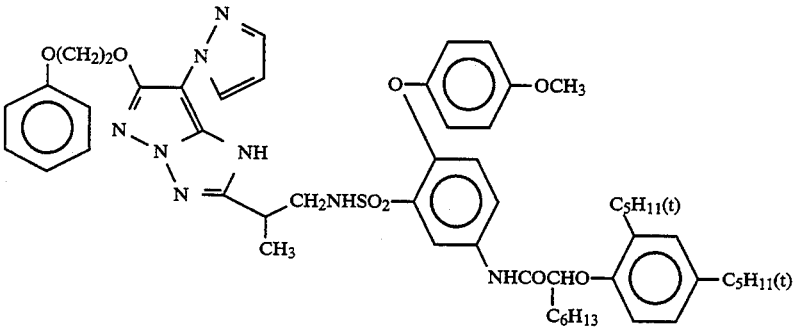
ExY-1
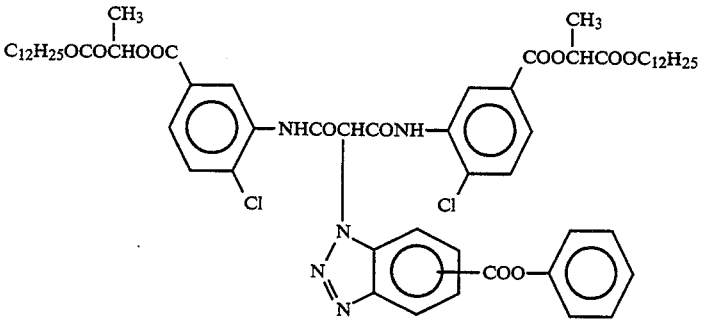
ExY-2
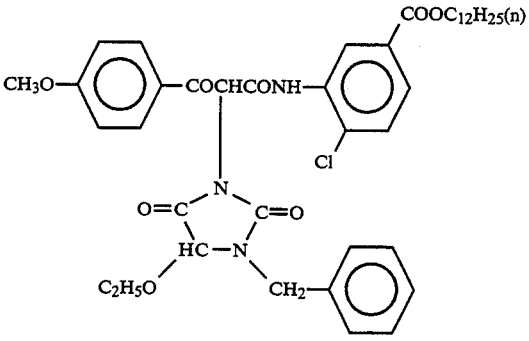

-continued
ExF-1
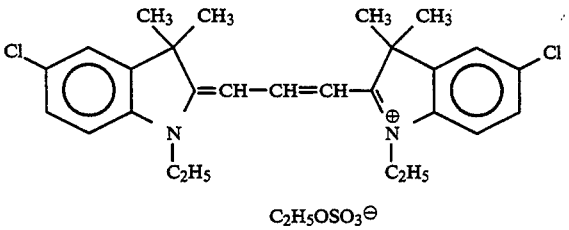
Cpd-1
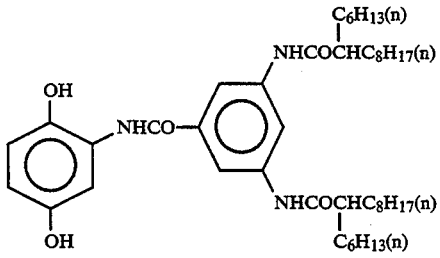
UV-1
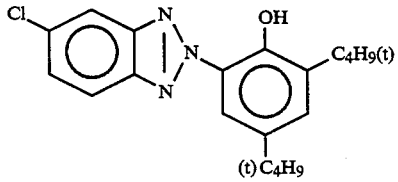
UV-2
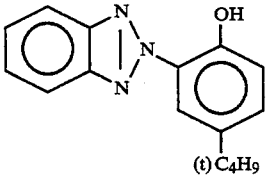
UV-3
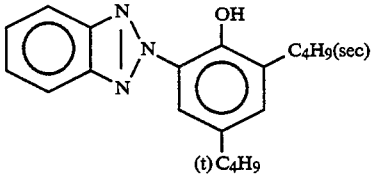
UV-4
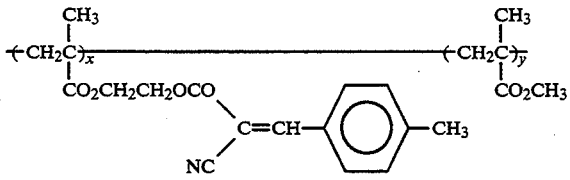
x : y = 70:30 (wt %)
UV-5
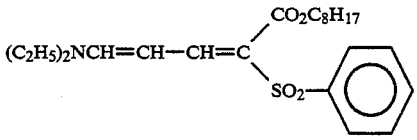
Tricresyl phosphate — HBS-1
Di-n-butyl phthalate — HBS-2
HBS-3
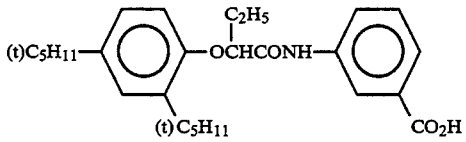

-continued
ExS-1
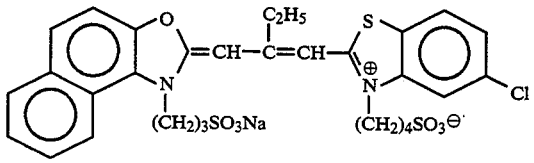
ExS-2
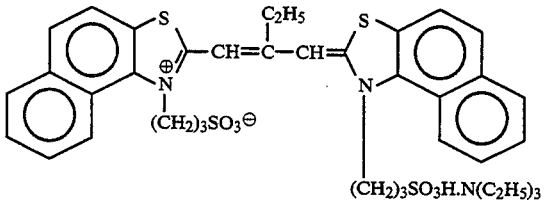
ExS-3
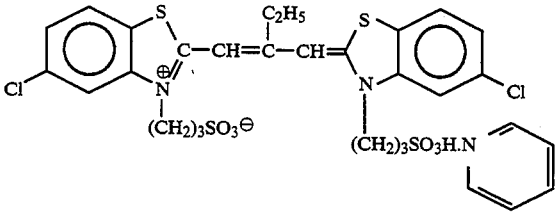
ExS-4
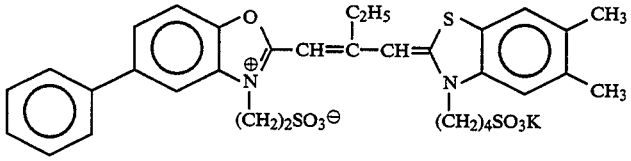
ExS-5
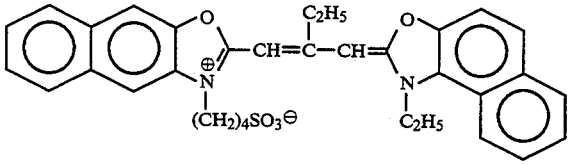
ExS-6
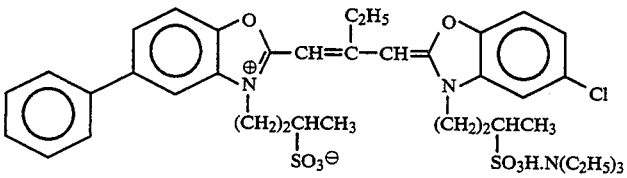
ExS-7
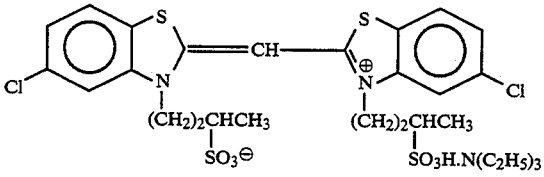
S-1
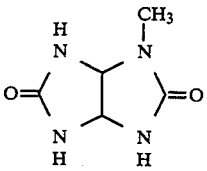
H-1
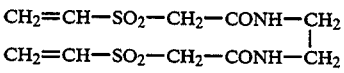

-continued
B-1
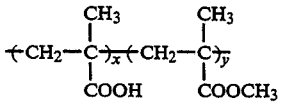
x/y = 10/90 (mole ratio)
B-2
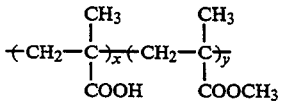
x/y = 40/60 (mole ratio)
B-3
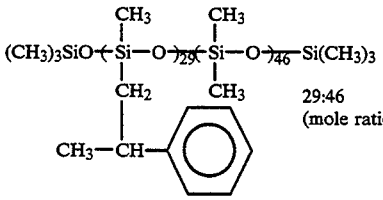
29:46 (mole ratio)
B-4
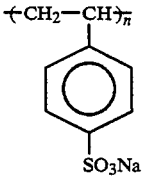
n = 100 mole %
B-5
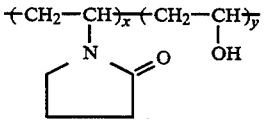
x/y = 70/30 (mole ratio)
B-6
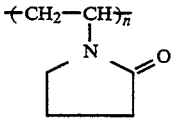
(mol. wt. 10,000)
W-1
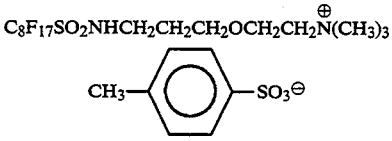
W-2
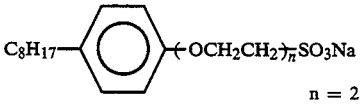
n = 2 ~ 4
W-3
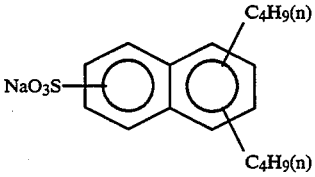
F-1
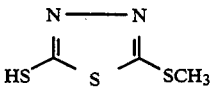

-continued
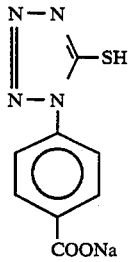
F-2
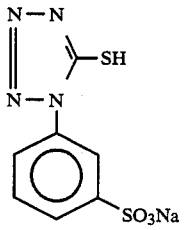
F-3
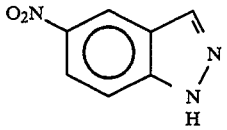
F-4
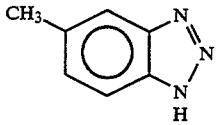
F-5
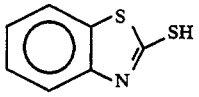
F-6
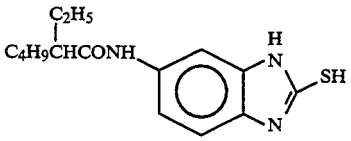
F-7
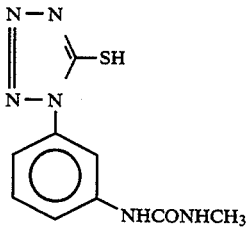
F-8
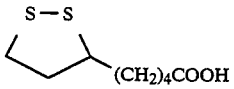
F-9
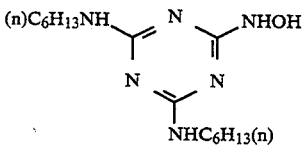
F-10

-continued

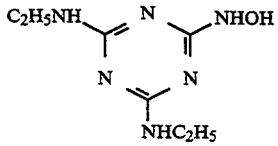

F-11

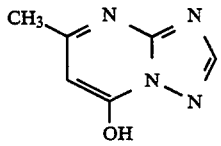

F-12

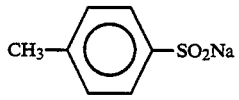

F-13

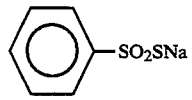

F-14

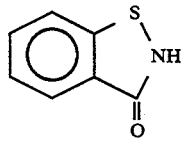

F-15

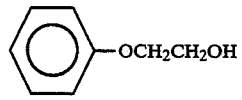

F-16

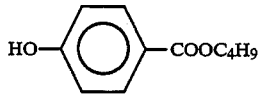

F-17

Next, there were prepared forty-eight samples in which cyan couplers (ExC-1 and ExC-4) contained in the third, fourth and fifth layers were replaced with equimolar amounts of couplers C-1, C-3, C-4, C-16, C-19, and C-31 according to the present invention and the yellow coupler (ExY-2) contained in the eleventh, twelfth and thirteenth layers was replaced with equimolar amounts of couplers Y-18, Y-28, Y-30, Y-38, y-3, y-4, and y-8, of the present invention, respectively. Further, there were also prepared six samples in which the cyan couplers were similarly replaced and yellow coupler (ExY-1) contained in the eleventh layer was replaced with an equimolar amount of yellow coupler y-50 of the present invention.

These samples were subjected to an imagewise exposure and then to the following processings:

| Step | Processing steps Time | Temperature |
|---|---|---|
| Color developing | 3 minutes & 15 seconds | 38.0° C. |
| Bleaching | 3 minutes | 38.0° C. |
| Water washing | 30 seconds | 24.0° C. |
| Fixing | 3 minutes | 38.0° C. |
| Water washing (1) | 30 seconds | 24.0° C. |
| Water washing (2) | 30 seconds | 24.0° C. |
| Stabilizing | 30 seconds | 38.0° C. |
| Drying | 4 minutes & 20 seconds | 55° C. |

-continued

| Step | Processing steps Time | Temperature |
|---|---|---|

The compositions of the processing solutions are shown below:

| | |
|---|---|
| Color developing solution | |
| Diethylenetriaminepentacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-ethyl-N-β-hydroxyethylamino)-2-methylaniline sulfate | 4.5 g |
| Water was added to make the total quantity | 1000 ml |
| pH | 10.05 |
| Bleaching solution | |
| Ferric sodium ethylenediamine-tetracetate trihydrate | 100.0 g |
| Disodium ethylenediaminetetracetate | 10.0 g |
| 3-Mercapto-1,2,4-triazole | 0.08 g |
| Ammonium bromide | 140.0 g |
| Ammonium nitrate | 30.0 g |
| Ammonia water | 6.5 ml |

-continued

| | |
|---|---|
| Water was added to make the total quantity | 1000 ml |
| pH | 6.0 |
| Fixing solution | |
| Ferric ammonium ethylenediamine-tetracetate | 0.5 g |
| Ammonium sulfite | 20.0 g |
| Ammonium thiosulfate aqueous solution (700 g/liter)) | 290.0 ml |
| Water was added to make the total quantity | 1000 ml |
| pH | 6.7 |
| Stabilizing solution | |
| Sodium p-toluenesulfinate | 0.03 g |
| Polyoxyethylene-p-monophenyl ether (average polymerization degree: 10) | 0.2 g |
| Disodium ethylenediaminetetracetate | 0.05 g |
| 1,2,4-Triazole | 1.3 g |
| 1,4-Bis-1,2,4-triazole-1-yl-methyl) piperadine | 0.75 g |
| Water was added to make the total quantity | 1000 ml |
| pH | 8.5 |

The processed samples were evaluated for color reproducibility and color developability (maximum density) in the same manners as Example 1, and it was confirmed that the samples of the invention were excellent compared with the samples of comparison.

EXAMPLE 3

The respective layers having the following compositions were coated on a cellulose triacetate film support with a thickness of 205μ provided on both sides thereof with a subbing layer, whereby a multilayer color light-sensitive material was prepared, which was designated as Sample 301.

The coated amounts of the respective components are expressed in terms of the amounts per $m^2$ of the samples. The coated amounts of silver halide and colloidal silver are expressed in terms of the weight amounts converted to equivalent silver.

| | |
|---|---|
| First layer: an anti-halation layer: | |
| Black colloidal silver | 0.25 g |
| Gelatin | 1.9 g |
| UV absorber U-1 | 0.04 g |
| UV absorber U-2 | 0.1 g |
| UV absorber U-3 | 0.1 g |
| UV absorber U-4 | 0.1 g |
| UV absorber U-6 | 0.1 g |
| Additive P-1 | 0.2 g |
| High boiling organic solvent Oil-1 | 0.1 g |
| Second layer: an intermediate layer: | |
| Gelatin | 0.40 g |
| Compound Cpd-D | 10 mg |
| Dye D-4 | 0.4 mg |
| Dye D-6 | 0.1 g |
| High boiling organic solvent Oil-3 | 40 mg |
| Third layer: an intermediate layer: | |
| Non-light-sensitive silver bromoiodide fine grains emulsion (an average grain size: 0.01 μm, an AgI content: 1 mole %) | 0.15 g silver amount |
| Silver bromoiodide fine grains emulsion whose surface and inside were fogged (an average grain size: 0.06 μm, a fluctuation coefficient: 18%, an AgI content: 1 mole %) | 0.05 g silver amount |
| Additive M-1 | 0.05 g |
| Gelatin | 0.4 g |
| Fourth layer: a low red-sensitive layer: | |
| Emulsion A | silver amount 0.2 g |
| Emulsion B | silver amount 0.3 g |

-continued

| | |
|---|---|
| Gelatin | 0.8 g |
| Coupler ExC-8 | 0.15 g |
| Coupler ExC-10 | 0.05 g |
| Coupler ExC-16 | 0.05 g |
| Coupler ExC-17 | 0.10 g |
| Compound Cpd-D | 10 mg |
| Compound Cpd-K | 0.05 g |
| Additive F-2 | 0.1 mg |
| Additive F-12 | 0.5 mg |
| Additive F-14 | 1.0 mg |
| High boiling organic solvent Oil-2 | 0.10 g |
| Fifth layer: a medium red-sensitive layer: | |
| Emulsion B | silver amount 0.2 g |
| Emulsion C | silver amount 0.3 g |
| Gelatin | 0.8 g |
| Coupler ExC-8 | 0.2 g |
| Coupler ExC-9 | 0.05 g |
| Coupler ExC-10 | 0.2 g |
| Additive F-2 | 0.1 mg |
| Additive F-13 | 0.05 mg |
| High boiling organic solvent Oil-2 | 0.1 g |
| Sixth layer: a high red-sensitive layer: | |
| Emulsion D | silver amount 0.4 g |
| Gelatin | 1.1 g |
| Coupler ExC-8 | 0.3 g |
| Coupler ExC-10 | 0.7 g |
| Additive P-1 | 0.1 g |
| Additive F-2 | 0.1 mg |
| Seventh layer: an intermediate layer | |
| Gelatin | 0.6 g |
| Anti-color mixing agent Cpd-K | 0.05 g |
| Anti-color mixing agent Cpd-L | 0.05 g |
| Additive F-2 | 1.5 mg |
| Additive F-7 | 2.0 mg |
| Additive Cpd-N | 0.02 g |
| Additive M-1 | 0.3 g |
| UV absorber U-1 | 0.1 g |
| UV absorber U-6 | 0.1 g |
| Dye D-1 | 0.02 g |
| Dye D-6 | 0.05 g |
| Eighth layer: an intermediate layer: | |
| Silver bromoiodide fine grains emulsion whose surface and inside were fogged (an average grain size: 0.06 μm, a fluctuation coefficient: 16%, an AgI content: 0.3 mole %) | 0.02 g silver amount |
| Gelatin | 1.0 g |
| Additive P-1 | 0.2 g |
| Anti-color mixing agent Cpd-A | 0.1 g |
| Anti-color mixing agent Cpd-J | 0.1 g |
| Anti-color mixing agent Cpd-M | 0.05 g |
| Ninth layer: a low green-sensitive layer: | |
| Silver bromoiodide fine grains emulsion whose surface was fogged (an average grain size: 0.1 μm, an AgI content: 0.1 mole %) | 0.05 g silver amount |
| Emulsion E | silver amount 0.3 g |
| Emulsion F | silver amount 0.1 g |
| Emulsion G | silver amount 0.1 g |
| Gelatin | 0.5 g |
| Coupler ExC-11 | 0.20 g |
| Coupler ExC-14 | 0.10 g |
| Coupler ExC-15 | 0.10 g |
| Coupler ExC-18 | 0.10 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| Additive F-3 | 0.02 mg |
| Additive F-5 | 0.1 mg |
| Additive F-11 | 0.5 mg |
| High boiling organic solvent Oil-2 | 0.2 g |
| Tenth layer: a medium green-sensitive layer: | |
| Emulsion G | silver amount 0.3 g |
| Emulsion H | silver amount 0.1 g |
| Gelatin | 0.6 g |
| Coupler ExC-11 | 0.1 g |
| Coupler ExC-14 | 0.1 g |
| Coupler ExC-15 | 0.1 g |

-continued

| | |
|---|---|
| Coupler ExC-18 | 0.05 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| Additive F-5 | 0.08 mg |
| High boiling organic solvent Oil-2 | 0.01 g |
| Eleventh layer: a high green-sensitive layer: | |
| Emulsion I | silver amount 0.5 g |
| Gelatin | 1.1 g |
| Coupler ExC-11 | 0.4 g |
| Coupler ExC-14 | 0.2 g |
| Coupler ExC-15 | 0.2 g |
| Coupler ExC-16 | 0.05 g |
| Coupler ExC-19 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| Additive F-2 | 0.3 mg |
| Additive F-13 | 0.05 mg |
| High boiling organic solvent Oil-2 | 0.04 g |
| Twelfth layer: an intermediate layer: | |
| Gelatin | 0.8 g |
| Additive F-1 | 2.0 mg |
| Additive F-8 | 2.0 mg |
| Dye D-1 | 0.1 g |
| Dye D-2 | 0.05 g |
| Dye D-3 | 0.07 g |
| Dye D-8 | 0.03 g |
| Thirteenth layer: a yellow filter layer: | |
| Yellow colloidal silver | silver amount 0.1 g |
| Gelatin | 1.3 g |
| Dye D-5 | 0.05 g |
| Dye D-7 | 0.03 g |
| Anti-color mixing agent Cpd-A | 0.01 g |
| Additive F-4 | 0.3 mg |
| Additive F-2 | 0.01 g |
| High boiling organic solvent Oil-1 | 0.01 g |
| Fourteenth layer: an intermediate layer: | |
| Gelatin | 0.6 g |
| Dye D-9 | 0.02 g |
| Fifteenth layer: a low blue-sensitive layer: | |
| Emulsion J | silver amount 0.4 g |
| Emulsion K | silver amount 0.1 g |
| Emulsion L | silver amount 0.1 g |
| Gelatin | 0.9 g |
| Coupler ExC-12 | 0.7 g |
| Additive F-2 | 0.2 mg |
| Additive F-5 | 0.4 mg |
| Additive F-8 | 0.05 mg |
| Sixteenth layer: a medium blue-sensitive layer: | |
| Emulsion L | silver amount 0.2 g |
| Emulsion M | silver amount 0.4 g |
| Gelatin | 1.2 g |
| Coupler ExC-12 | 0.35 g |
| Coupler ExC-13 | 0.35 g |
| Additive F-2 | 0.04 mg |
| Additive F-8 | 0.04 mg |
| Seventeenth layer: a high blue-sensitive layer: | |
| Emulsion N | silver amount 0.4 g |
| Gelatin | 1.4 g |
| Coupler ExC-13 | 0.5 g |
| Additive F-2 | 0.4 mg |
| Additive F-8 | 0.02 mg |
| Additive F-9 | 1.0 mg |
| Eighteenth layer: the first protective layer: | |
| Gelatin | 0.9 g |
| UV absorber U-1 | 0.04 g |
| UV absorber U-2 | 0.01 g |
| UV absorber U-3 | 0.03 g |
| UV absorber U-4 | 0.03 g |
| UV absorber U-5 | 0.05 g |
| UV absorber U-6 | 0.05 g |
| High boiling organic solvent Oil-1 | 0.02 g |
| Formalin scavenger | |
| Cpd-C | 0.2 g |
| Cpd-I | 0.4 g |

-continued

| | |
|---|---|
| Latex dispersion of ethyl acrylate | 0.05 g |
| Dye D-3 | 0.05 g |
| Additive Cpd-J | 0.02 g |
| Additive Cpd-N | 0.01 g |
| Additive F-1 | 1.0 mg |
| Additive F-6 | 1.0 mg |
| Additive F-7 | 0.5 mg |
| Additive M-2 | 0.05 g |
| Nineteenth layer: the second protective layer: | |
| Colloidal silver | silver amount 0.1 mg |
| Silver bromoiodide fine grains emulsion (an average grain size: 0.06 μm, AgI content: 1 mole %) | 0.1 g silver amount |
| Gelatin | 0.7 g |
| Twentieth layer: the third protective layer: | |
| Gelatin | 0.7 g |
| Polymethyl methacrylate (an average grain size: 1.5 μm) | 0.1 g |
| Copolymer of methyl methacrylate and acrylic acid (4:6) (an average grain size: 1.5 μm) | 0.1 g |
| Silicon oil | 0.03 g |
| Surface active agent W-1 | 3.0 mg |
| Surface active agent W-2 | 0.03 g |
| Twenty first layer: a back layer: | |
| Gelatin | 10 g |
| UV absorber U-1 | 0.05 g |
| UV absorber U-2 | 0.02 g |
| High boiling organic solvent Oil-1 | 0.01 g |
| Twenty second layer: a back protective layer: | |
| Gelatin | 5 g |
| Polymethyl methacrylate (an average grain size: 1.5 μm) | 0.03 g |
| Copolymer of methyl methacrylate and acrylic acid (4:6) (an average grain size: 1.5 μm) | 0.1 g |
| Surface active agent W-1 | 1.0 mg |
| Surface active agent W-2 | 10 g |

The additive F-1 was added to each of the emulsion layers.

Further, in addition to the above components, a gelatin hardener H-1, the surface active agents W-3 and W-4 for coating and the surface active agent W-5 for emulsifying were added to each of the layers.

Further, phenol, 1,2-benzisothiazline-3-one, 2-phenoxyethanol, phenyl isothiocyanate and phenethyl alcohol were added as a fungicide and an anti-mold agent.

TABLE 21

| | Emulsion | Average grain size (μm) | Variation coefficient (%) | AgI content (%) |
|---|---|---|---|---|
| A | Monodispersed tetra-decahedral grains | 0.35 | 16 | 4.5 |
| B | Monodispersed cubic, internal latent image type grains | 0.45 | 10 | 5.0 |
| C | Monodispersed tetra-decahedral grains | 0.60 | 18 | 4.0 |
| D | Polydispersed twinned grains | 1.10 | 25 | 3.0 |
| E | Monodispersed cubic grains | 0.30 | 17 | 4.0 |
| F | Monodispersed cubic grains | 0.40 | 16 | 4.0 |
| G | Monodisersed cubic, internal latent image type grains | 0.11 | 11 | 4.5 |
| H | Monodispersed tetra-decahedral grains | 0.65 | 9 | 3.5 |
| I | Polydispersed tabular grains (average aspect ratio: 5.3) | 1.20 | 28 | 3.0 |
| J | Monodispersed tabular grains (average aspect | 0.70 | 18 | 4.5 |

TABLE 21-continued

| Emulsion | | Average grain size (μm) | Variation coefficient (%) | AgI content (%) |
|---|---|---|---|---|
| | ratio: 3.8) | | | |
| K | Monodispersed tetra-decahedral grains | 0.60 | 17 | 6.0 |
| L | Monodispersed octahedral grains | 0.80 | 14 | 4.0 |
| M | Polydispersed tabular grains (average aspect ratio: 4.5) | 1.00 | 18 | 4.0 |
| N | Polydispersed twinned grains | 1.45 | 27 | 3.5 |

TABLE 22

| Emulsion | Spectral sensitization of Emulsions A to N: Sensitizing dye added | Added amount per mol of AgX (g) | Timing to add sensitizing dye |
|---|---|---|---|
| A | S-1 | 0.025 | IV |
| | S-2 | 0.25 | IV |
| | S-9 | 0.002 | IV |
| B | S-1 | 0.01 | II |
| | S-2 | 0.25 | II |
| C | S-1 | 0.02 | IV |
| | S-2 | 0.25 | IV |
| | S-9 | 0.002 | IV |
| D | S-1 | 0.01 | IV |
| | S-2 | 0.10 | IV |
| | S-7 | 0.01 | IV |
| E | S-3 | 0.5 | IV |
| | S-4 | 0.1 | IV |
| | S-10 | 0.05 | IV |

TABLE 22-continued

| Emulsion | Spectral sensitization of Emulsions A to N: Sensitizing dye added | Added amount per mol of AgX (g) | Timing to add sensitizing dye |
|---|---|---|---|
| F | S-3 | 0.3 | IV |
| | S-4 | 0.1 | IV |
| G | S-3 | 0.25 | II |
| | S-4 | 0.08 | II |
| H | S-3 | 0.2 | I |
| | S-4 | 0.06 | I |
| | S-10 | 0.1 | IV |
| I | S-3 | 0.3 | III |
| | S-4 | 0.07 | III |
| | S-8 | 0.1 | III |

TABLE 23

| Emulsion | Sensitizing dye added | Added amount per mol of AgX (g) | Timing to add sensitizing dye |
|---|---|---|---|
| J | S-5 | 0.2 | I |
| | S-6 | 0.05 | I |
| K | S-5 | 0.2 | I |
| | S-6 | 0.05 | I |
| L | S-5 | 0.22 | II |
| | S-6 | 0.06 | II |
| M | S-5 | 0.15 | IV |
| | S-6 | 0.04 | IV |
| N | S-5 | 0.22 | II |
| | S-6 | 0.06 | II |

I: during grain formation
II: immediately after finishing grain formation
III: immediately before starting chemical sensitization
IV: immediately after finishing chemical sensitization ExC-8

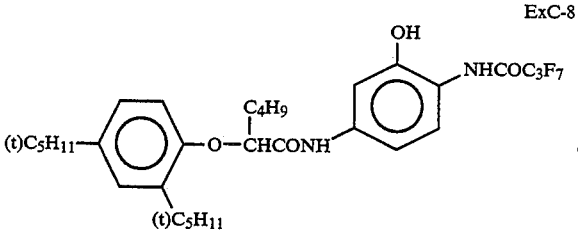

ExC-9

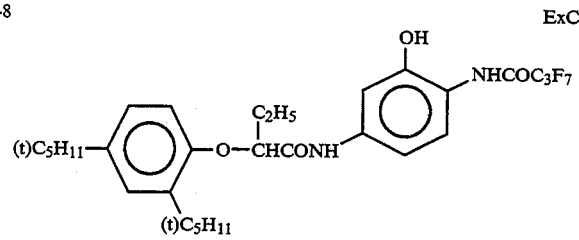

ExC-10

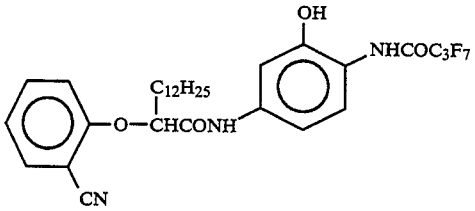

ExC-11

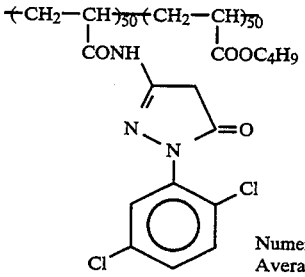

Numerals are % by weight
Average molecular weight: about 25,000

ExC-12

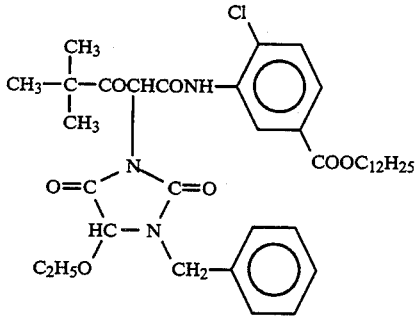

ExC-13

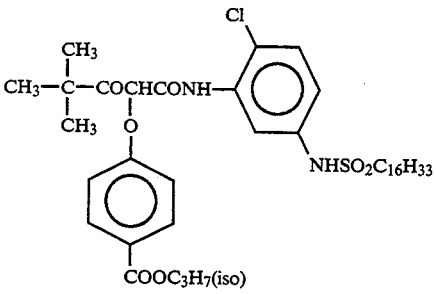

-continued
ExC 14
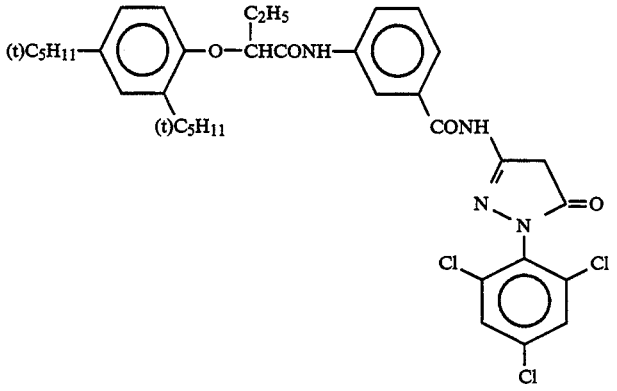
ExC-15
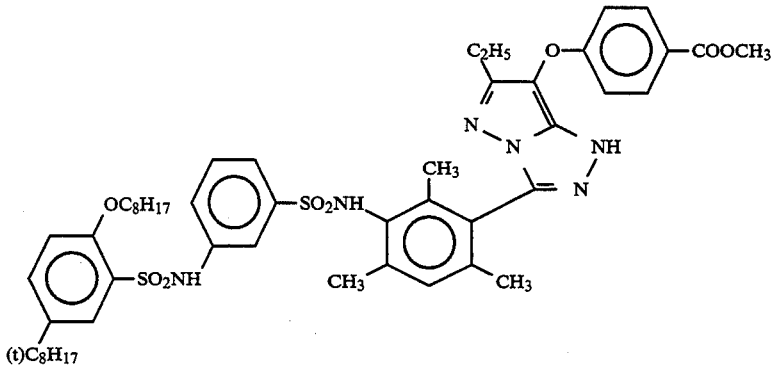
ExC-16
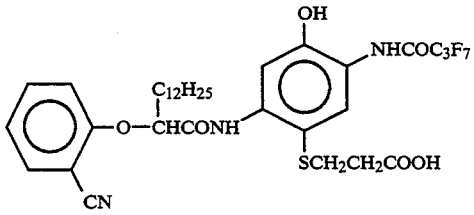
ExC-17
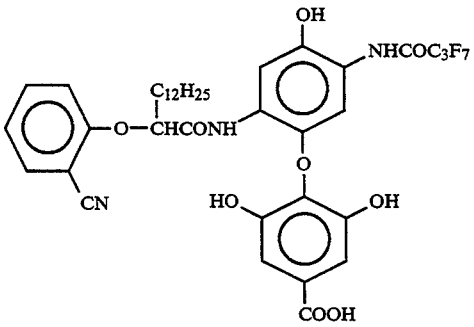
ExC-18
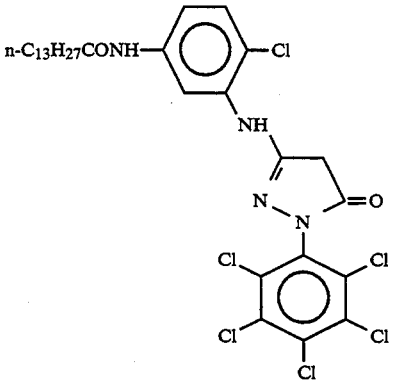

-continued
ExC-19
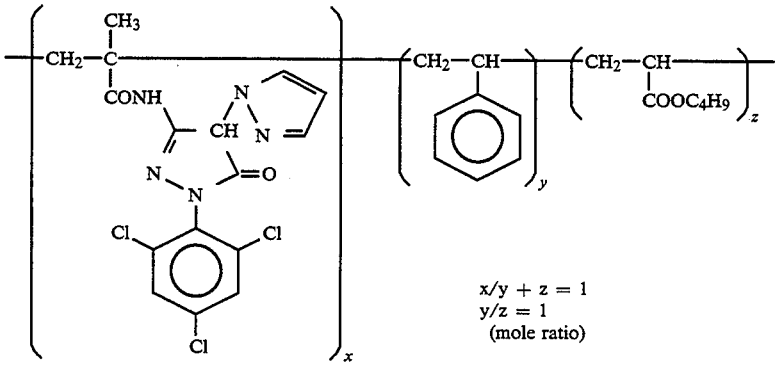
x/y + z = 1
y/z = 1
(mole ratio)
Dibutyl phthalate Oil-1
Tricresyl phosphate Oil-2
Oil-3
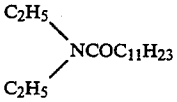
Cpd-A
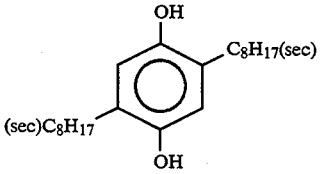
Cpd-B
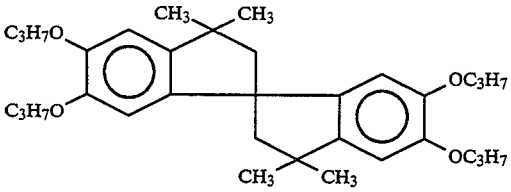
Cpd-C
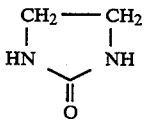
Cpd-D
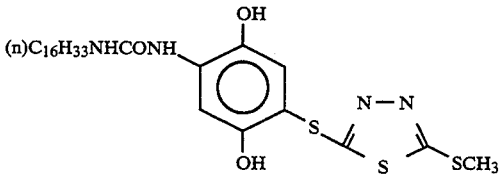
Cpd-E
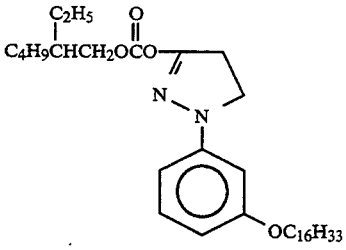
Cpd-F
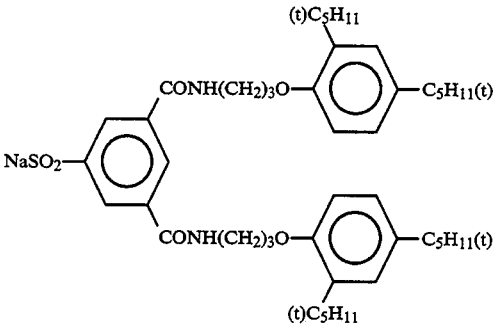
Cpd-G
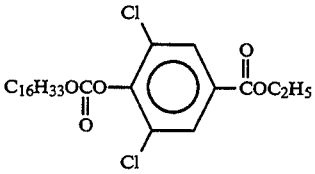
Cpd-H
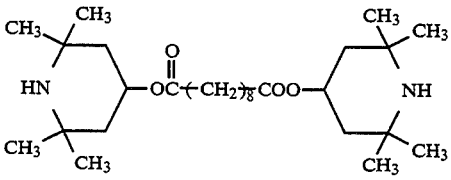
Cpd-I
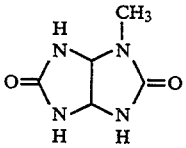

-continued
Cpd-J
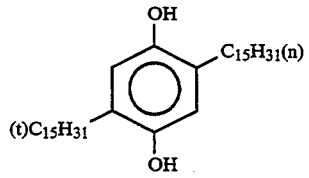
Cpd-K
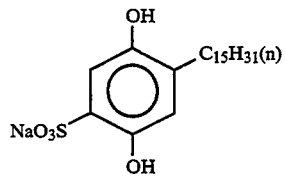
Cpd-L
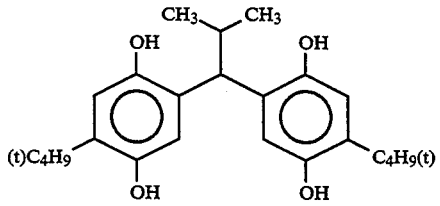
Cpd-M
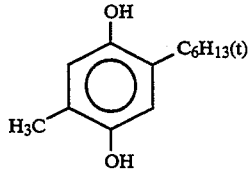
Cpd-N
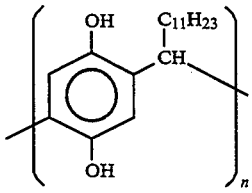
U-1
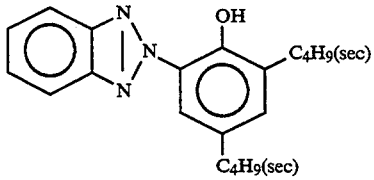
U-2
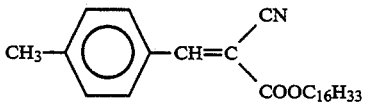
U-3
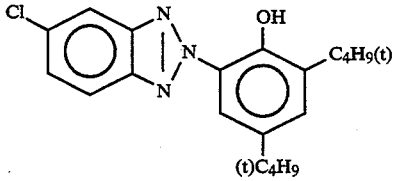
U-4
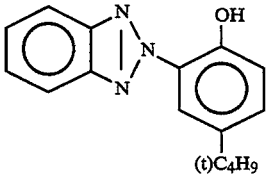
U-5
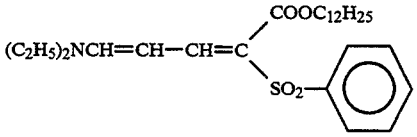
U-6
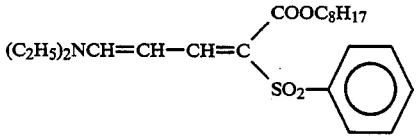
S-1
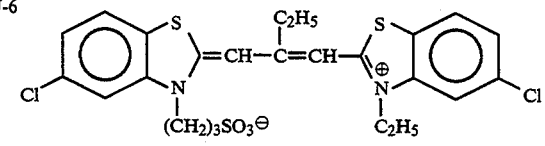
S-2
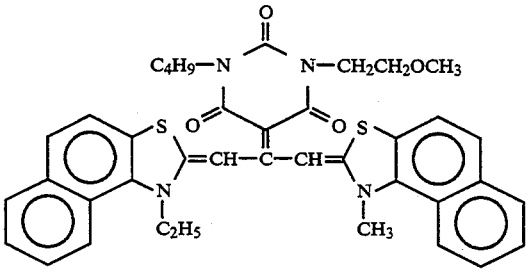
S-3
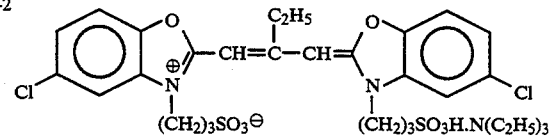
S-4
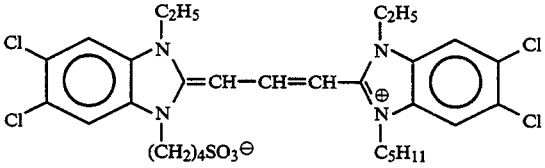
S-5
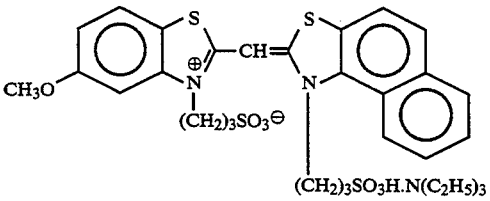

-continued
S-6
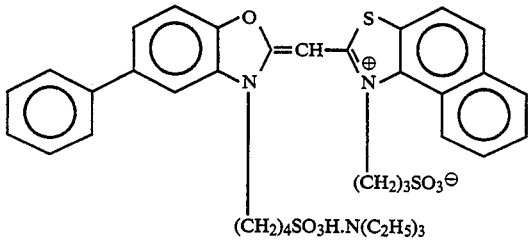
S-7
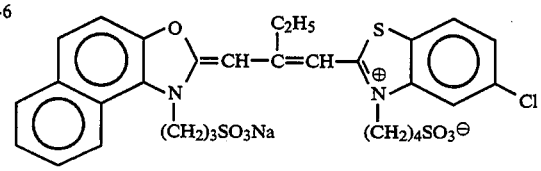
S-8
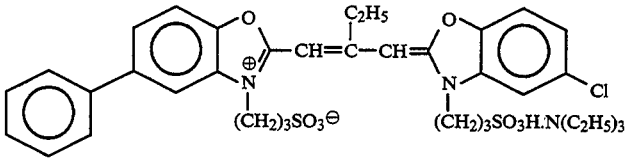
S-9
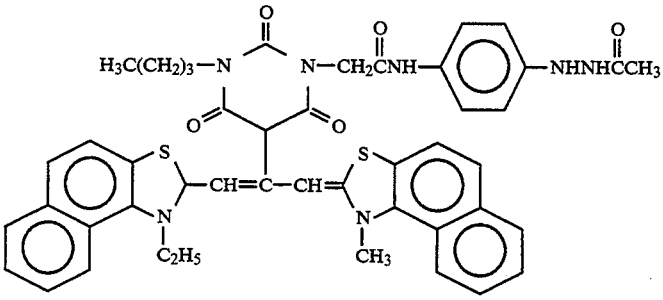
S-10
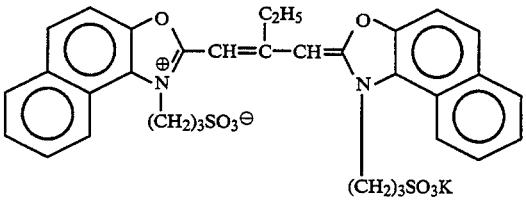
D-1
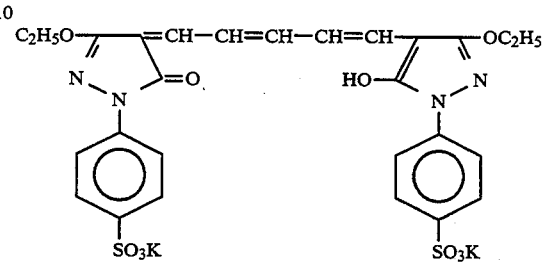
D-2
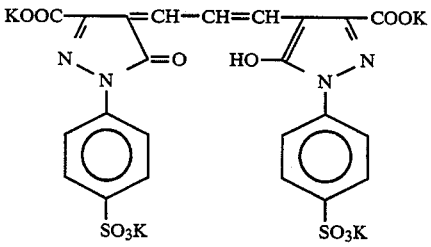
D-3
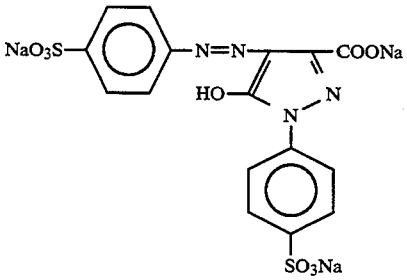
D-4
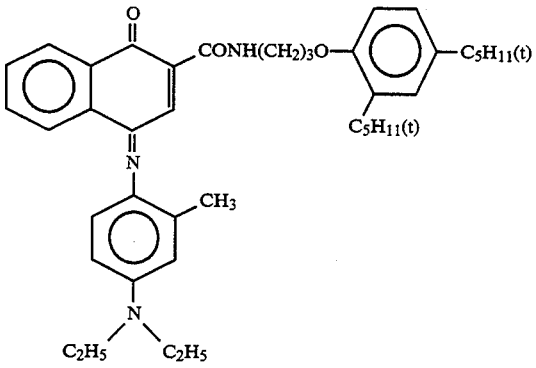
D-5
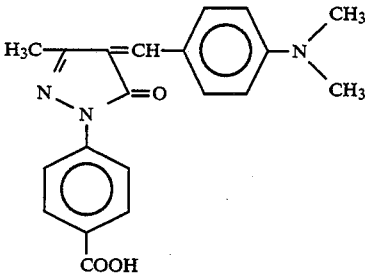

-continued
D-6
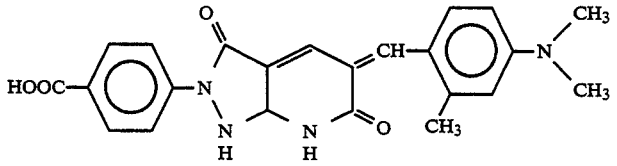
D-7
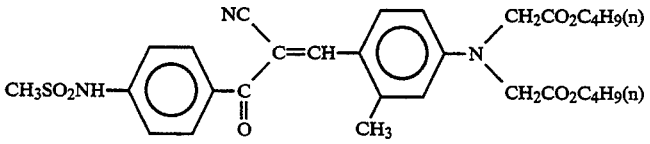
D-8
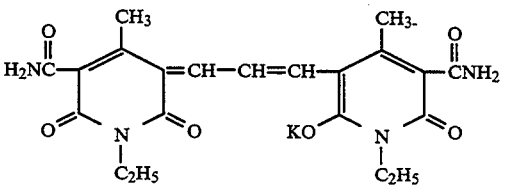
D-9
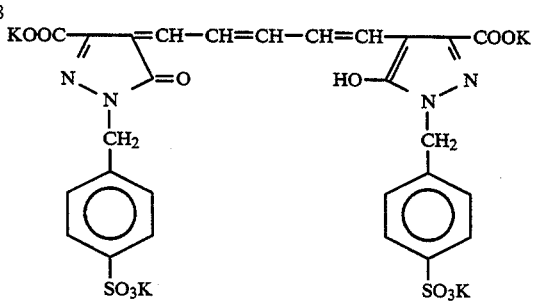
H-1
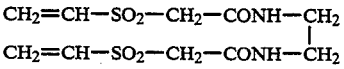
W-1
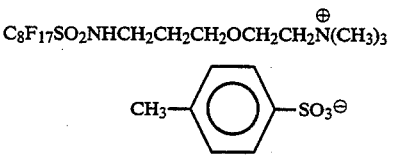
W-2
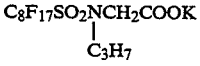
W-3
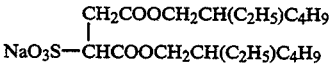
W-4
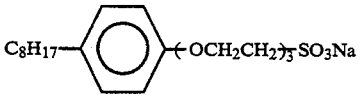
W-5
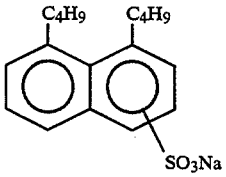
P-1
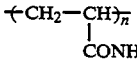
n = 100 mole %
M-1
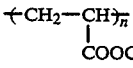
n = 100 mole %
M-2
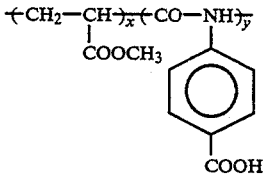
x/y = 1/1 (mole ratio)
F-1
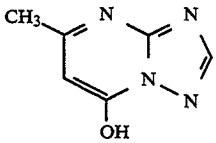
F-2
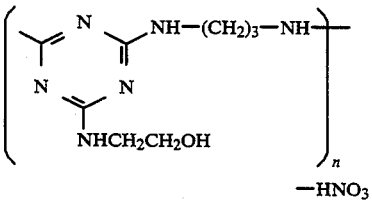
n = 100 mole %
F-3
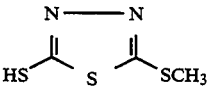

-continued

F-4

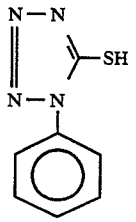

F-5

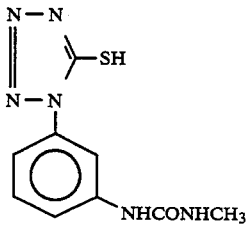

F-6

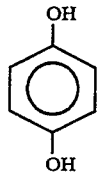

F-7

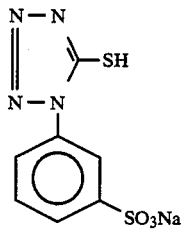

F-8

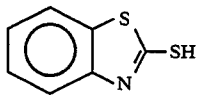

F-9

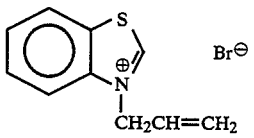

F-10

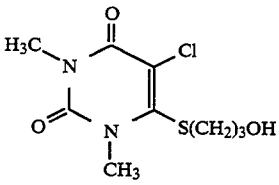

F-11

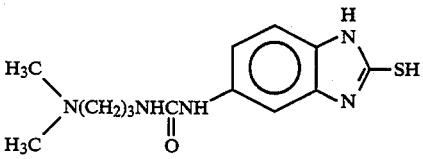

F-12

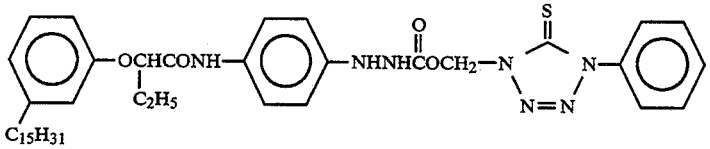

F-13

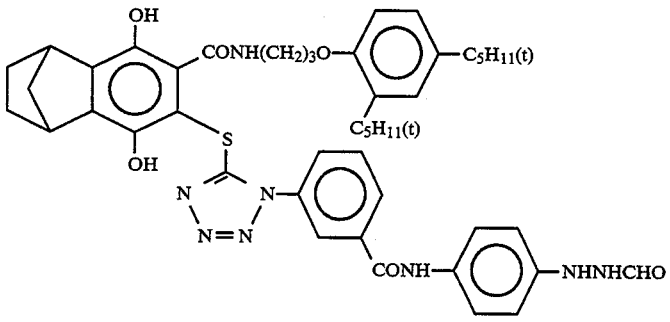

F-14

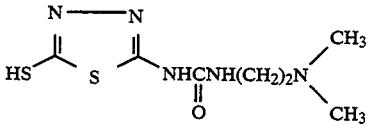

Next, there were prepared thirty samples in which the cyan couplers (ExC-8, ExC-9 and ExC-10) contained in the fourth, fifth and sixth layers were replaced with the equimolar amounts of couplers C-1, C-3, C-16, C-17, C-19, and C-39 of the present invention, and yellow couplers (ExC-12 and ExC-13) in the fifteenth, sixteenth and seventeenth layers were replaced with equimolar amounts of yellow couplers Y-18, Y-28, Y-38, Y-38, Y-3, and Y-8 of the present invention.

These samples were subjected to the following processings and then to the same evaluation as Example 1.

| Processing steps | | |
|---|---|---|
| Step | Time | Temperature |
| 1st developing | 6 minutes | 38° C. |
| Rinsing | 2 minutes | 38° C. |
| Reversal | 2 minutes | 38° C. |
| Color developing | 6 minutes | 38° C. |
| Controlling | 2 minutes | 38° C. |
| Bleaching | 6 minutes | 38° C. |
| Fixing | 4 minutes | 38° C. |
| Rinsing | 4 minutes | 38° C. |
| Stabilizing | 1 minutes | 25° C. |
| Drying | | |

The compositions of the respective processing solutions are shown below:

| | |
|---|---|
| First developing solution | |
| Pentasodium nitrilo-N,N,N-trimethylene phosphonate | 1.5 g |
| Pentasodium diethylenetriamine tetracetate | 2.0 g |
| Sodium sulfite | 30.0 g |
| Hydroquinone.potassium monosulfonate | 20.0 g |
| Sodium carbonate (monohydrate) | 15.0 g |
| Sodium bicarbonate | 12.0 g |
| 1-Phenyl-4-methyl-4-hydroxymethyl-3-pyrazolidone | 1.5 g |
| Potassium bromide | 2.5 g |
| Potassium thiocyanate | 1.2 g |
| Potassium iodide (0.1% solution) | 2.0 ml |
| Diethylene glycol | 13.0 g |
| Water was added to make the total quantity | 1000 ml |
| pH (adjusted with hydrochloric acid or potassium hydroxide) | 9.60 |
| Reversal solution | |
| Pentasodium nitrilo-N,N,N-trimethylene-phosphonate | 3.0 g |
| Stannous chloride (dihydrate) | 1.0 g |
| p-Aminophenol | 0.1 g |
| Sodium hydroxide | 8.0 g |
| Glacial acetic acid | 15 ml |
| Water was added to make the total quantity | 1000 ml |
| pH (adjusted with hydrochloric acid or potassium hydroxide) | 6.0 |
| Color developing solution | |
| Pentasodium nitrilo-N,N,N-trimethylene-phosphonate | 3.0 g |
| Sodium sulfite | 7.0 g |
| Trisodium phosphate 12 hydrate | 36.0 g |
| Potassium bromide | 7.0 g |
| Potassium iodide | 90 mg |
| Sodium hydroxide | 3.0 g |
| Citrazinic acid | 1.5 g |
| N-ethyl-(β-methanesulfonamidethyl)-3-methyl-4-aminoanline 3/2 sulfate monohydrate | 11.0 g |
| 3,6-Dithiaoctane-1,8-diol | 1.0 g |
| Water was added to make the total quantity | 1000 ml |
| pH (adjusted with hydrochloric acid or potassium hydroxide) | 11.80 |
| Controlling solution | |
| Sodium sulfite | 12.0 g |
| Sodium ethylenediamine tetracetate (dihydrate) | 8.0 g |
| 1-Thioglycol | 0.4 g |
| Formaldehyde sodium bisulfite adduct | 30.0 g |
| Water was added to make the total quantity | 1.000 ml |
| pH (adjusted with hydrochloric acid or potassium hydroxide) | 6.20 |
| Bleaching solution | |
| Sodium ethylenediamineteracetate (dihydrate) | 2.0 g |
| Iron (III) ammonium ethylenediamine-tetracetate (dihydrate) | 120 g |

-continued

| | |
|---|---|
| Potassium bromide | 100.0 g |
| Ammonium nitrate | 10.0 g |
| Water was added to make the total quantity | 1000 ml |
| pH (adjusted with hydrochloric acid or potassium hydroxide) | 5.70 |
| Fixing solution | |
| Ammonium thiosulfate | 80.0 g |
| Sodium sulfite | 5.0 g |
| Sodium bisulfite | 5.0 g |
| Water was added to make the total quantity | 1000 ml |
| pH | 6.60 |
| Stabilizing solution | |
| Benzoisothiazoline-3-one | 0.02 g |
| Polyoxyethylene-p-monononylphenyl ether (an average polymerization degree: 10) | 0.3 g |
| Water was added to make the total quantity | 1000 ml |
| pH | 7.0 |

The samples of the present invention had an excellent color reproducibility and a good color developability in every hue.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support and provided thereon at least one silver halide emulsion layer containing a cyan dye-forming coupler, a silver halide emulsion layer containing a magenta dye-forming coupler and a silver halide emulsion layer containing a yellow dye-forming coupler, wherein the silver halide emulsion layer containing the cyan dye-forming coupler contains at least one cyan dye-forming coupler represented by the following Formula (I) or (II) and the silver halide emulsion layer containing the yellow dye-forming coupler contains at least one yellow dye-forming coupler represented by the following Formula (III) or (IV):

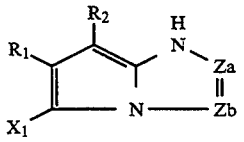

(I)

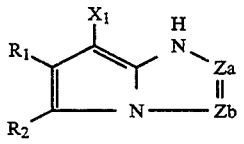

(II)

where Za represents —C($R_3$)= and and Zb is —N=; $R_1$ and $R_2$ each are an electron attractive group having a Hammett's substituents constant $\sigma_p$ of 0.2 or more and the sum of the $\sigma_p$ values of $R_1$ and $R_2$ is 0.65 or more; $R_3$ represents a hydrogen atom or a substituent; $X_1$ represents a hydrogen atom or a group capable of splitting off upon a reaction with an oxidation product of an aromatic primary amine color developing agent; the group represented by $R_1$, $R_2$, $R_3$ or $X_1$ may be a divalent group and combine with a polymer which is higher than a dimer and which has a high molecular chain to form a homopolymer or a copolymer;

(III)

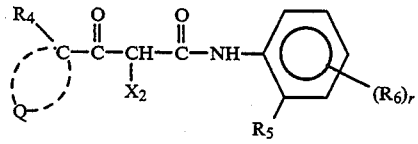

wherein, $R_4$ represents a monovalent group excluding a hydrogen atom; Q represents a group of non-metallic atoms necessary to form a 3 to 5-membered hydrocarbon ring or a 3 to 5-membered heterocyclic ring containing at least one hetero atom selected from N, S, O and P together with C, provided that $R_4$ is not combined with Q to form a ring; $R_5$ represents a hydrogen atom, a halogen atom, an alkoxy group, an aryloxy group, an alkyl group, or an amino group; $R_6$ represents a substituent group, $X_2$ represents a hydrogen atom or a group capable of splitting off upon a reaction with an oxidation product of an aromatic primary amine color developing agent; r represents an integer of 0 to 4, provided that when r is plural, $R_6$ is the same or different;

(IV)

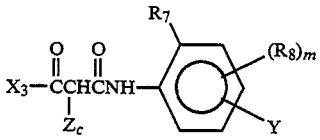

wherein $R_7$ represents a halogen atom or an alkoxy group; $X_3$ represents

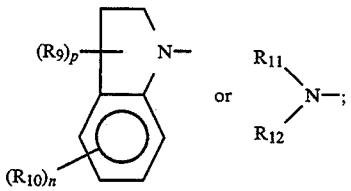

$R_8$, $R_9$ and $R_{10}$ each represents a substituent; $R_{11}$ represents an alkyl group; $R_{12}$ represents an alkyl group or an aryl group; $Z_c$ represents a group capable of splitting off upon a reaction with an oxidation product of an aromatic primary amine color developing agent; Y represents an alkoxycarbonyl group, a sulfamoyl group, a carbamoyl group, an N-sulfonylsulfamoyl group, an N-acylsulfamoyl group, an acylamino group, an N-sulfonylcarbamoyl group, or a sulfonamido group; and p, m and n represent the integers of 0 to 2, 0 to 3 and 0 to 4, respectively.

2. The silver halide color photographic light-sensitive material of claim 1, wherein $R_3$ represents a hydrogen atom, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, or an azolyl group.

3. The silver halide color photographic light-sensitive material of claim 1, wherein $R_1$ and $R_2$ each independently represents an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having $\sigma_p$ of 0.20 or more, a heterocyclic group, a halogen atom, an azo group, or a selenocyanate group.

4. The silver halide color photographic light-sensitive material of claim 1, wherein $X_1$ represents a hydrogen atom, a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino gruop, a 5-membered or 6-membered nitrogen-containing heterocyclic group, an imido group, or an arylazo group.

5. The silver halide color photographic light-sensitive material of claim 1, wherein the silver halide emulsion layer containing the cyan dye-forming coupler represented by Formula (I) or (II) is a red-sensitive emulsion layer.

6. The silver halide color photographic light-sensitive material of claim 1, wherein the cyan dye-forming coupler is represented by Formula (I).

7. The silver halide color photographic light-sensitive material of claim 1, wherein the amount of cyan dye-forming coupler represented by formula (I) or (II) is present in an amount of $1\times10^{-3}$ mol to 1 mol per mol of silver halide in said silver halide emulsion layer containing the cyan dye-forming coupler.

8. The silver halide color photographic material of claim 1, wherein $R_4$ represents a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an acyloxy group, a nitro group, a heterocyclic group, a cyano group, an acyl group, an amino group, an imido group, an alkylsulfonyloxy group, an arylsulfonyloxy group, a carboxyl group, a sulfo group, or a hydroxy group.

9. The silver halide color photographic material of claim 1, wherein Q represents a group of non-metallic atoms necessary to form a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thietane ring, a thiolane ring, or a pyrrolidine ring.

10. The silver halide color photographic material of claim i, wherein $R_6$ represents a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an acyloxy group, a nitro group, a heterocyclic group, a cyano group, an acyl group, an amino group, an imido group, an alkylsulfonyloxy group, an arylsulfonyloxy group, a carboxyl group, a sulfo group, or a hydroxy group.

11. The silver halide color photographic material of claim 1, wherein $X_2$represents a hydrogen atom, a heterocyclic group bonded to a coupling active site via a nitrogen atom, an aryloxy group, an arylthio group, an acyloxy group, an alkylsulfonyloxy group, an arylsulfonyloxy group, a heterocyclic oxy group, or a halogen atom.

12. The silver halide color photographic material of claim 1, wherein $R_8$, $R_9$ and $R_{10}$ each represents a halogen atom, an alkoxycarbonyl group, an acylamino group, a sulfonamido group, a carbamoyl group, an N-sulfonylcarbamoyl group, a sulfamoyl group, an alkoxy group, an aryloxy group, an aryloxycarbonyl group, an N-acylsulfamoyl group, a sulfonyl group, an alkoxycarbonylamino group, a cyano group, a nitro group, a carboxyl group, a hydroxyl group, a sulfo group, an alkylthio group, a ureido group, an aryl group, a heterocyclic group, a linear, branched or cyclic alkyl group, an acyl group, an acyloxy group, an arylthio group, a sulfamoylamino group, or an N-sulfonylsulfamoyl group.

13. The silver halide color photographic material of claim 1, wherein $Z_c$ represents a nitrogen-containing heterocyclic group bonded to a coupling site via a nitrogen atom, an aryloxy group, or a heterocyclic oxy group.

14. The silver halide color photographic material of claim 3, wherein $R_1$ and $R_2$ each represents an alkoxycarbonyl group, a nitro group, a cyano group, an arylsulfonyl group, a carbamoyl group, a halogenated alkyl group or an aryloxycarbonyl group.

15. The silver halide color photographic material of claim 14, wherein $R_1$ is a cyano group and $R_2$ is a branched alkoxycarbonyl group.

16. The silver halide color photographic material of claim 1, wherein the yellow dye-forming coupler represented by formula (III) or (IV) is present in an amount of $1\times10^{-5}$ to $1\times10^{-2}$ mol per $m^2$ of the light-sensitive material.

* * * * *